US008401765B2

(12) United States Patent
Iwazaki et al.

(10) Patent No.: US 8,401,765 B2
(45) Date of Patent: Mar. 19, 2013

(54) INTER-CYLINDER AIR-FUEL RATIO IMBALANCE DETERMINATION APPARATUS FOR INTERNAL COMBUSTION ENGINE

(75) Inventors: Yasushi Iwazaki, Ebina (JP); Hiroshi Sawada, Gotenba (JP); Hiroshi Miyamoto, Susono (JP); Fumihiko Nakamura, Susono (JP); Keiichiro Aoki, Shizuoka-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/516,841

(22) PCT Filed: Dec. 18, 2009

(86) PCT No.: PCT/JP2009/071717

§ 371 (c)(1),
(2), (4) Date: Jul. 16, 2012

(87) PCT Pub. No.: WO2011/074132

PCT Pub. Date: Jun. 23, 2011

(65) Prior Publication Data

US 2012/0277980 A1 Nov. 1, 2012

(51) Int. Cl.

| | |
|---|---|
| ***F02D 41/26*** | (2006.01) |
| *F02D 41/30* | (2006.01) |
| *F02B 77/08* | (2006.01) |

(52) U.S. Cl. ..... 701/104

(58) Field of Classification Search ..... 701/104, 701/103, 107, 109, 111, 114

See application file for complete search history.

(56) References Cited

U.S. PATENT DOCUMENTS

| | | | | |
|---|---|---|---|---|
| 5,289,808 | A * | 3/1994 | Takahashi et al. | 123/406.55 |
| 7,152,594 | B2 | 12/2006 | Anilovich et al. | |
| 2011/0192146 | A1 * | 8/2011 | Sugimoto et al. | 60/276 |

FOREIGN PATENT DOCUMENTS

| | | |
|---|---|---|
| JP | A-11-072473 | 3/1999 |
| JP | A-2000-065782 | 3/2000 |

(Continued)

OTHER PUBLICATIONS

Feb. 23, 2010 International Search Report and Written Opinion issued in Application No. PCT/JP2009/071717 (with English translation).

*Primary Examiner* — Hieu T Vo
(74) *Attorney, Agent, or Firm* — Oliff & Berridge, PLC

(57) ABSTRACT

An inter-cylinder air-fuel ratio imbalance determination apparatus that obtains, based on an output value Vabyfs of an air-fuel ratio sensor, an air-fuel ratio fluctuation indicating amount (AFD) which becomes larger as an air-fuel ratio fluctuation of an exhaust gas passing through a position at which the air-fuel ratio sensor is disposed becomes larger, during a parameter obtaining period. The determination apparatus estimates an air-fuel ratio sensor element temperature (Temps) having a strong relation with responsiveness of the air-fuel ratio sensor during the parameter obtaining period, and obtains a corrected air-fuel ratio fluctuation indicating amount by correcting the AFD based on the estimated Temps. The determination apparatus adopts the corrected air-fuel ratio fluctuation indicating amount as the imbalance determination parameter X, and determines whether or not an inter-cylinder air-fuel-ratio imbalance state has been occurring based on a comparison between the imbalance determination parameter X and the imbalance determination threshold Xth.

4 Claims, 25 Drawing Sheets

FOREIGN PATENT DOCUMENTS

| | | |
|---|---|---|
| JP | A-2001-074693 | 3/2001 |
| JP | A-2002-048761 | 2/2002 |
| JP | A-2003-107035 | 4/2003 |
| JP | A-2003-328848 | 11/2003 |
| JP | A-2004-069547 | 3/2004 |
| JP | A-2007-017191 | 1/2007 |
| JP | A-2009-013967 | 1/2009 |
| JP | A-2009-074559 | 4/2009 |
| JP | A-2009-257245 | 11/2009 |
| JP | A-2009-264287 | 11/2009 |

* cited by examiner

INTER-CYLINDER AIR-FUEL RATIO IMBALANCE DETERMINATION APPARATUS FOR INTERNAL COMBUSTION ENGINE

TECHNICAL FIELD

The present invention relates to an "inter-cylinder air-fuel ratio imbalance determination apparatus for an internal combustion engine," which is applied to a multi-cylinder internal combustion engine, and which can determine (monitor/detect) that an imbalance among the air-fuel ratios of air-fuel mixtures, each supplied to each of cylinders (inter-cylinder air-fuel ratio imbalance; inter-cylinder air-fuel ratio variation; or inter-cylinder air-fuel ratio non-uniformity) has increased excessively.

BACKGROUND ART

Conventionally, as shown in FIG. 1, there has been widely known an air-fuel ratio control apparatus which includes a three-way catalyst (53) disposed in an exhaust passage of an internal combustion engine, and an upstream air-fuel ratio sensor (67) and a downstream air-fuel ratio sensor (68) that are disposed upstream and downstream, respectively, of the three-way catalyst (53).

This air-fuel ratio control apparatus calculates, based on the outputs of the upstream and downstream air-fuel ratio sensors, an "air-fuel ratio feedback amount for having the air-fuel ratio of the air-fuel mixture supplied to the engine (air-fuel ratio of the engine) coincide with the stoichiometric air-fuel ratio" in such a manner that the air-fuel ratio of the engine coincides with the stoichiometric air-fuel ratio, and is configured so as to feedback-control the air-fuel ratio of the engine based on the air-fuel ratio feedback amount. Further, there has been also widely known an air-fuel ratio control apparatus, which calculates, based on the output of the upstream air-fuel ratio sensor only, an "air-fuel ratio feedback amount for having the air-fuel ratio of the engine coincide with the stoichiometric air-fuel ratio", and which is configured so as to feedback-control the air-fuel ratio of the engine based on the air-fuel ratio feedback amount. The air-fuel ratio feedback amount used in each of those air-fuel ratio control apparatuses is a control amount commonly used for all of the cylinders.

Meanwhile, in general, an electronic-fuel-injection-type internal combustion engine has at least one fuel injection valve (39) at each of the cylinders or at each of intake ports communicating with the respective cylinders. Accordingly, when the characteristic/property of the fuel injection valve of a certain specific cylinder changes to a "characteristic that it injects fuel in an amount excessively larger than an instructed fuel injection amount", only the air-fuel ratio of an air-fuel mixture supplied to that certain specific cylinder (the air-fuel ratio of the specific cylinder) greatly changes toward the rich side. That is, an air-fuel ratio non-uniformity among the cylinders (inter-cylinder air-fuel ratio variation; inter-cylinder air-fuel ratio imbalance) becomes large. In other words, there arises an imbalance among "cylinder-by-cylinder air-fuel ratios," each of which is the air-fuel ratio of the air-fuel mixture supplied to each of the cylinders.

In such a case, the average of the air-fuel ratios of the air-fuel mixtures supplied to the entire engine becomes an air-fuel ratio richer than the stoichiometric air-fuel ratio. Accordingly, by the air-fuel ratio feedback amount commonly used for all of the cylinders, the air-fuel ratio of the above-mentioned specific cylinder is changed toward the lean side so as to come closer to the stoichiometric air-fuel ratio, and, at the same time, the air-fuel ratios of the remaining cylinders are changed toward the lean side so as to deviate from the stoichiometric air-fuel ratio. As a result, the average of the air-fuel ratios of the air-fuel mixtures supplied to the entire engine is made to become substantially equal to the stoichiometric air-fuel ratio.

However, since the air-fuel ratio of the specific cylinder is still in the rich side in relation to the stoichiometric air-fuel ratio and the air-fuel ratios of the remaining cylinders are in the lean side in relation to the stoichiometric air-fuel ratio, combustion of the air-fuel mixture in each of the cylinders fail to become complete combustion. As a result, the amount of emissions (the amount of unburned combustibles and/or the amount of nitrogen oxides) discharged from each of the cylinders increases. Therefore, even when the average of the air-fuel ratios of the air-fuel mixtures supplied to the engine is equal to the stoichiometric air-fuel ratio, the increased emissions cannot be completely removed by the three-way catalyst. Consequently, the amount of emissions may increase.

Accordingly, in order to prevent emissions from increasing, it is important to detect a state in which the air-fuel ratio non-uniformity among the cylinders becomes excessively large (generation of an inter-cylinder air-fuel ratio imbalance state) so as to take some measures against the imbalance state. It should be noted that, the inter-cylinder air-fuel ratio imbalance also occurs in a case where the characteristic of the fuel injection valve of the certain specific cylinder changes to a "characteristic that it injects fuel in an amount excessively smaller than the instructed fuel injection amount", or the like.

One of such conventional apparatuses for determining whether or not an inter-cylinder air-fuel ratio imbalance state has occurred is configured so as to obtain a trace/trajectory length of an output value (output signal) of an air-fuel ratio sensor (the above-mentioned upstream air-fuel ratio sensor 67) disposed at an exhaust merging/aggregated region/portion into which exhaust gases from a plurality of the cylinders of the engine merge, compare the trace length with a "reference value which changes in accordance with the rotational speed of the engine," and determine whether or not the inter-cylinder air-fuel ratio imbalance state has occurred based on the result of the comparison (see, for example, U.S. Pat. No. 7,152,594).

It should be noted that, in the present specification, the expression of "an inter-cylinder air-fuel ratio imbalance state has been occurring" means a state in which the difference between the cylinder-by-cylinder air-fuel ratios (cylinder-by-cylinder air-fuel ratio difference) is equal to or greater than an allowable value" has been occurring; in other words, it means an excessive inter-cylinder air-fuel ratio imbalance state has been occurring in which the amount of unburned combustibles and/or nitrogen oxides exceeds a prescribed value. The determination as to whether or not the "inter-cylinder air-fuel ratio imbalance state has been occurring" will be simply referred to as an "inter-cylinder air-fuel ratio imbalance determination" or an "imbalance determination." Moreover, a cylinder supplied with an air-fuel mixture whose air-fuel ratio deviates from the air-fuel ratio of air-fuel mixtures supplied to the remaining cylinders (for example, an air-fuel ratio approximately equal to the stoichiometric air-fuel ratio) will also be referred to as an "imbalanced cylinder." The air-fuel ratio of the air-fuel mixture supplied to such an imbalanced cylinder will also be referred to as an "air-fuel ratio of the imbalanced cylinder." The remaining cylinders (cylinders other than the imbalanced cylinder) will also be referred to as "normal cylinders" or "balanced cylinders." The air-fuel ratio of air-fuel mixtures supplied to such normal cylinders will also be referred as an "air-fuel ratio of the normal cylinder" or an "air-fuel ratio of the balanced cylinder."

In addition, a parameter (e.g., the above-mentioned trace length of the output value of the air-fuel ratio sensor), whose absolute value becomes larger as the difference between the cylinder-by-cylinder air-fuel ratios (the difference between the air-fuel ratio of the imbalanced cylinder and those of the normal cylinders) becomes larger will also be referred to as an "air-fuel ratio fluctuation indicating amount." That is, the air-fuel ratio fluctuation indicating amount is a "value obtained based on the output value of the above-mentioned air-fuel ratio sensor" in such a manner that its absolute value becomes larger as the air-fuel ratio variation/fluctuation of the exhaust gas reaching the above-mentioned air-fuel ratio sensor becomes larger. Further, a value, which is obtained based on the air-fuel ratio fluctuation indicating amount, and which becomes larger as the absolute value of the air-fuel ratio fluctuation indicating amount becomes larger, will also be referred to as an "imbalance determination parameter." In other words, the imbalance determination parameter is a parameter which becomes larger as the fluctuation/variation of the air-fuel ratio of the exhaust gas passing through the position at which the air-fuel ratio sensor is disposed becomes larger. This imbalance determination parameter is compared with an imbalance determination threshold in order to perform (carry out) the imbalance determination.

SUMMARY OF THE INVENTION

As shown in (A) of FIG. 2, for example, a well-known air-fuel ratio sensor includes an air-fuel ratio detecting section, which includes at least a solid electrolyte layer (671), an exhaust-gas-side electrode layer (672), an atmosphere-side electrode layer (673), a diffusion resistance layer (674), and a heater (678).

The exhaust-gas-side electrode layer (672) is formed on one of surfaces of the solid electrolyte layer (671). The exhaust-gas-side electrode layer (672) is covered with the diffusion resistance layer (674). Exhaust gas within an exhaust passage reaches an outer surface of the diffusion resistance layer (674), and reaches the exhaust-gas-side electrode layer (672) after passing through the diffusion resistance layer (674). The atmosphere-side electrode layer (673) is formed on the other one of surfaces of the solid electrolyte layer (671). The atmosphere-side electrode layer (673) is exposed to an atmosphere chamber (67A) into which atmospheric air is introduced. The heater (678) generates a heat when energized so as to adjust a temperature of a sensor element section. The sensor element section includes at least the solid electrolyte layer (671), the exhaust-gas-side electrode layer (672), and the atmosphere-side electrode layer (673).

As shown in (B) and (C) of FIG. 2, a voltage (Vp) is applied between the exhaust-gas-side electrode layer (672) and the atmosphere-side electrode layer (673) so as to generate a "limiting current which varies in accordance with the air-fuel ratio of the exhaust gas." In general, this voltage is applied such that the potential of the atmosphere-side electrode layer (673) is higher than that of the exhaust-gas-side electrode layer (672).

As shown in (B) of FIG. 2, when an excessive amount of oxygen is contained in the exhaust gas reaching the exhaust-gas-side electrode layer (672) after passing through the diffusion resistance layer (674) (that is, when the air-fuel ratio of the exhaust gas reaching the exhaust-gas-side electrode layer is leaner than the stoichiometric air-fuel ratio), the oxygen is led in the form of oxygen ion from the exhaust-gas-side electrode layer (672) to the atmosphere-side electrode layer (673) owing to the above-mentioned voltage and an oxygen pump characteristic of the solid electrolyte layer (671).

In contrast, as shown in (C) of FIG. 2, when excessive unburned combustibles are contained in the exhaust gas reaching the exhaust-gas-side electrode layer (672) after passing through the diffusion resistance layer (674) (that is, when the air-fuel ratio of the exhaust gas reaching the exhaust-gas-side electrode layer is richer than the stoichiometric air-fuel ratio), oxygen within the atmosphere chamber (67A) is led in the form of oxygen ion from the atmosphere-side electrode layer (673) to the exhaust-gas-side electrode layer (672) owing to an oxygen cell characteristic of the solid electrolyte layer (671), so as to react with the unburned combustibles at the exhaust-gas-side electrode layer (672).

Because of the presence of the diffusion resistance layer (674), a moving amount of such oxygen ions is limited to a value corresponding to the "air-fuel ratio of the exhaust gas reaching the outer surface of the diffusion resistance layer (674)." In other words, a current generated as a result of movement of the oxygen ions has a value corresponding to the air-fuel ratio (A/F) of the exhaust gas (that is, limiting current Ip) (see FIG. 3).

The air-fuel ratio sensor outputs an output value Vabyfs corresponding to the "air-fuel ratio of the exhaust gas passing through the position at which the air-fuel ratio sensor is disposed", based on the limiting current (the current flowing through the solid electrolyte layer owing to the application of the voltage between the exhaust-gas-side electrode layer and the atmosphere-side electrode layer). This output value Vabyfs is generally converted into a detected air-fuel ratio abyfs based on a previously obtained "relationship between the output value Vabyfs and the air-fuel ratio, shown in FIG. 4." As understood from FIG. 4, the output value Vabyfs is substantially proportional to the detected air-fuel ratio abyfs.

Meanwhile, the air-fuel ratio fluctuation indicating amount which is a "base data for the imbalance determination parameter" is not limited to the trace length of "the output value Vabyfs of the air-fuel ratio sensor or the detected air-fuel ratio abyfs," but may be any one of values which reflect a fluctuation of the air-fuel ratio of the exhaust gas flowing through the position at which the air-fuel ratio sensor is disposed (e.g., a fluctuation amount of one of those per/for a predetermined period). This point will be described further.

Exhaust gases from the cylinders successively reach the air-fuel ratio sensor in the order of ignition (accordingly, in the order of exhaust). In a case where no inter-cylinder air-fuel ratio imbalance state has been occurring, the air-fuel ratios of the exhaust gases discharged from the cylinders are approximately equal to one another. Accordingly, in the case where no inter-cylinder air-fuel ratio imbalance state has been occurring, as shown by a broken line C1 in (B) of FIG. 5, the waveform of the output value Vabyfs of the air-fuel ratio sensor (in (B) of FIG. 5, the waveform of the detected air-fuel ratio abyfs) is almost flat.

In contrast, in a case where there has been occurring an "inter-cylinder air-fuel ratio imbalance state in which only the air-fuel ratio of a specific cylinder (for example, the first cylinder) has deviated toward the rich side from the stoichiometric air-fuel ratio (specific-cylinder rich-side-deviated imbalance state)," the air-fuel ratio of the exhaust gas from the specific cylinder greatly differs from those of the exhaust gases from the cylinders (the remaining cylinders) other than the specific cylinder.

Accordingly, as shown by a solid line C2 in (B) of FIG. 5, the waveform of the output value Vabyfs of the air-fuel ratio sensor (in (B) of FIG. 5, the waveform of the detected air-fuel ratio abyfs) in a case where the specific-cylinder rich-side-deviated imbalance state has been occurring greatly fluctuates, specifically, in a case of a four-cylinder, four-cycle engine, the waveform of the output value Vabyfs of the air-fuel ratio sensor greatly fluctuates every 720° crank angle (the crank angle required for all of the cylinders, each of which discharges exhaust gas which reaches a single air-fuel ratio sensor, to complete their single-time combustion strokes). It should be noted that, in the present specification, a "period corresponding to the crank angle required for all of the cylinders, each of which discharges the exhaust gas which reaches the single air-fuel ratio sensor, to complete their single-time combustion strokes" will also be referred to as a "unit combustion cycle period."

Further, an amplitude of the output value Vabyfs of the air-fuel ratio sensor and that of the detected air-fuel ratio abyfs become larger, and those values fluctuates more greatly, as the air-fuel ratio of the imbalanced cylinder deviates more greatly from the air-fuel ratios of the balanced cylinders. For example, assuming that the detected air-fuel ratio abyfs varies as shown by a solid line C2 in (B) of FIG. 5 when a difference between the air-fuel ratio of the imbalanced cylinder and the air-fuel ratios of the balanced cylinders is equal to a first value, the detected air-fuel ratio abyfs varies as shown by an alternate long and short dash line C2*a* in (B) of FIG. 5 when the difference between the air-fuel ratio of the imbalanced cylinder and the air-fuel ratios of the balanced cylinders is equal to a "second value larger than the first value."

Accordingly, a change amount per unit time "of the output value Vabyfs of the air-fuel ratio sensor or of the detected air-fuel ratio abyfs" (i.e., a first order differential value of the output value Vabyfs of the air-fuel ratio sensor or of the detected air-fuel ratio abyfs with respect to time, refer to angles $\alpha$1, $\alpha$2 shown in (B) of FIG. 5) fluctuates slightly as shown by a broken line C3 in (C) of FIG. 5 when the cylinder-by-cylinder air-fuel ratio difference is small, and fluctuates greatly as shown by a solid line C4 in (C) of FIG. 5 when the cylinder-by-cylinder air-fuel ratio difference is large. That is, an absolute value of the differential value d(Vabyfs)/dt or of the differential value d(abyfs/dt) becomes larger as the degree of the inter-cylinder air-fuel-ratio imbalance state becomes larger (as the cylinder-by-cylinder air-fuel ratio difference becomes larger).

In view of the above, for example, "a maximum value or a mean value" of the absolute values of "the differential values d(Vabyfs)/dt or the differential values d(abyfs/dt)", that are obtained a plurality of times in the unit combustion cycle period can be adopted as the air-fuel ratio fluctuation indicating amount. Further, the air-fuel ratio fluctuation indicating amount itself or a mean value of the air-fuel ratio fluctuation indicating amounts obtained for a plurality of the unit combustion cycle periods can be adopted as the imbalance determination parameter.

Further, as shown in (D) of FIG. 5, a change amount of the change amount "of the output value Vabyfs of the air-fuel ratio sensor or of the detected air-fuel ratio abyfs" (i.e., a second order differential value $d^2$(Vabyfs)/$dt^2$ or a second order differential value $d^2$(abyfs)/$dt^2$) hardly fluctuates as shown by a broken line C5 when the cylinder-by-cylinder air-fuel ratio difference is small, but greatly fluctuates as shown by a solid line C6 when the cylinder-by-cylinder air-fuel ratio difference is large.

In view of the above, for example, "a maximum value or a mean value" of the absolute values of "the second order differential values $d^2$(Vabyfs)/$dt^2$ or the second order differential values $d^2$(abyfs)/$dt^2$", that are obtained a plurality of times in the unit combustion cycle period can also be adopted as the air-fuel ratio fluctuation indicating amount. Further, the air-fuel ratio fluctuation indicating amount itself or a mean value of the air-fuel ratio fluctuation indicating amounts obtained for a plurality of the unit combustion cycle periods can be adopted as the imbalance determination parameter.

The inter-cylinder air-fuel ratio imbalance determination apparatus determines whether or not the inter-cylinder air-fuel-ratio imbalance state has been occurring by determining whether or not the imbalance determination parameter thus obtained is larger than the predetermined threshold (imbalance determination threshold).

However, the present inventor(s) has/have acquired findings/knowledge that a state occurs in which the inter-cylinder air-fuel ratio imbalance determination cannot be performed accurately, because the imbalance determination parameter varies depending on the air-fuel ratio sensor element temperature even when the degree of the fluctuation of the air-fuel ratio of the exhaust gas (i.e., the cylinder-by-cylinder air-fuel ratio difference which represents the degree of the inter-cylinder air-fuel ratio imbalance state) remains unchanged. Hereinafter, the reason for this will be described. It should be noted that the air-fuel ratio sensor element temperature is a temperature of the sensor element section (the solid electrolyte layer, the exhaust-gas-side electrode layer, and the atmosphere-side electrode layer) which includes the solid electrolyte layer of the air-fuel ratio sensor.

FIG. 6 is a graph showing a relation between the temperature of the air-fuel ratio sensor element section and the responsiveness of the air-fuel ratio sensor. In FIG. 6, a response time t representing the responsiveness of the air-fuel ratio sensor is, for example, a time (duration) from a "specific point in time" at which an "air-fuel ratio of the exhaust gas which is present in the vicinity of the air-fuel ratio sensor" is changed from a "first air-fuel ratio (e.g., 14) richer than the stoichiometric air-fuel ratio" to a "second air-fuel ratio (e.g., 15) leaner than the stoichiometric air-fuel ratio" to a point in time at which the detected air-fuel ratio abyfs changes to a third air-fuel ratio which is between the first air-fuel ratio and the second air-fuel ratio (e.g., the third air-fuel ratio being $14.63=14+0.63\cdot(15-14)$). Accordingly, the responsiveness of the air-fuel ratio sensor is better (higher) as the response time t is shorter.

As understood from FIG. 6, the responsiveness of the air-fuel ratio sensor is better as the air-fuel ratio sensor element temperature is higher. It is inferred that the reason for that is the reaction (oxidation-reduction reaction) at the sensor element section (especially, at the exhaust-gas-side electrode layer) becomes more active.

Meanwhile, as described above, when the inter-cylinder air-fuel ratio imbalance state has been occurring, the air-fuel ratio of the exhaust gas fluctuates/varies greatly such that the cycle coincides with the unit combustion cycle. However, if the air-fuel ratio sensor element temperature is low, the responsiveness of the air-fuel ratio sensor is low, and thus, the output value of the air-fuel ratio sensor can not sufficiently follow the "fluctuation/variation of the air-fuel ratio of the exhaust gas." Therefore, the air-fuel ratio fluctuation indicating amount and the imbalance determination parameter become smaller than the original values (values they should take). As a result, the inter-cylinder air-fuel ratio imbalance determination cannot be performed accurately (refer to FIG. 11).

On the other hand, if an amount of heat generation of the heater is adjusted so as to always maintain the air-fuel ratio sensor element temperature at high temperature, the imbalance determination parameter with high accuracy can be obtained. However, when the air-fuel ratio sensor element temperature is always maintained at high temperature, the air-fuel ratio sensor may deteriorate (deteriorate with age) relatively earlier.

In view of the above, one of objects of the present invention is to provide an apparatus (hereinafter, also referred to as a "present invention apparatus"), which performs an inter-cylinder air-fuel ratio imbalance determination using "the air-fuel ratio fluctuation indicating amount and the imbalance determination parameter," obtained based on the output value of the air-fuel ratio sensor as described above, and which can more accurately perform the inter-cylinder air-fuel ratio imbalance determination.

The present invention apparatus estimates the air-fuel ratio sensor element temperature, and determines the imbalance determination parameter by correcting, based on the estimated air-fuel ratio sensor element temperature, the air-fuel ratio fluctuation indicating amount, or determines, based on the estimated air-fuel ratio sensor element temperature, the imbalance determination threshold.

More specifically, one of aspects of the present invention apparatus is applied to a multi-cylinder internal combustion engine having a plurality of cylinders, and includes an air-fuel ratio sensor, a plurality of fuel injection valves (injectors), and imbalance determining means.

The air-fuel ratio sensor is disposed in an exhaust merging portion of an exhaust passage of the engine into which exhaust gases discharged from at least two or more (preferably, three or more) of the cylinders among a plurality of the cylinders merge, or is disposed in the exhaust passage at a position/location downstream of the exhaust merging portion.

Further, the air-fuel ratio sensor includes an air-fuel ratio detecting section having a solid electrolyte layer, an exhaust-gas-side electrode layer formed on one of surfaces of the solid electrolyte layer, a diffusion resistance layer which covers the exhaust-gas-side electrode layer and at which the exhaust gases arrive, and an atmosphere-side electrode layer which is formed on the other one of the surfaces of the solid electrolyte layer and is exposed to an atmosphere chamber.

In addition, the air-fuel ratio sensor outputs an output value corresponding to an "air-fuel ratio of the exhaust gas passing through the position at which the air-fuel ratio sensor is disposed" based on a "limiting current flowing through the solid electrolyte layer owing to an application of a voltage between the exhaust-gas-side electrode layer and the atmosphere-side electrode layer."

Each of a plurality of the fuel injection valves is disposed in such a manner that each of the injection valves corresponds to each of the above-mentioned at least two or more of the cylinders, and injects fuel contained in an air-fuel mixture supplied to a combustion chamber of the corresponding cylinder. That is, one or more fuel injection valves are provided for each cylinder. Each of the fuel injection valves injects fuel to the cylinder corresponding to that fuel injection valve.

The imbalance determining means:

(1) obtains, based on the "output value of the air-fuel ratio sensor", an air-fuel ratio fluctuation indicating amount which becomes larger as a variation/fluctuation of the air-fuel ratio of the "exhaust gas passing/flowing through the position at which the air-fuel ratio sensor is disposed" becomes larger, in a "parameter obtaining period" which is a "period for/in which a predetermined parameter obtaining condition is being satisfied";

(2) makes a comparison between an "imbalance determination parameter obtained based on the obtained air-fuel ratio fluctuation indicating amount" and a "predetermined imbalance determination threshold";

(3) determines that an "inter-cylinder air-fuel ratio imbalance state has occurred", when the imbalance determination parameter is larger than the imbalance determination threshold, and determines that the "inter-cylinder air-fuel ratio imbalance state has not occurred", when the imbalance determination parameter is smaller than the imbalance determination threshold.

The air-fuel ratio fluctuation indicating amount may be, for example, one of; "a maximum value or a mean value" of absolute values of "the above mentioned differential values d(Vabyfs)/dt or the above mentioned differential values d(abyfs/dt)" for a predetermined period (e.g., for the unit combustion cycle period); "a maximum value or a mean value" of the absolute values of "the second order differential values $d^2(Vabyfs)/dt^2$ or the second order differential values $d^2(abyfs)/dt^2$" for a predetermined period (e.g., for the unit combustion cycle period); a trace length and the like of "the output value Vabyfs or the detected air-fuel ratio abyfs" for a predetermined period (e.g., for the unit combustion cycle period); and a value based on one of those values. The air-fuel ratio fluctuation indicating amount is not limited to those values.

Further, the imbalance determining means includes element temperature estimating means, and pre-comparison preparation means.

The element temperature estimating means is configured so as to estimate an air-fuel ratio element temperature which is a temperature of the solid electrolyte layer during/for the parameter obtaining period The pre-comparison preparation means is configured so as to perform/make at least one of determinations before performing the comparison between the imbalance determination parameter and the imbalance determination threshold, wherein a. one of the determinations being to obtain a corrected air-fuel ratio fluctuation indicating amount by performing, on (onto) the obtained air-fuel ratio fluctuation indicating amount, a correction to decrease the obtained air-fuel ratio fluctuation indicating amount as the estimated air-fuel ratio element temperature becomes higher with respect to a specific temperature, and/or, a correction to increase the obtained air-fuel ratio fluctuation indicating amount as the estimated air-fuel ratio element temperature becomes lower with respect to the specific temperature, and to determine, as the imbalance determination parameter, a value corresponding to (in accordance with) the corrected air-fuel ratio fluctuation indicating amount; and b. the other of the determinations being to determine, based on the estimated air-fuel ratio element temperature, the imbalance determination threshold, in such a manner that the imbalance determination threshold decreases as the estimated air-fuel ratio element temperature becomes lower (i.e., the imbalance determination threshold increases as the estimated air-fuel ratio element temperature becomes higher).

The responsiveness of the air-fuel ratio sensor becomes lower as the air-fuel ratio element temperature becomes lower, and accordingly, the air-fuel ratio fluctuation indicating amount obtained based on the output value of the air-fuel ratio sensor becomes smaller as the air-fuel ratio element temperature becomes lower. In other words, since the responsiveness of the air-fuel ratio sensor becomes higher as the air-fuel ratio element temperature becomes higher, the air-fuel ratio fluctuation indicating amount obtained based on the output value of the air-fuel ratio becomes larger as the air-fuel ratio element temperature becomes higher.

Accordingly, the corrected air-fuel ratio fluctuation indicating amount is obtained by performing, on the obtained air-fuel ratio fluctuation indicating amount, the correction to decrease the obtained air-fuel ratio fluctuation indicating amount as the estimated air-fuel ratio element temperature becomes higher with respect to the specific temperature, and/or, the correction to increase the obtained air-fuel ratio fluctuation indicating amount as the estimated air-fuel ratio element temperature becomes lower with respect to the specific temperature, the value corresponding to the corrected air-fuel ratio fluctuation indicating amount (e.g., the corrected air-fuel ratio fluctuation indicating amount itself, or a value obtained by multiplying the corrected air-fuel ratio fluctuation indicating amount by a positive constant) is determined as the imbalance determination parameter.

According to the configuration above, the imbalance determination parameter becomes a "value which is obtained when the air-fuel ratio element temperature is equal to (coincides with) the specific temperature (that is, when the responsiveness of the air-fuel ratio sensor is a specific responsiveness)." Consequently, the imbalance determination can be performed accurately regardless of the air-fuel ratio element temperature.

Further, when the imbalance determination threshold is determined based on the estimated air-fuel ratio element temperature in such a manner that the imbalance determination threshold becomes smaller as the estimated air-fuel ratio element temperature becomes lower, the imbalance determination threshold becomes a value enjoined by (reflecting) the responsiveness of the air-fuel ratio sensor. Consequently, the imbalance determination can be performed accurately regardless of the air-fuel ratio element temperature.

It should be noted that the aspect described above may include not only an aspect which performs only one of the determination of the imbalance determination parameter (as described above as "a") and the determination of the imbalance determination threshold (as described above as "b") but also an aspect which performs both of these determinations.

The air-fuel ratio sensor includes a heater which produces heat when a current is flowed through the heater so as to heat (up) the sensor element section including the solid electrolyte layer, the exhaust-gas-side electrode layer, and the atmosphere-side electrode layer.

An actual admittance of the solid electrolyte layer becomes larger as the air-fuel ratio element temperature becomes higher (refer to FIG. 15). An actual impedance of the solid electrolyte layer becomes smaller as the air-fuel ratio sensor element temperature becomes higher. In view of the above, the inter-cylinder air-fuel ratio imbalance determination apparatus includes heater control means to control an amount of heat generation of/from the heater in such a manner that a difference between a value corresponding to the actual "admittance or impedance" of the solid electrolyte layer and a predetermined target value becomes smaller.

In this case, it is preferable that the element temperature estimating means be configured so as to estimate the air-fuel ratio sensor element temperature based on at least a value corresponding to an amount of a current flowing through the heater.

The air-fuel ratio sensor deteriorates with age (changes with the passage of time) when a usage time of the air-fuel ratio sensor becomes long. As a result, as shown in FIG. 19, the admittance (refer to a broken line Y2) of the air-fuel ratio sensor which has deteriorated with age becomes smaller than the admittance (refer to a solid line Y1) of the air-fuel ratio sensor which has not deteriorated with age yet.

Accordingly, even when the actual admittance of the solid electrolyte layer coincides with a "certain specific admittance (e.g., Y0)", the air-fuel ratio sensor element temperature of the air-fuel ratio sensor which has deteriorated with age is higher than the air-fuel ratio sensor element temperature of the air-fuel ratio sensor has not deteriorated with age. The air-fuel ratio sensor element temperature therefore differs based on whether or not the air-fuel ratio sensor has deteriorated with age, even when the actual admittance is equal to a "target admittance serving as a target value" owing to the heater control. Consequently, if the air-fuel ratio sensor element temperature is estimated based on the admittance, the estimated air-fuel ratio sensor element temperature may be different from the actual air-fuel ratio sensor element temperature. Accordingly, when the imbalance determination parameter is determined using the "air-fuel ratio sensor element temperature estimated based on the actual admittance", it is likely that the imbalance determination parameter is not a value which represent the degree of the cylinder-by-cylinder air-fuel ratio difference with high accuracy. Similarly, when the imbalance determination threshold is determined using the "air-fuel ratio sensor element temperature estimated based on the actual admittance", it is likely that the imbalance determination threshold is not a value which reflects (is enjoined by) the responsiveness of the air-fuel ratio sensor with high accuracy.

Similarly, even when the heater control is performed based on the impedance and the actual impedance coincides with a "target impedance serving as a target value", the air-fuel ratio sensor element temperature differs based on whether or not the air-fuel ratio sensor has deteriorated with age. Consequently, if the air-fuel ratio sensor element temperature is estimated based on the impedance, the estimated air-fuel ratio sensor element temperature may be different from the actual air-fuel ratio sensor element temperature. Accordingly, when the imbalance determination parameter or the imbalance determination threshold is determined using the "air-fuel ratio sensor element temperature estimated based on the actual impedance", it is likely that those values is not a value having high accuracy.

In view of the above, it is preferable that the element temperature estimating means be configured so as to estimate the air-fuel ratio sensor element temperature based on at least a value corresponding to the amount of the current flowing through the heater. The "current flowing through the heater" may be an actually measured value of the current flowing through the heater, or an instruction value (e.g., duty signal Duty) for the current flowing through the heater.

The magnitude of the current flowing through the heater has a strong relation with the amount of heat generation of the heater, and thus, has a strong relation with the air-fuel ratio sensor element temperature. Accordingly, the air-fuel ratio sensor element temperature can be estimated accurately regardless of whether or not the air-fuel ratio sensor has deteriorated with age, by estimating the air-fuel ratio sensor element temperature based on the value corresponding to the amount of the current flowing through the heater. Consequently, the imbalance determination parameter and the imbalance determination threshold can be appropriately determined.

Further, it is preferable that the element temperature estimating means be configured so as to estimate the air-fuel ratio sensor element temperature based on an operating parameter of the engine correlating to a temperature of the exhaust gas.

Since the air-fuel ratio sensor element temperature varies depending on the exhaust gas temperature, the air-fuel ratio sensor element temperature can be more accurately estimated according to the above configuration. Consequently, the imbalance determination parameter and the imbalance determination threshold can be appropriately determined.

The imbalance determining means may be configured so as to instruct the heater control means to perform, in the parameter obtaining period, a "sensor element section temperature elevating control to have the temperature of the sensor element section during the parameter obtaining period (be) higher than the temperature of the sensor element section during a period (parameter non-obtaining period) other than the parameter-obtaining-period", and the heater control means may be configured so as to realize the sensor element section temperature elevating control by having/making the target value when it is instructed to perform the sensor element section temperature elevating control (be) different from the target value when it is not instructed to perform the sensor element section temperature elevating control.

For example, in a case in which the heater control is performed based on the actual admittance, the target value (the target admittance) during the sensor element section temperature elevating control is made higher than the target value while the sensor element section temperature elevating control is not being performed. In a case in which the heater control is performed based on the actual impedance, the target value during the sensor element section temperature elevating control is made lower than the target value while the sensor element section temperature elevating control is not being performed.

This sensor element section temperature elevating control improves the responsiveness of the air-fuel ratio sensor when the air-fuel ratio fluctuation indicating amount is obtained. Accordingly, the air-fuel ratio fluctuation indicating amount is obtained based on the output value of the air-fuel ratio sensor while the output value of the air-fuel ratio sensor can follow the fluctuation of the air-fuel ratio of the exhaust gas without a great delay. Consequently, the air-fuel ratio fluctuation indicating amount can become a value accurately representing the cylinder-by-cylinder air-fuel ratio difference, and therefore, it becomes possible to accurately determine whether or not the inter-cylinder air-fuel-ratio imbalance state has been occurring.

Further, according to the configuration described above, the air-fuel ratio sensor element temperature during the parameter non-obtaining period is controlled so as to be lower than the air-fuel ratio sensor element temperature during the parameter obtaining period. Consequently, it can be avoided for the air-fuel ratio sensor to early deteriorate (with age) due to heat as compared to the case in which the air-fuel ratio sensor element temperature is always maintained at relatively high temperature.

Figure 1:
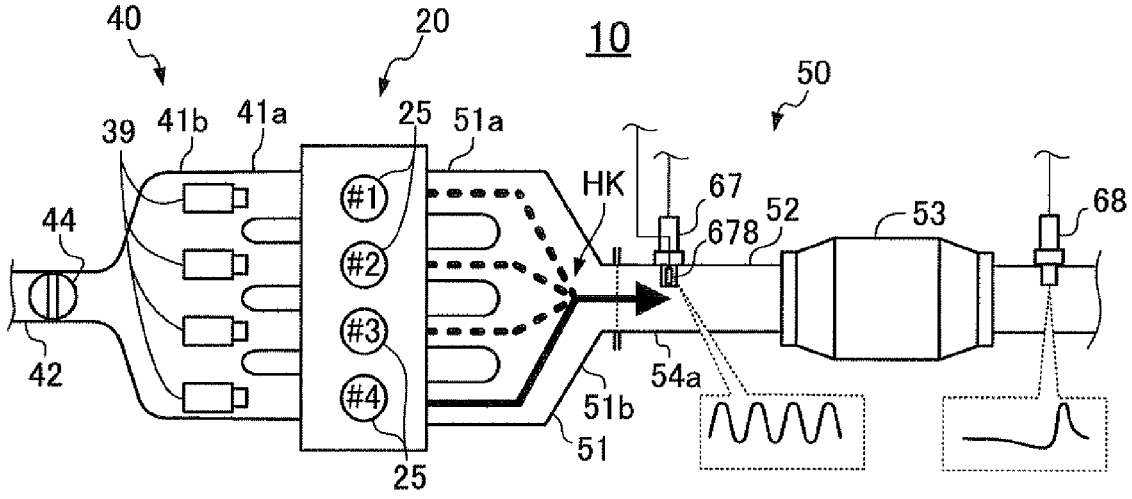
FIG. 1 is a schematic plan view of an internal combustion engine to which the inter-cylinder air-fuel ratio imbalance determination apparatus according to each of embodiments of the present invention is applied.
Figure 2:
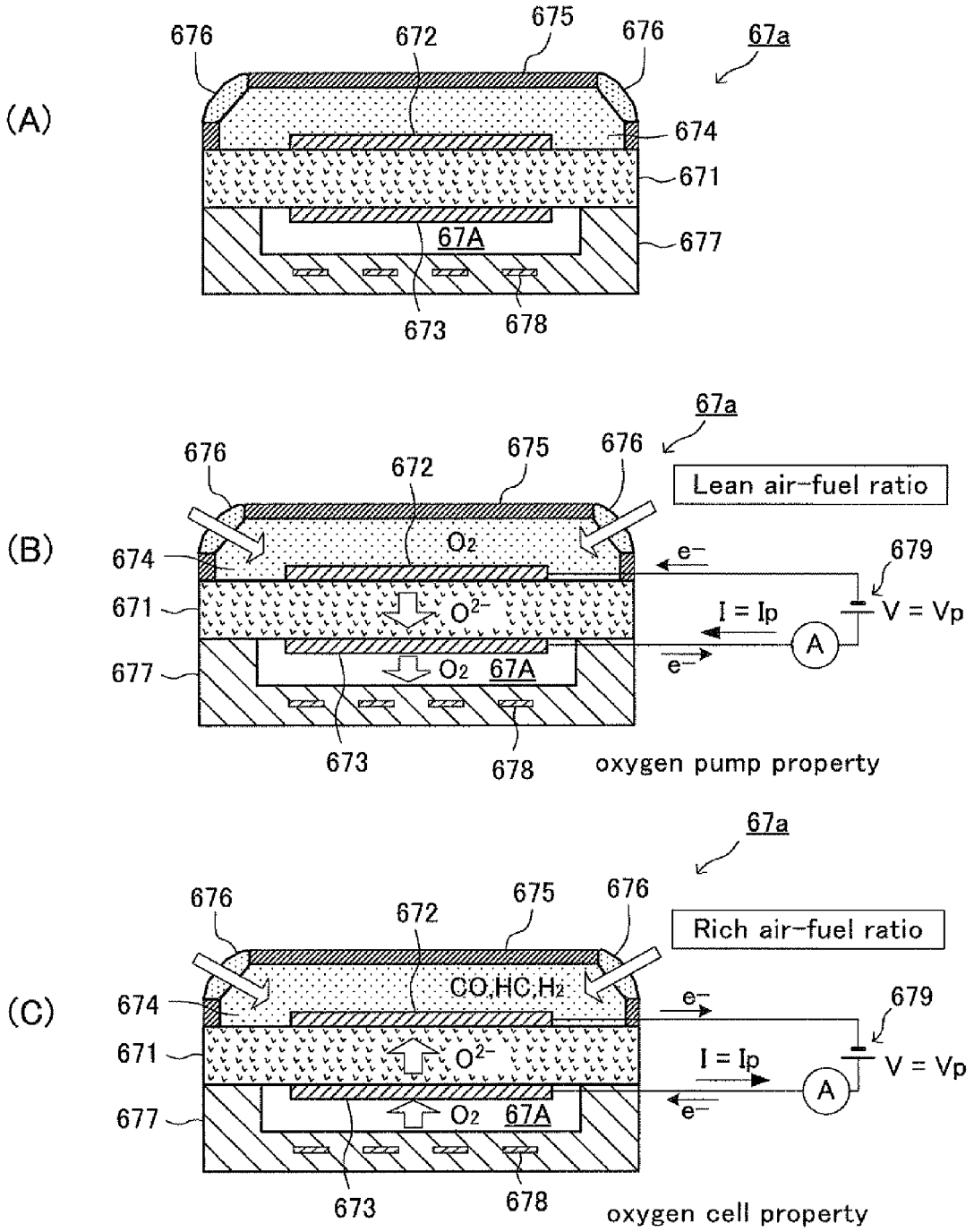

(A) to (C) of FIG. 2 are schematic sectional views of an air-fuel ratio detecting section provided in an air-fuel ratio sensor (upstream air-fuel ratio sensor) shown in FIG. 1.

Figure 3:
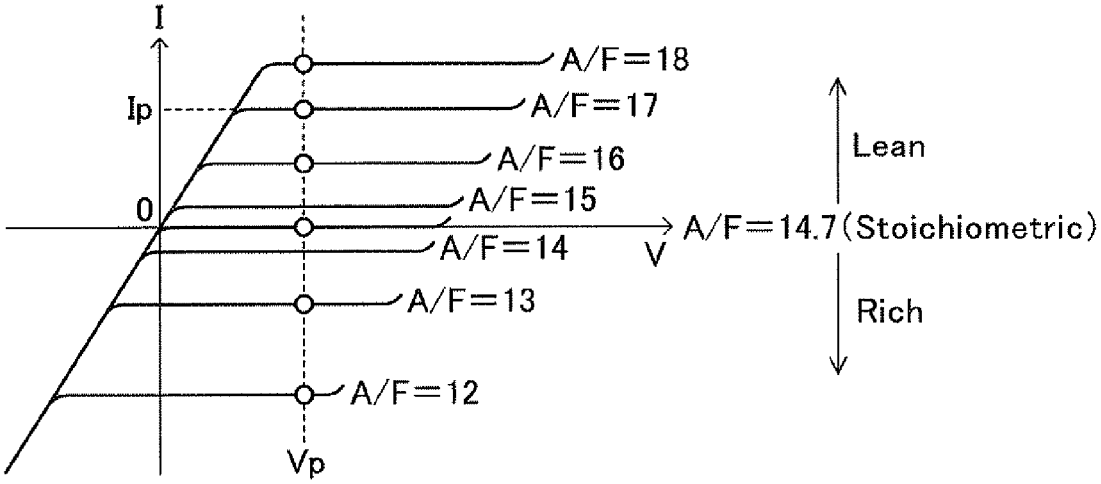

FIG. 3 is a graph showing a relation between an air-fuel ratio of an exhaust gas and a limiting current of the air-fuel ratio sensor.

Figure 4:
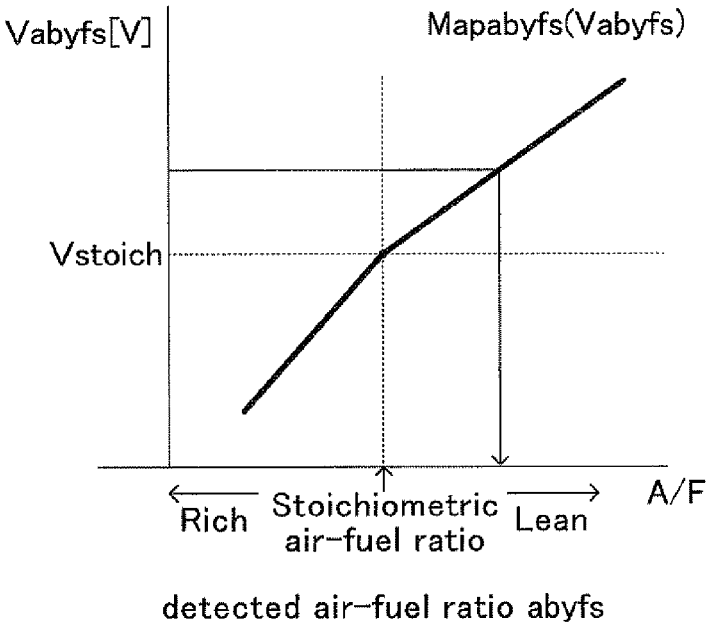

FIG. 4 is a graph showing a relation between the air-fuel ratio of the exhaust gas and an output value of the air-fuel ratio sensor.

Figure 5:
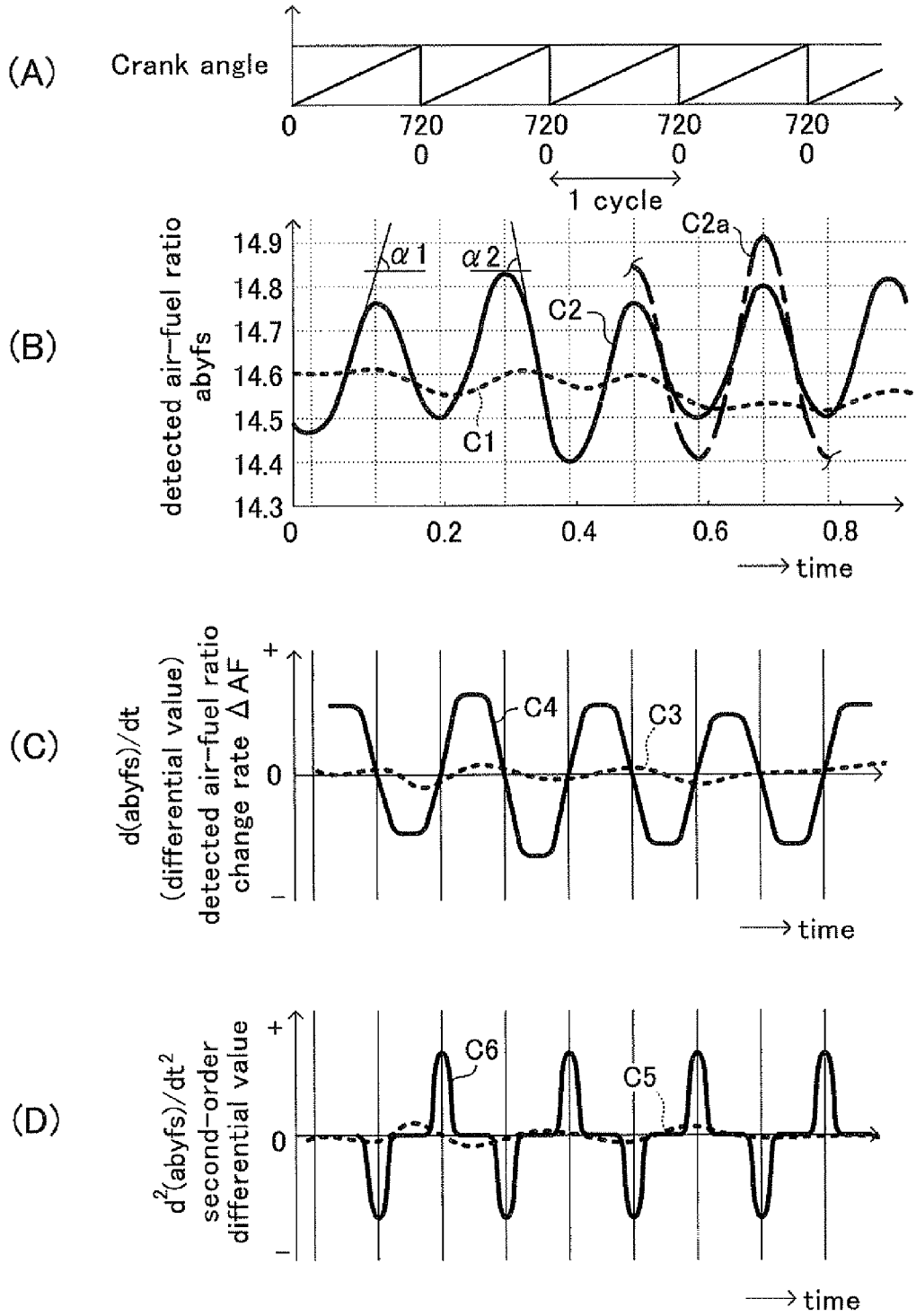

FIG. 5 is a set of time charts showing behaviors of values associated with imbalance determination parameters for a case where an inter-cylinder air-fuel ratio imbalance state has occurred and a case where the inter-cylinder air-fuel ratio imbalance state has not occurred.

Figure 6:
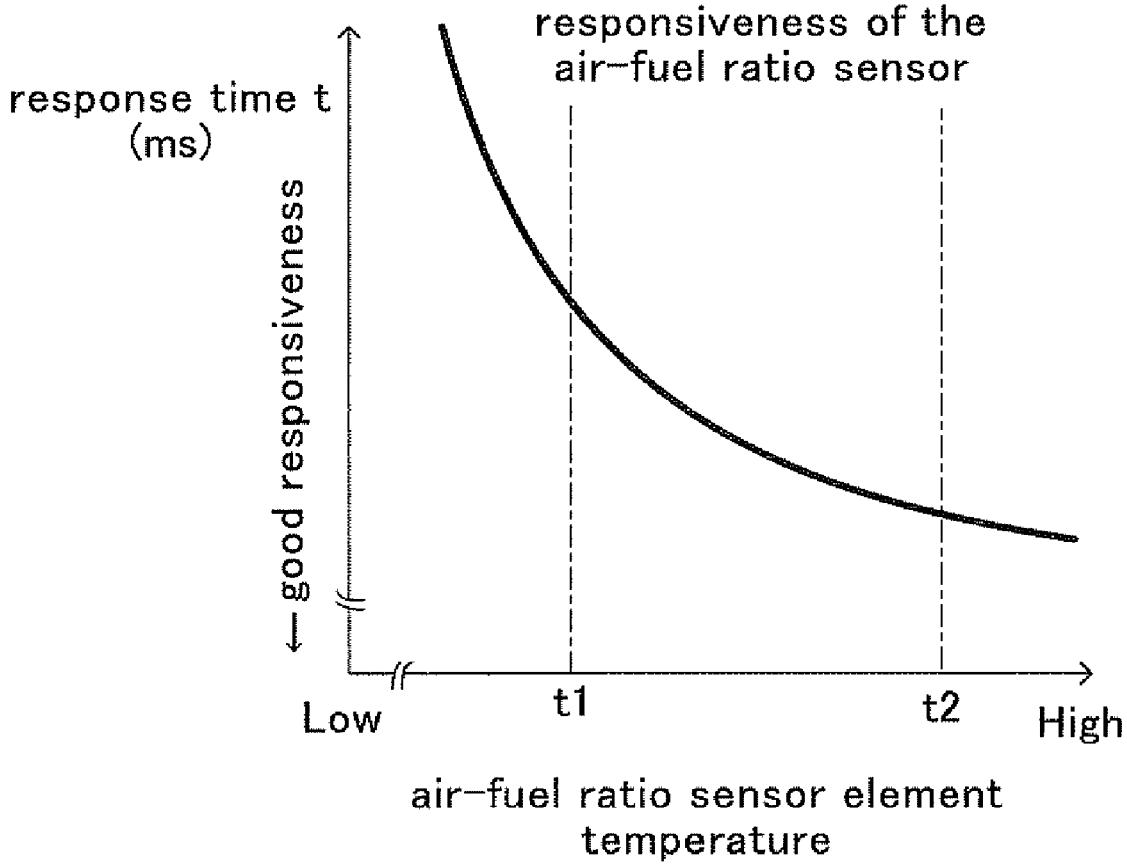

FIG. 6 is a graph showing a relation between a responsiveness of the air-fuel ratio sensor and an air-fuel ratio sensor element temperature.

Figure 7:
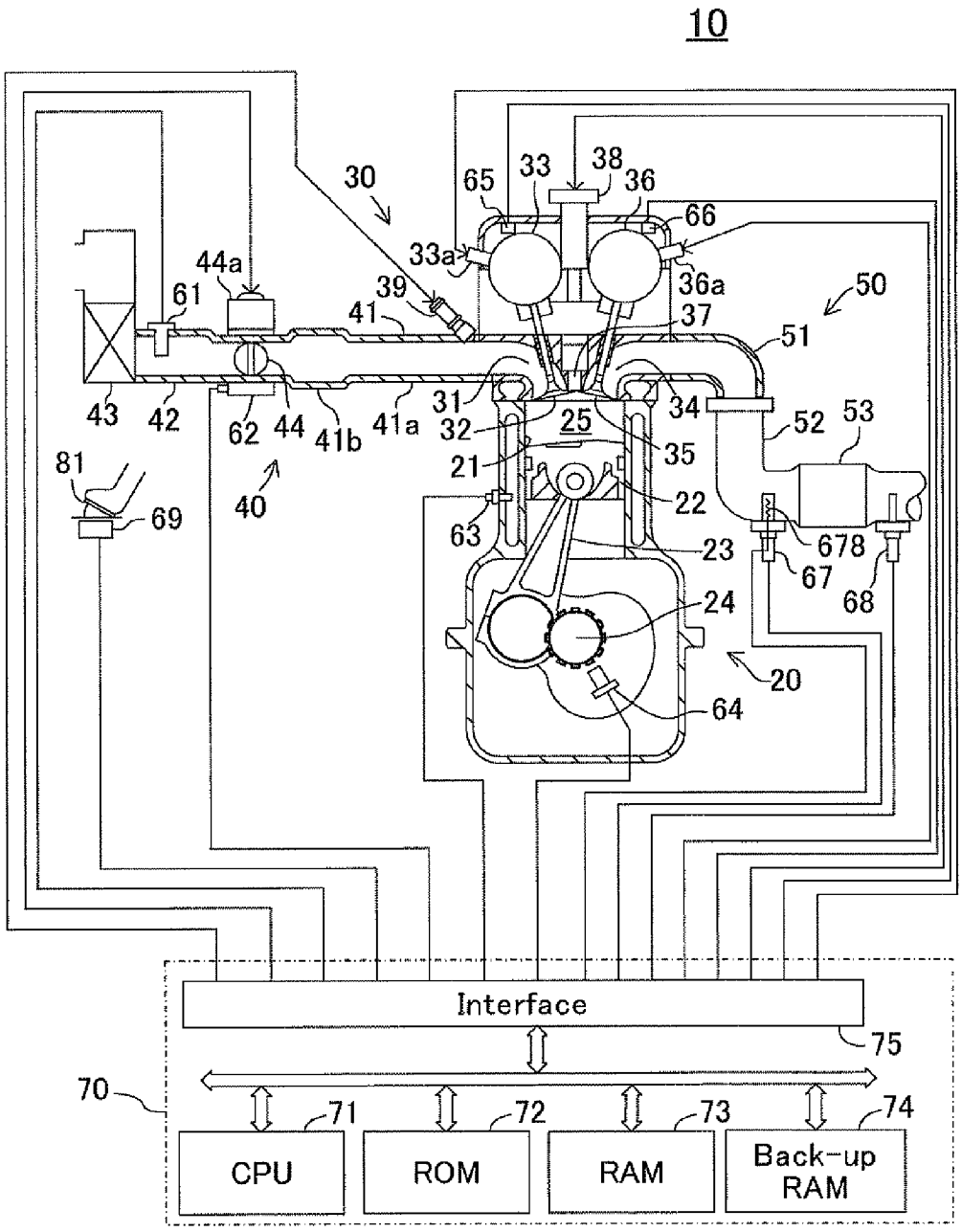

FIG. 7 is a diagram schematically showing the configuration of the internal combustion engine shown in FIG. 1.

Figure 8:
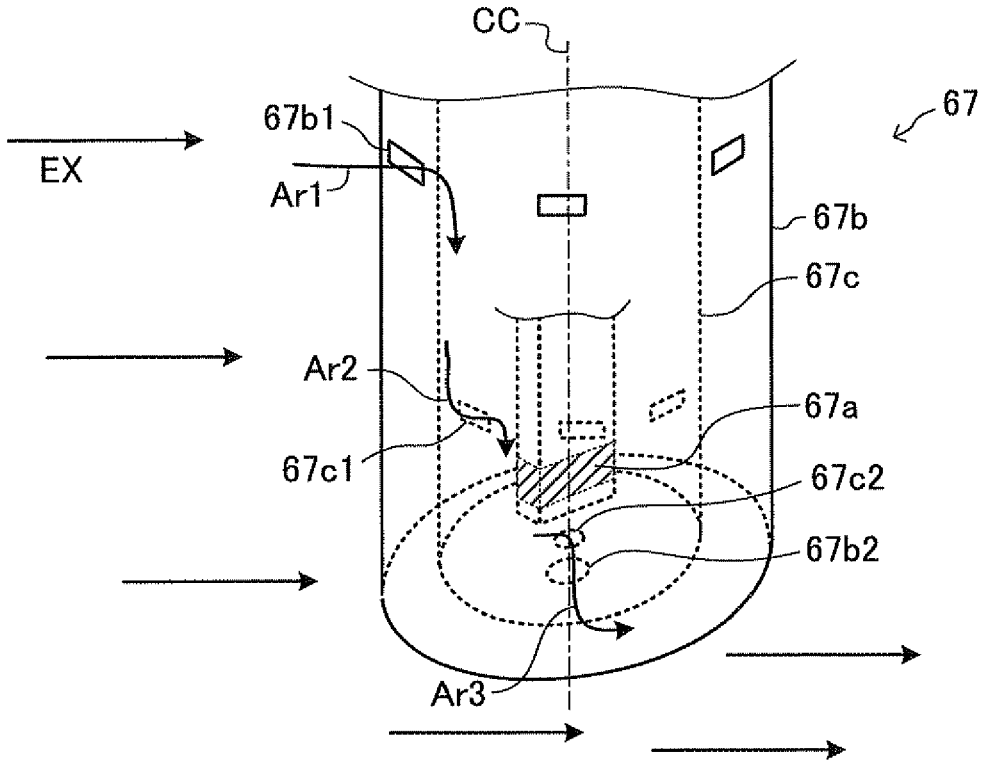

FIG. 8 is a partial schematic perspective view (through-view) of the air-fuel ratio sensor (upstream air-fuel ratio sensor) shown in FIGS. 1 and 7.

Figure 9:
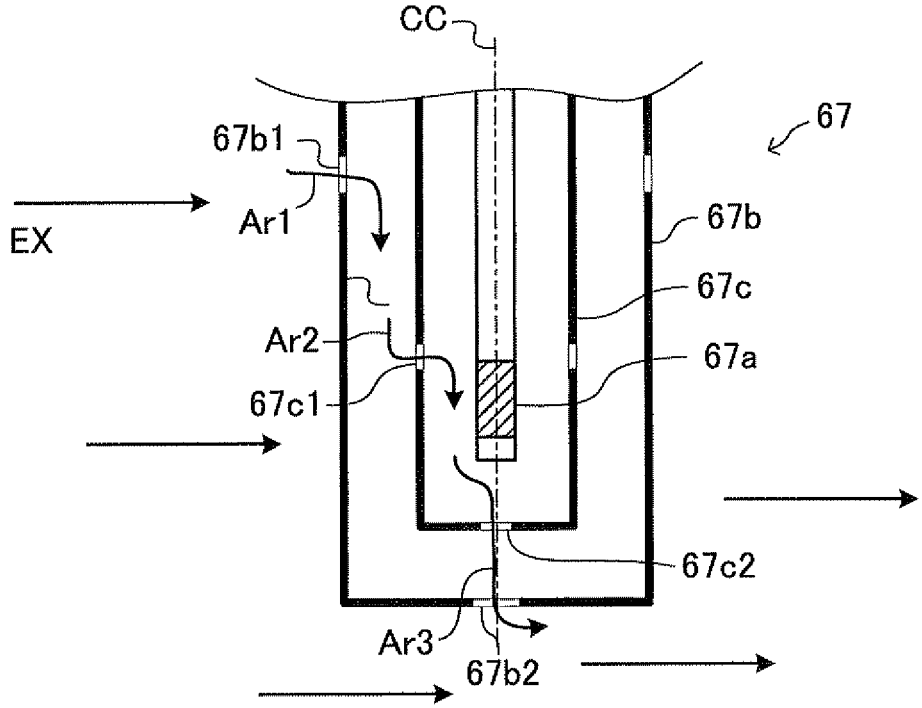

FIG. 9 is a partial sectional view of the air-fuel ratio sensor shown in FIGS. 1 and 7.

Figure 10:
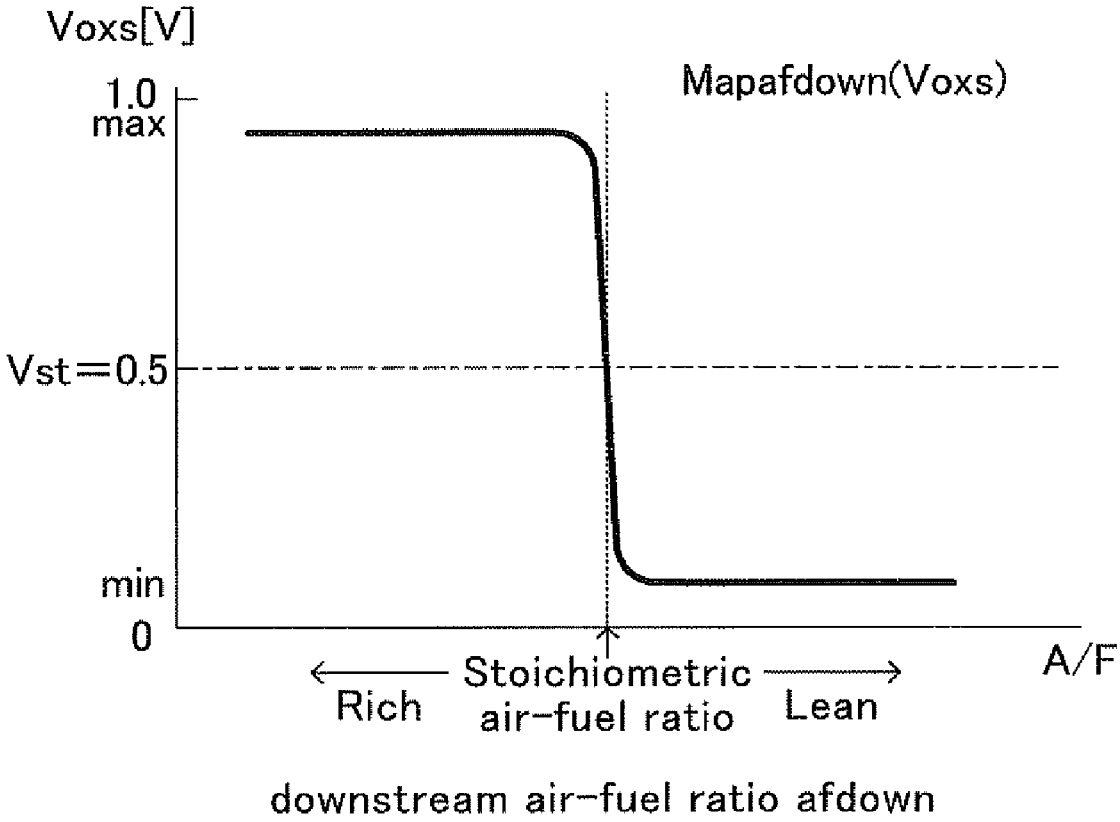

FIG. 10 is a graph showing a relation between an air-fuel ratio of an exhaust gas and an output value of the downstream air-fuel ratio sensor shown in FIGS. 1 and 7.

Figure 11:
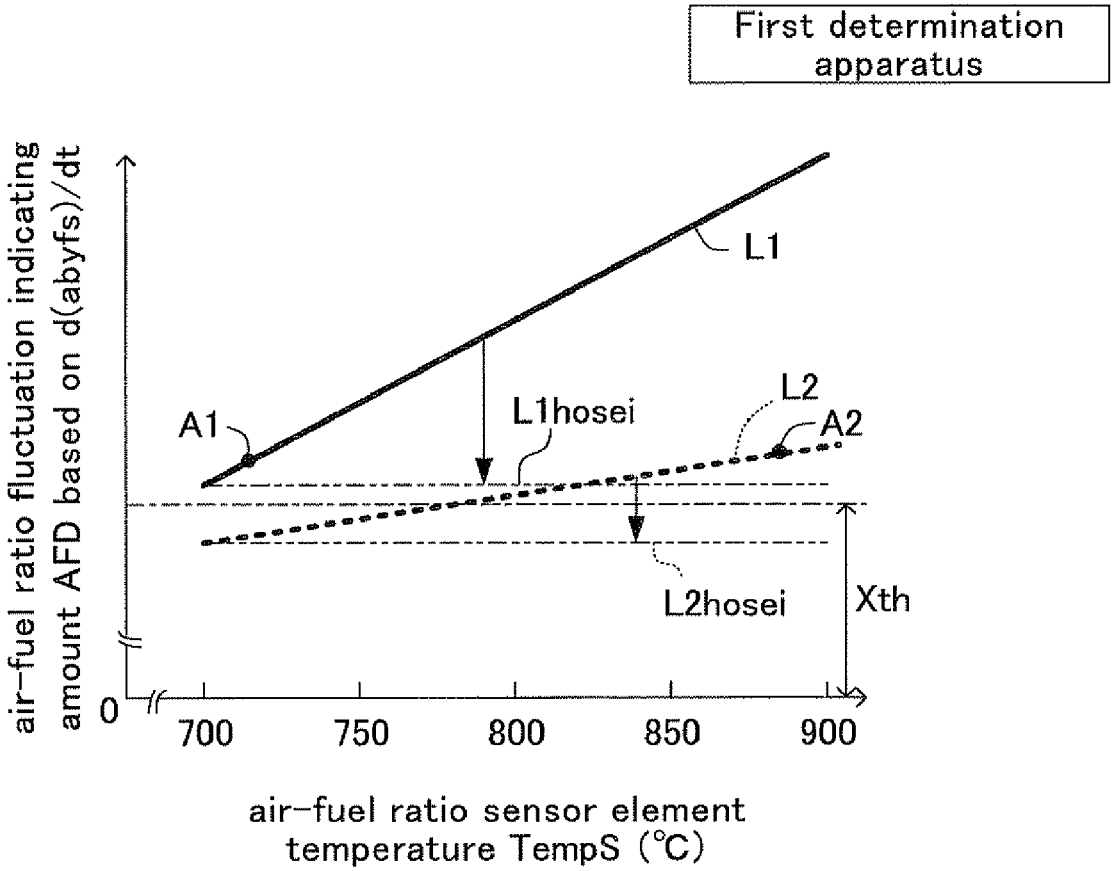

FIG. 11 is a graph showing a behavior of an air-fuel ratio fluctuation indicating amount with respect to an air-fuel ratio sensor element temperature.

Figure 12:
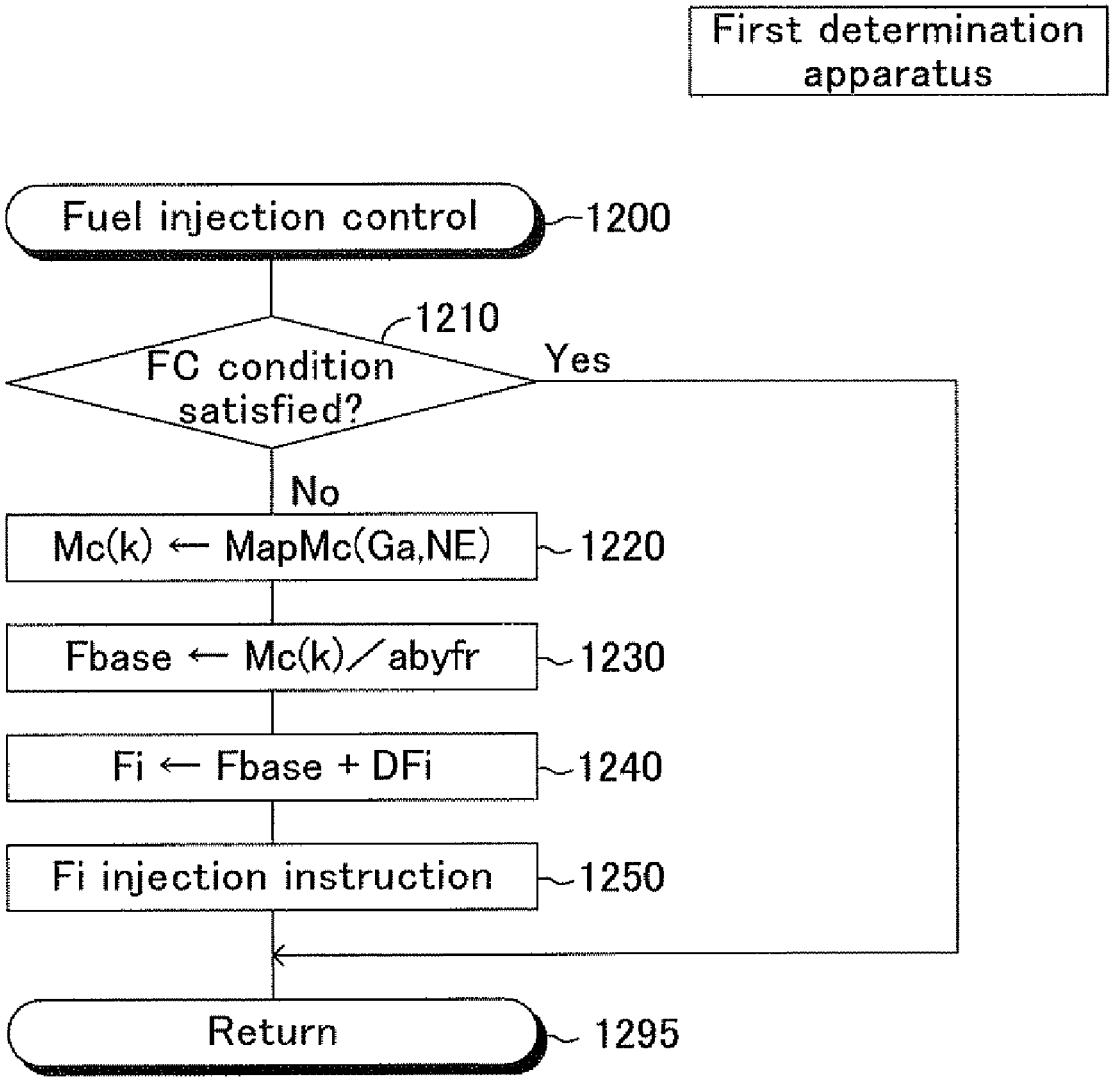

FIG. 12 is a flowchart showing a routine executed by a CPU of an inter-cylinder air-fuel ratio imbalance determination apparatus (first determination apparatus) according to a first embodiment of the present invention.

Figure 13:
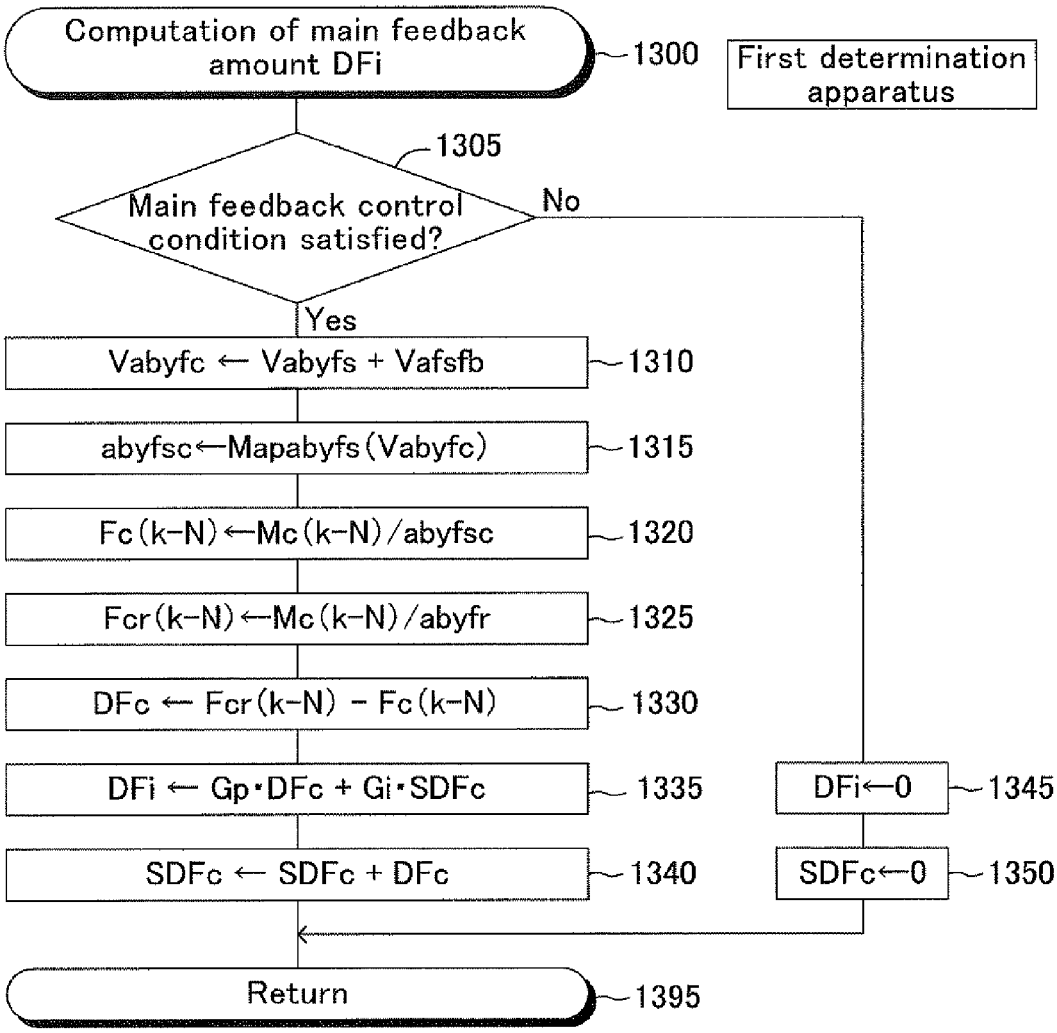

FIG. 13 is a flowchart showing another routine executed by the CPU of the first determination apparatus.

Figure 14:
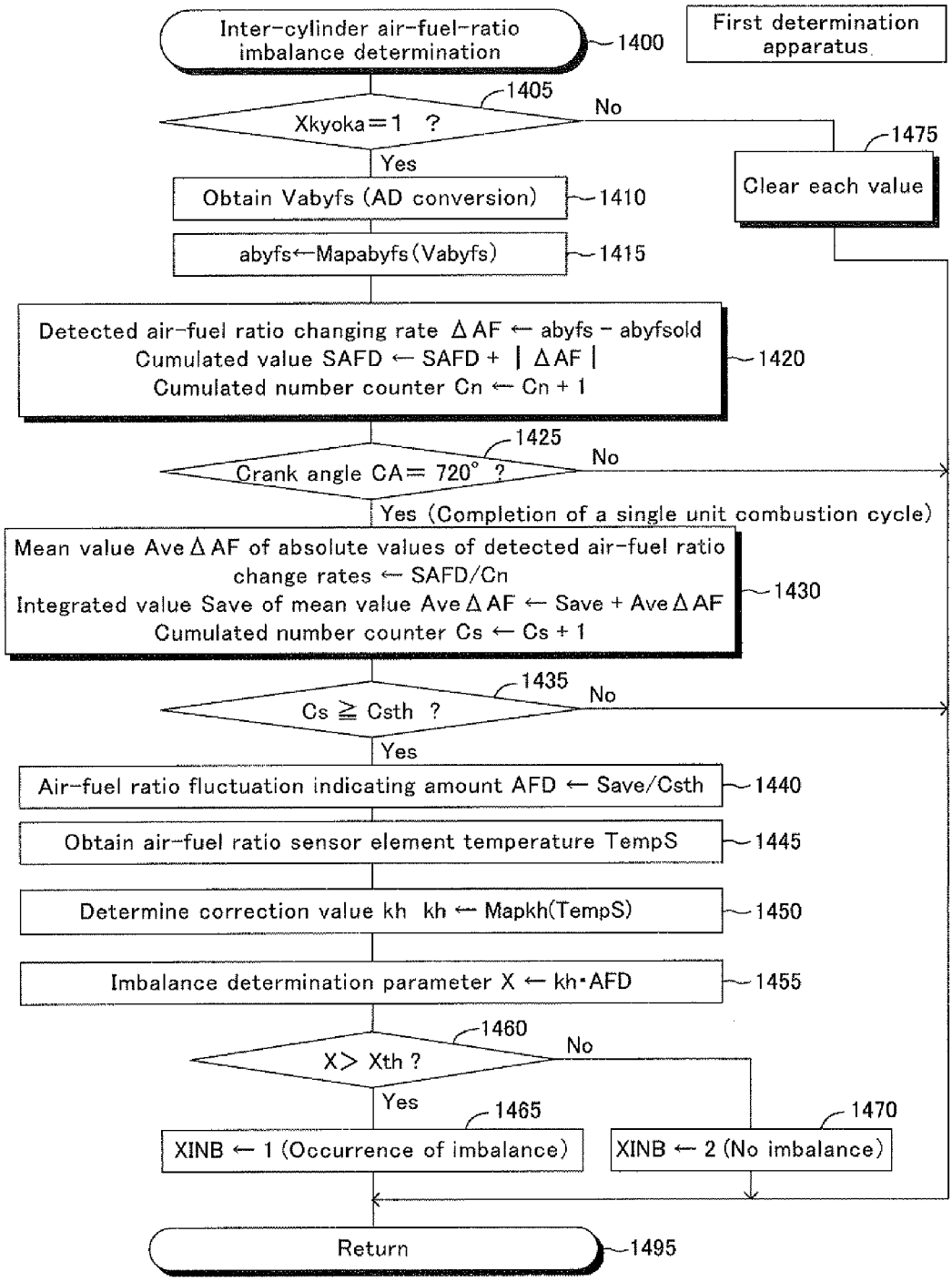

FIG. 14 is a flowchart showing another routine executed by the CPU of the first determination apparatus.

Figure 15:
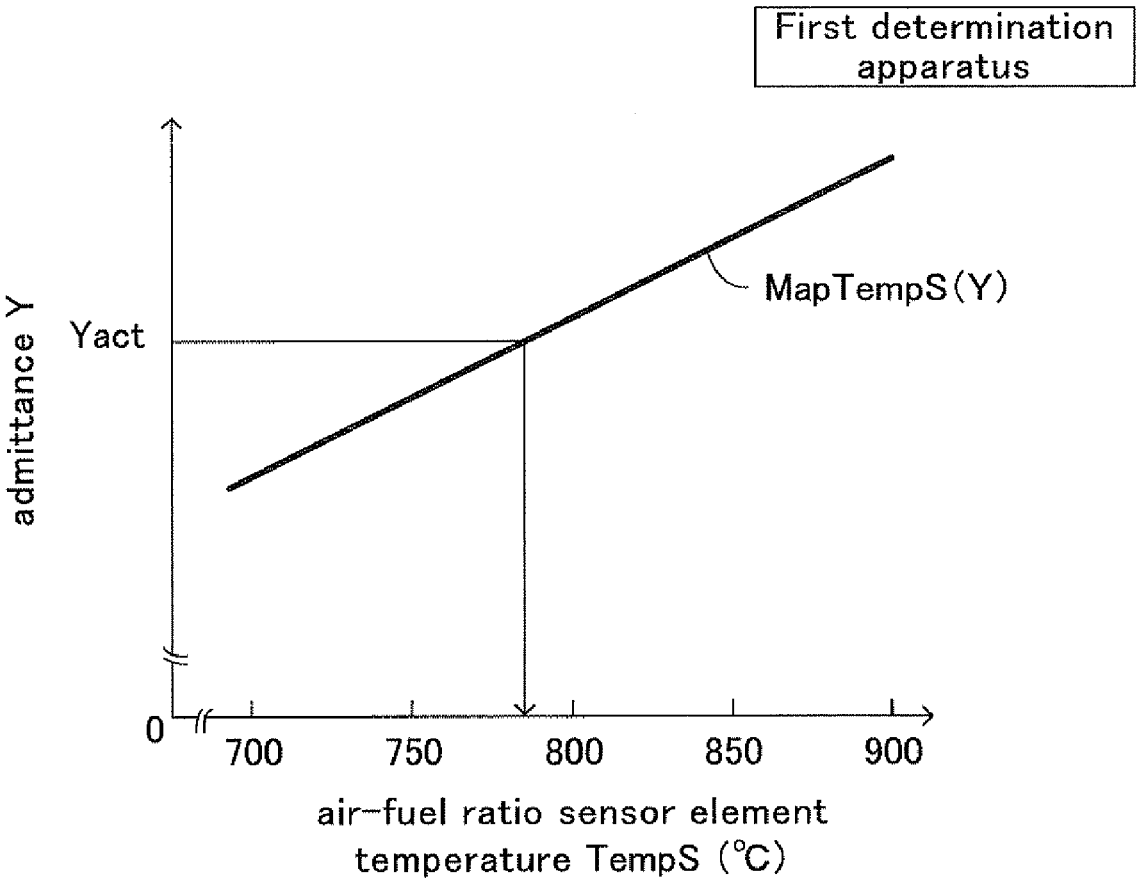

FIG. 15 is a graph showing a relation between an admittance of the solid electrolyte layer of the air-fuel ratio sensor and the air-fuel ratio sensor element temperature.

Figure 16:
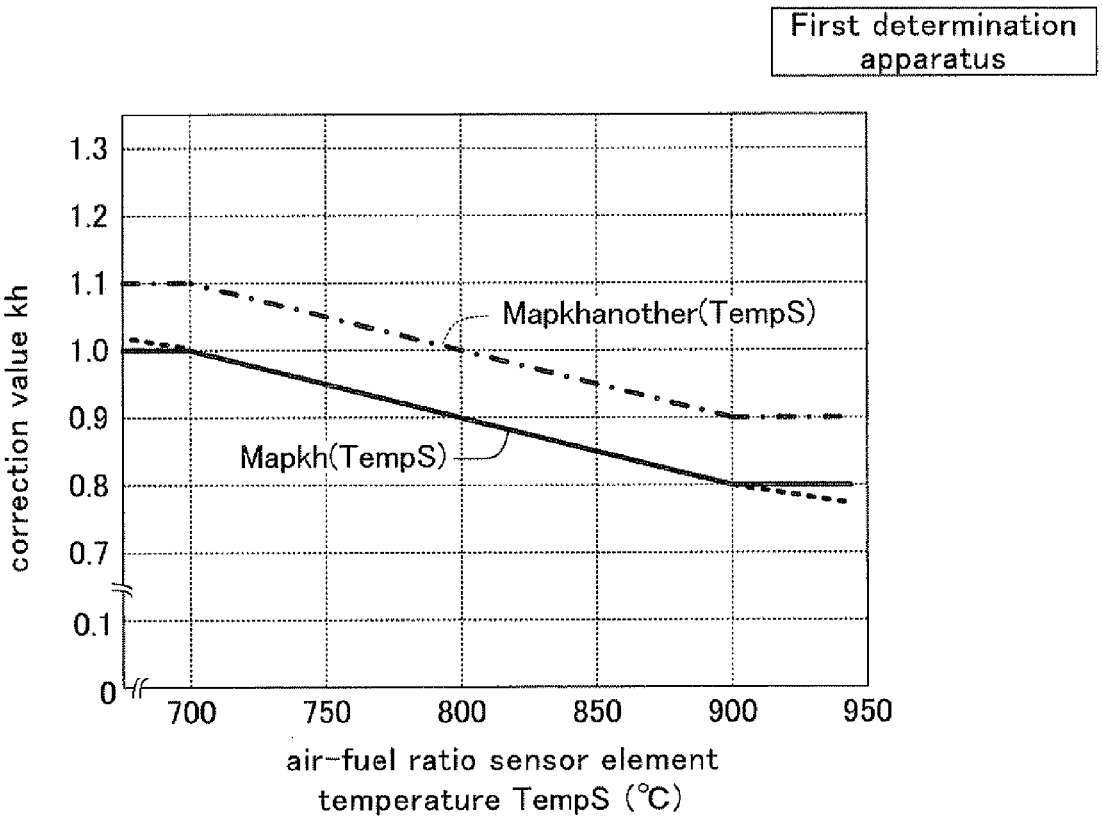

FIG. 16 is a table to which the CPU of the first determination apparatus refers when determining a correction amount for the air-fuel ratio fluctuation indicating amount.

Figure 17:
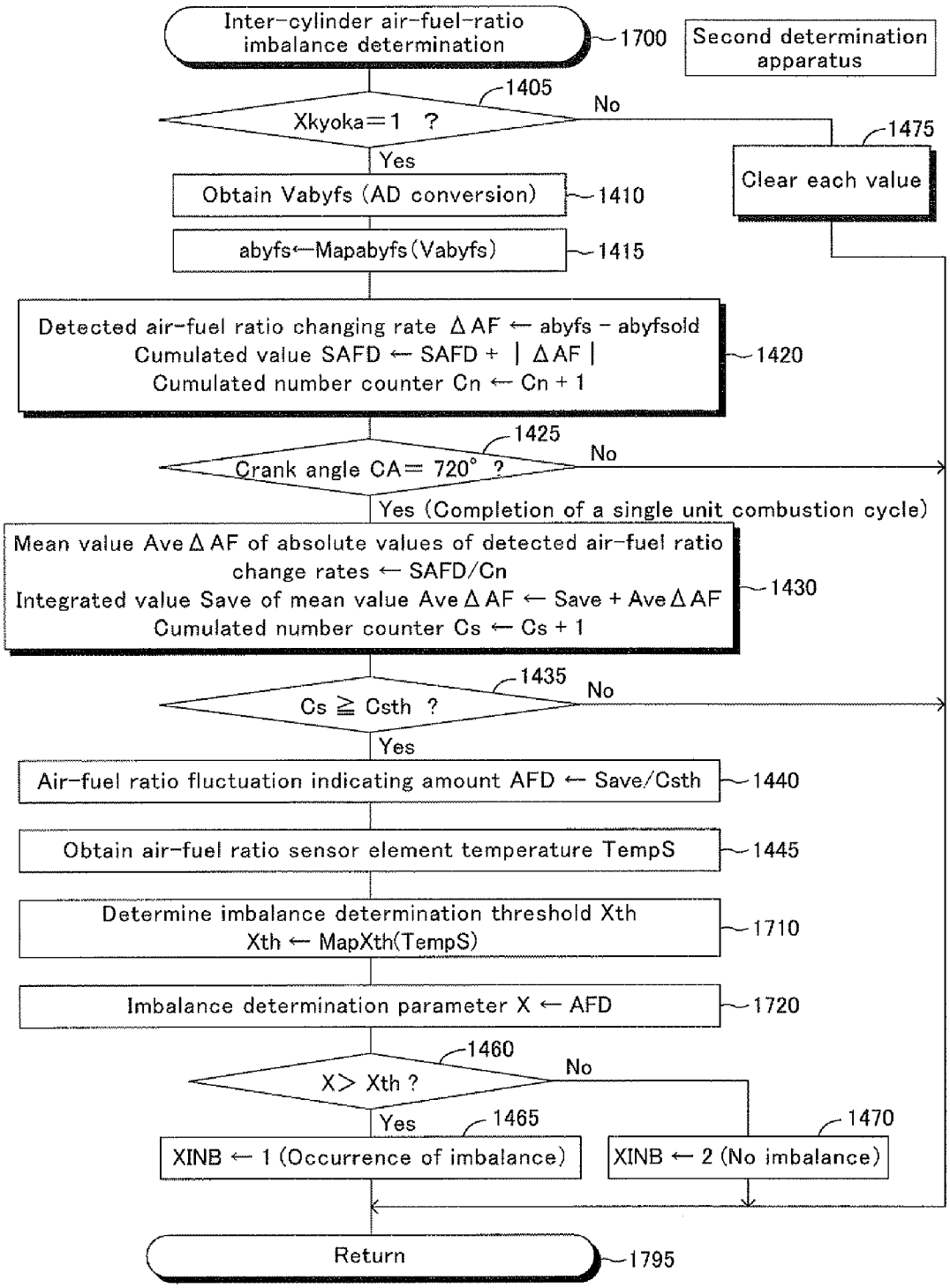

FIG. 17 is a flowchart showing a routine executed by a CPU of an inter-cylinder air-fuel ratio imbalance determination apparatus (second determination apparatus) according to a second embodiment of the present invention.

Figure 18:
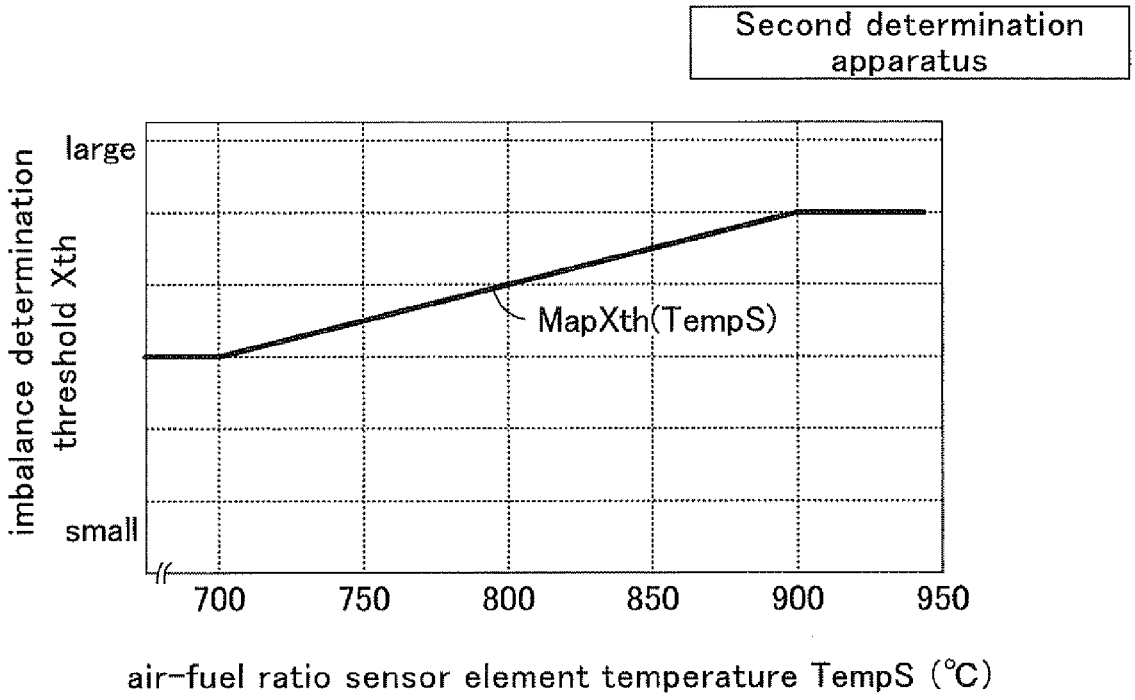

FIG. 18 is a table to which the CPU of the second determination apparatus refers when determining an imbalance determination threshold.

Figure 19:
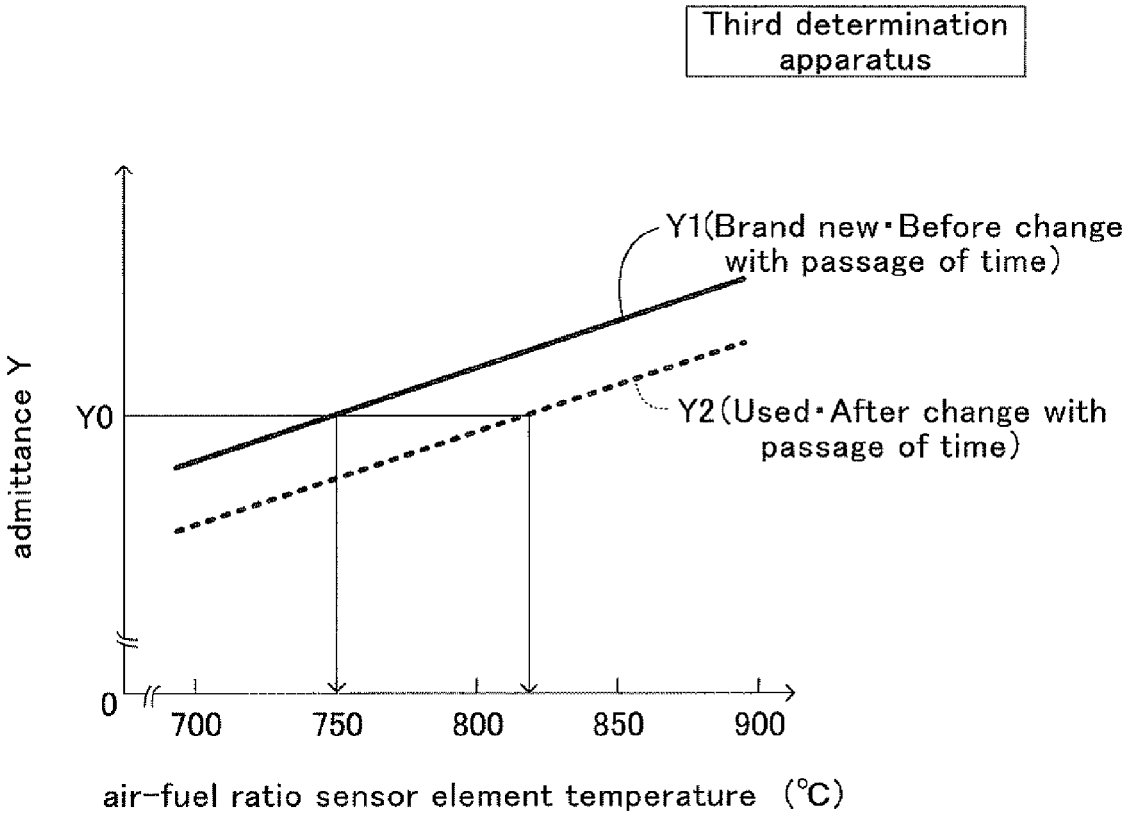

FIG. 19 is a graph showing a relation between the air-fuel ratio sensor element temperature and "an admittance of the air-fuel ratio sensor which has not deteriorated (changed) with age and an admittance of the air-fuel ratio sensor which has deteriorated (changed) with age."

Figure 20:
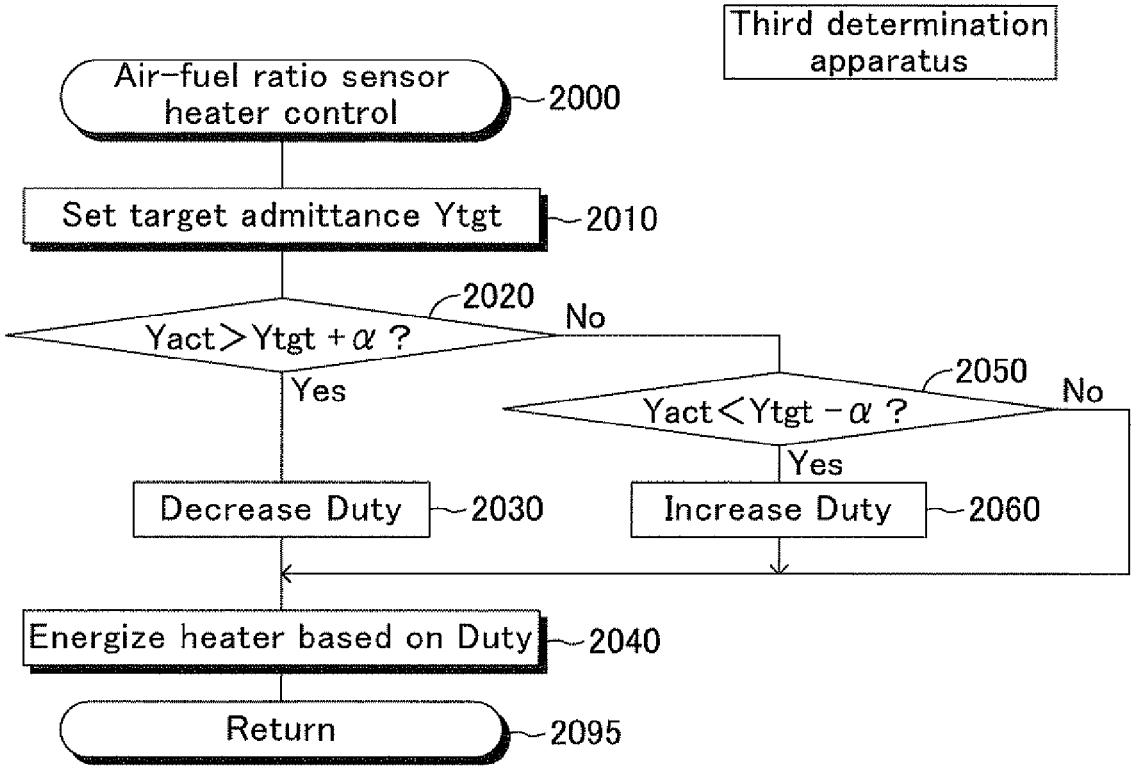

FIG. 20 is a flowchart showing a routine executed by a CPU of an inter-cylinder air-fuel ratio imbalance determination apparatus (third determination apparatus) according to a third embodiment of the present invention.

Figure 21:
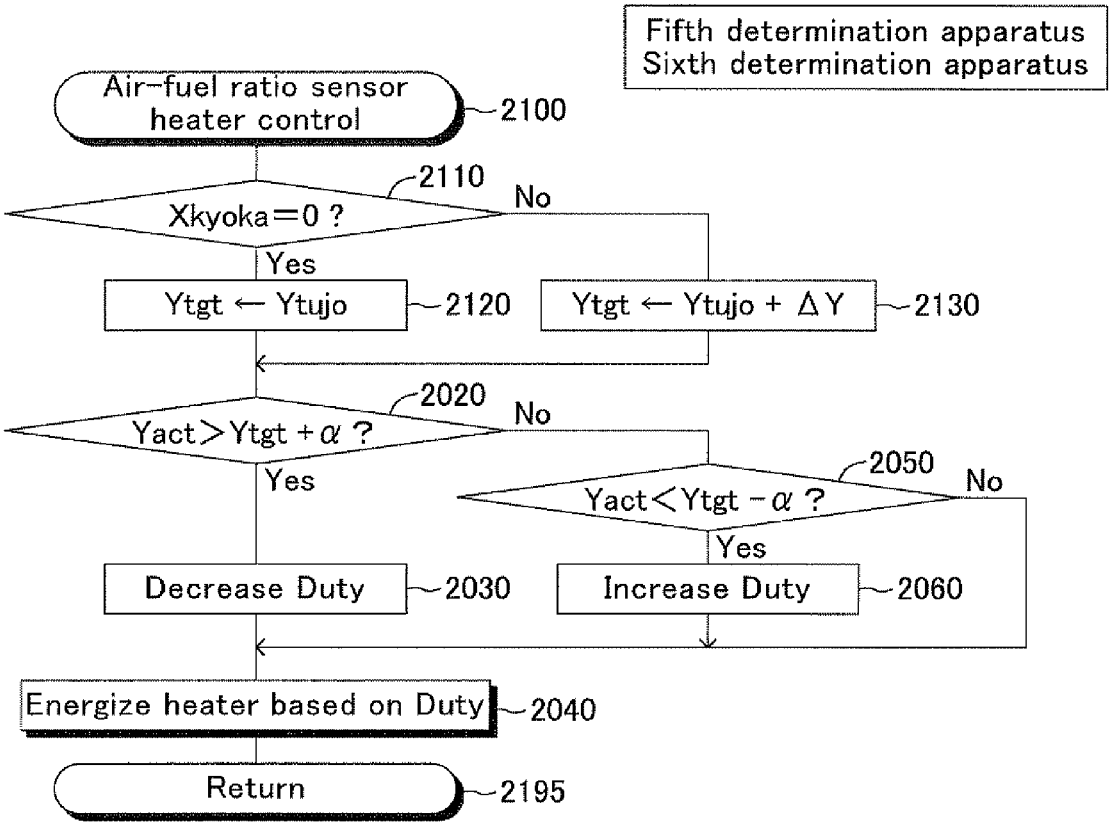

FIG. 21 is a flowchart showing a routine executed by a CPU of an inter-cylinder air-fuel ratio imbalance determination apparatuses according to fifth and sixth embodiments of the present invention.

Figure 22:
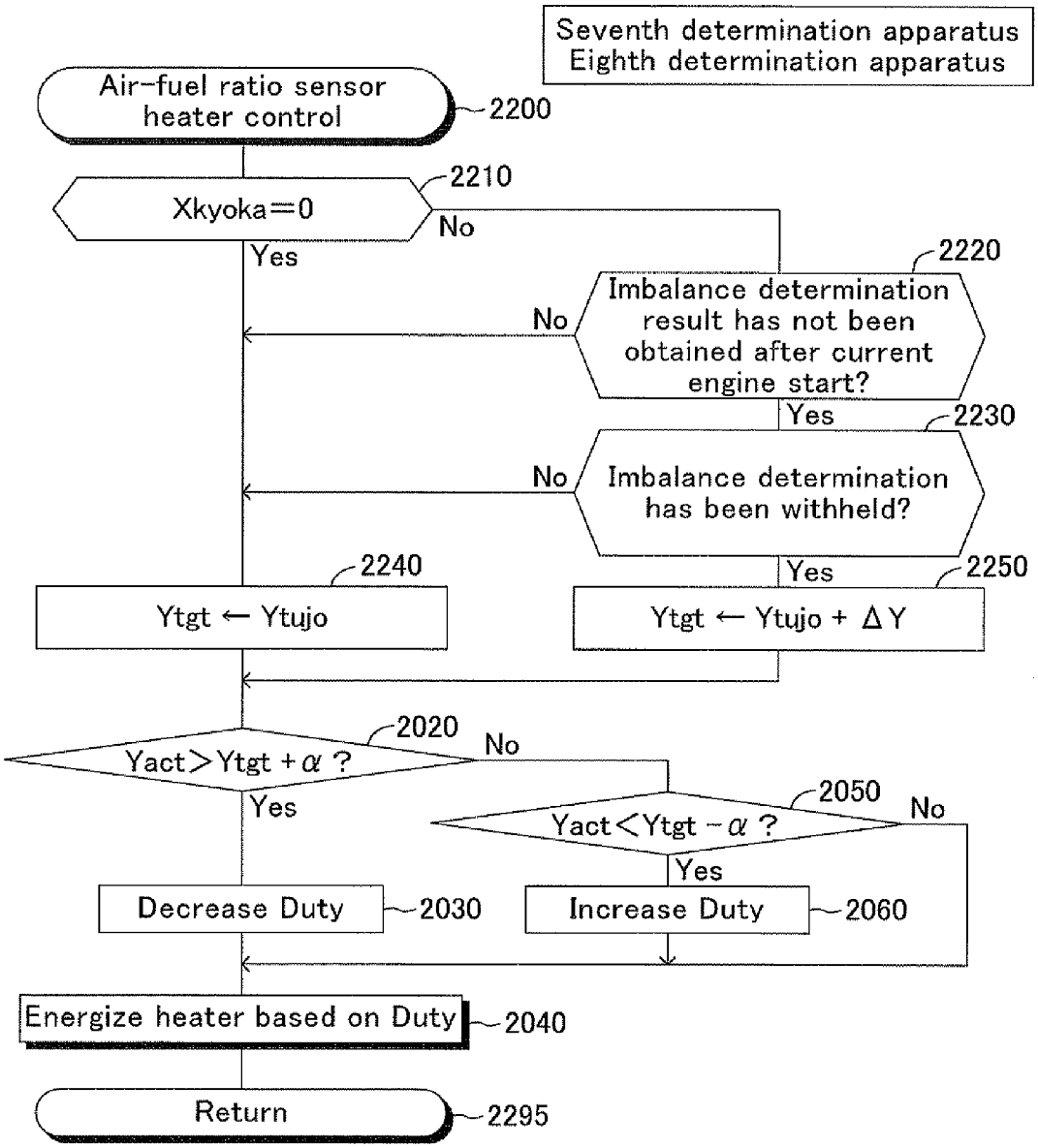

FIG. 22 is a flowchart showing a routine executed by a CPU of an inter-cylinder air-fuel ratio imbalance determination apparatuses according to seventh and eighth embodiments of the present invention.

Figure 23:
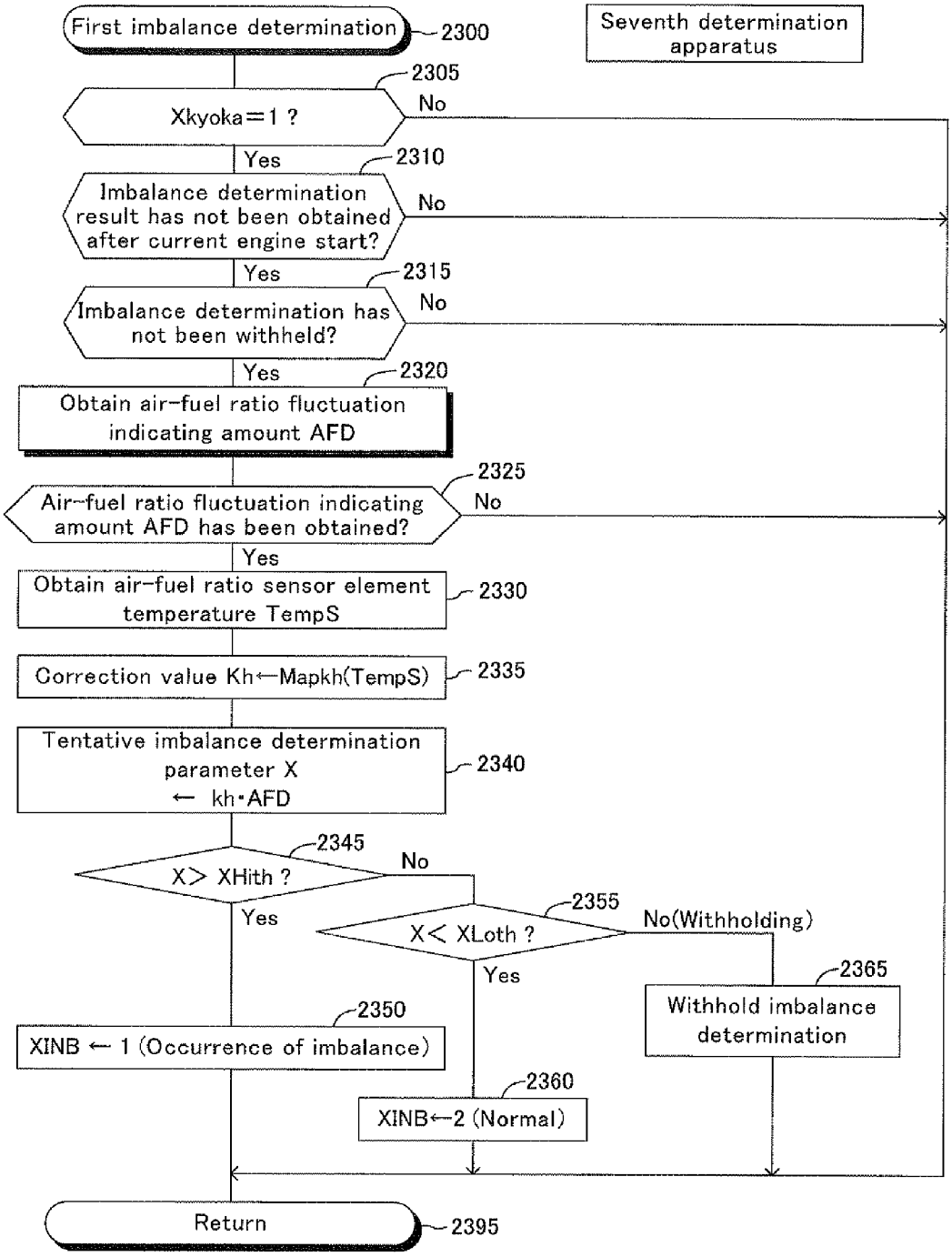

FIG. 23 is a flowchart showing another routine executed by the CPU of the seventh determination apparatus.

Figure 24:
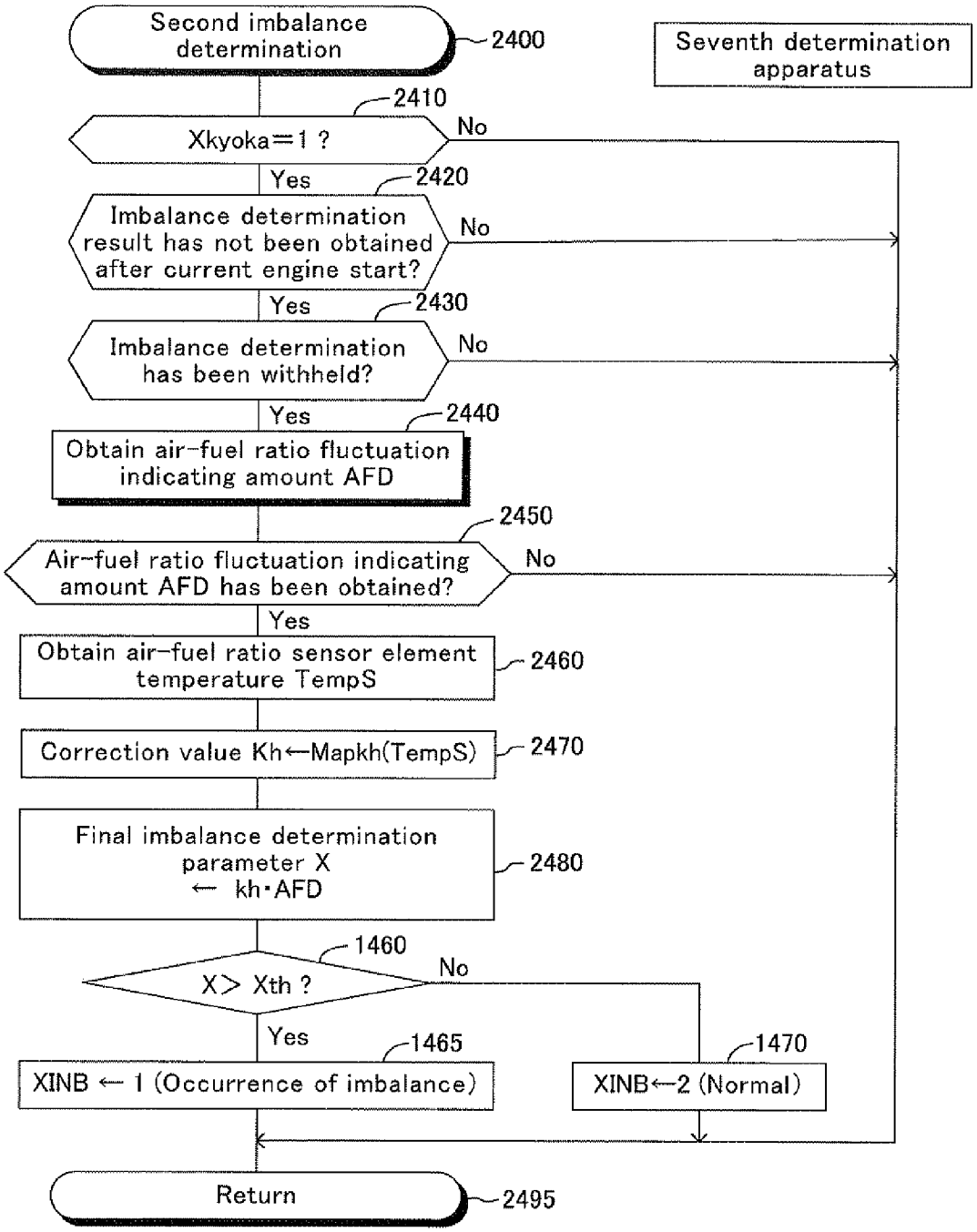

FIG. 24 is a flowchart showing another routine executed by the CPU of the seventh determination apparatus.

Figure 25:
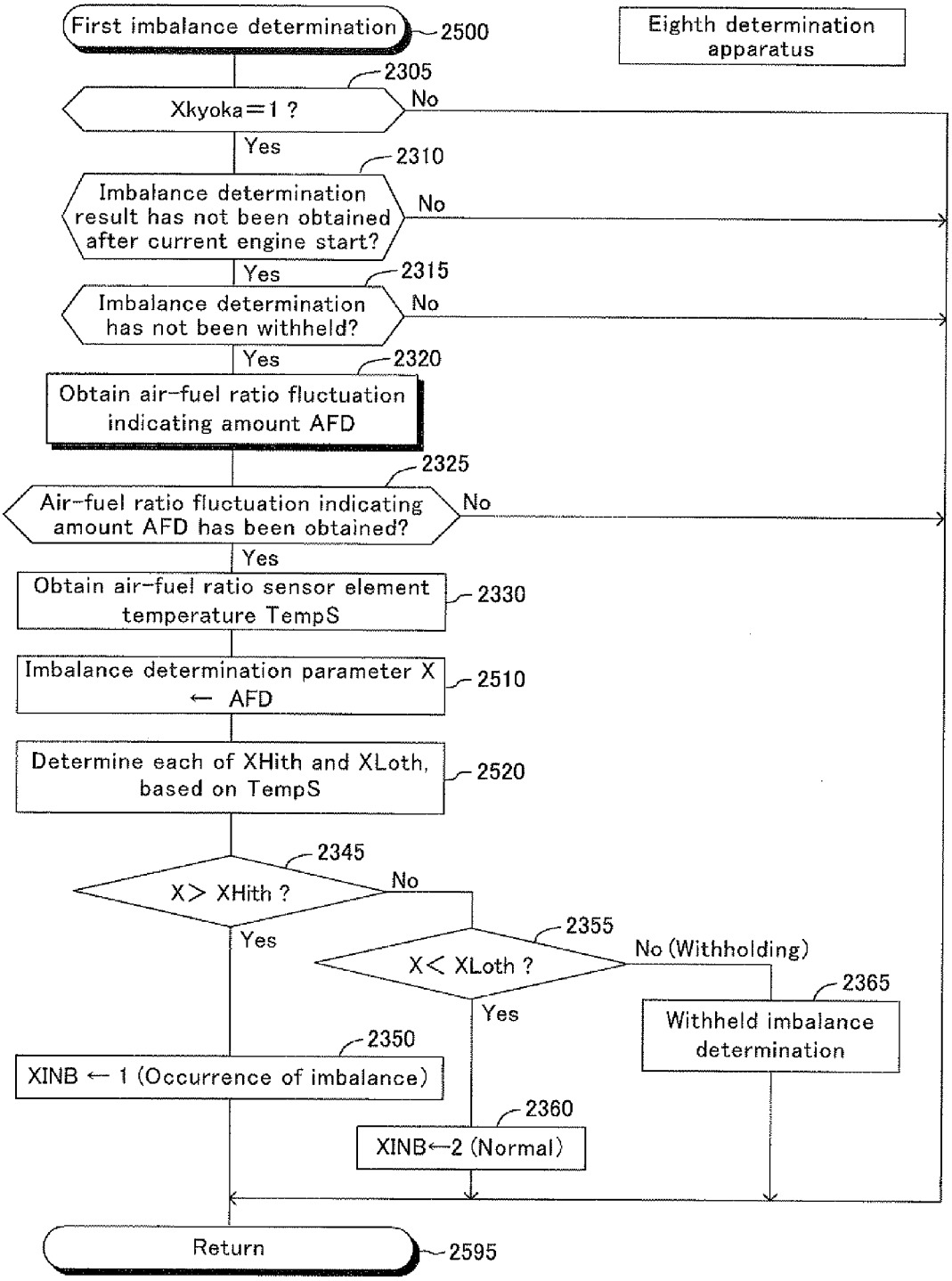

FIG. 25 is a flowchart showing another routine executed by the CPU of the eighth determination apparatus.

Figure 26:
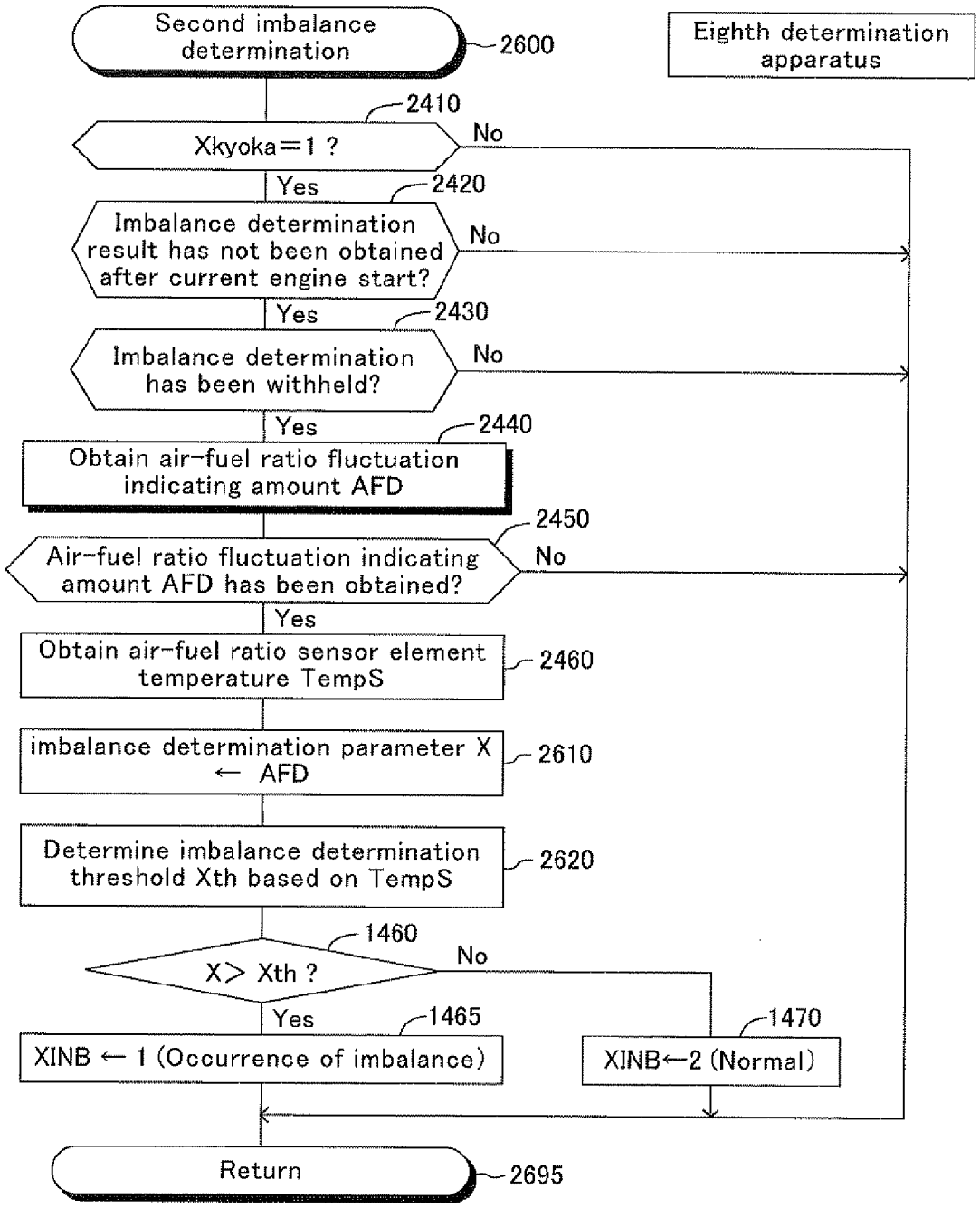

FIG. 26 is a flowchart showing another routine executed by the CPU of the eighth determination apparatus.

Figure 27:
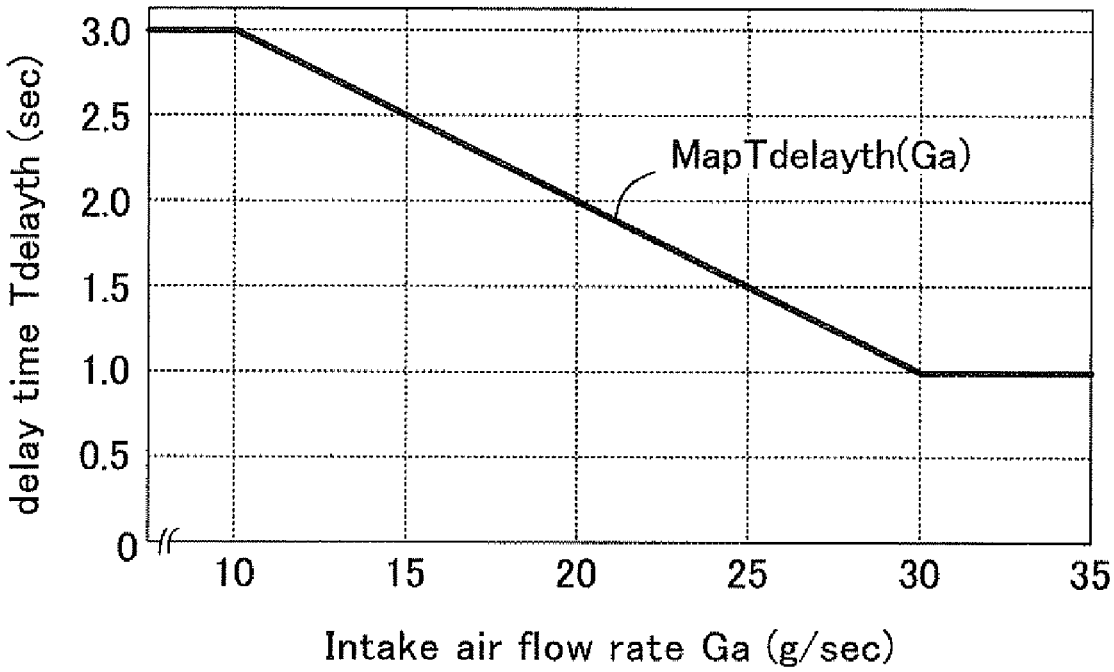

FIG. 27 is a graph showing a delay time table to which each of CPUs of each of the determination apparatuses of the embodiments refers to.

MODE FOR CARRYING OUT THE INVENTION

An inter-cylinder air-fuel ratio imbalance determination apparatus (hereinafter may be simply referred to as a "determination apparatus") for an internal combustion engine according to each of embodiments of the present invention will be described with reference to the drawings. This determination apparatus is a portion of an air-fuel ratio control apparatus for controlling the air-fuel ratio of gas mixture supplied to the internal combustion engine (the air-fuel ratio of the engine), and also serves as a portion of a fuel injection amount control apparatus for controlling the amount of fuel injection.

First Embodiment (Configuration)

FIG. 7 schematically shows the configuration of a system configured such that a determination apparatus according to a first embodiment (hereinafter also referred to as a "first determination apparatus") is applied to a spark-ignition multi-cylinder (straight 4-cylinder) four-cycle internal combustion engine 10. Although FIG. 7 shows the cross section of a specific cylinder only, the remaining cylinders have the same configuration.

This internal combustion engine 10 includes a cylinder block section 20 including a cylinder block, a cylinder block lower-case, an oil pan, etc.; a cylinder head section 30 fixedly provided on the cylinder block section 20; an intake system 40 for supplying gasoline gas mixture to the cylinder block section 20; and an exhaust system 50 for discharging exhaust gas from the cylinder block section 20 to the exterior of the engine.

The cylinder block section 20 includes cylinders 21, pistons 22, connecting rods 23, and a crankshaft 24. Each of the pistons 22 reciprocates within the corresponding cylinder 21. The reciprocating motion of the piston 22 is transmitted to the crankshaft 24 via the respective connecting rod 23, whereby the crankshaft 24 is rotated. The wall surface of the cylinder 21 and the top surface of the piston 22 form a combustion chamber 25 in cooperation with the lower surface of the cylinder head section 30.

The cylinder head section 30 includes an intake port 31 communicating with the combustion chamber 25; an intake valve 32 for opening and closing the intake port 31; a variable intake timing control apparatus 33 which includes an intake camshaft for driving the intake valve 32 and which continuously changes the phase angle of the intake camshaft; an actuator 33*a* of the variable intake timing control apparatus 33; an exhaust port 34 communicating with the combustion chamber 25; an exhaust valve 35 for opening and closing the exhaust port 34; a variable exhaust timing control apparatus 36 which includes an exhaust camshaft for driving the exhaust valve 35 and which continuously changes the phase angle of the exhaust camshaft; an actuator 36*a* of the variable exhaust timing control apparatus 36; a spark plug 37; an igniter 38 including an ignition coil for generating a high voltage to be applied to the spark plug 37; and a fuel injection valve (fuel injection means; fuel supply means) 39.

The fuel injection valves (fuel injector) 39 are disposed such that a single fuel injection valve is provided for each combustion chamber 25. The fuel injection valve 39 is provided at the intake port 31. When the fuel injection valve 39 is normal, in response to an injection instruction signal, the fuel injection valve 39 injects "fuel of an amount corresponding to an instructed fuel injection amount contained in the injection instruction signal" into the corresponding intake port 31. In this way, each of a plurality of the cylinders has the fuel injection valve 39 which supplies fuel thereto independently of other cylinders.

The intake system 40 includes an intake manifold 41, an intake pipe 42, an air filter 43, and a throttle valve 44.

As shown in FIG. 1, the intake manifold 41 is composed of a plurality of branch portions 41*a* and a surge tank 41*b*. One end of each of a plurality of the branch portions 41*a* is connected to each of a plurality of the corresponding intake ports 31, as shown in FIG. 7. The other end of each of a plurality of the branch portions 41*a* is connected to the surge tank 41*b*. One end of the intake pipe 42 is connected to the surge tank 41*b*. The air filter 43 is provided at the other end of the intake pipe 42. The throttle valve 44 is provided within the intake pipe 42 and adapted to change the opening cross sectional area of the intake passage. The throttle valve 44 is rotated within the intake pipe 42 by a throttle valve actuator 44*a* (a portion of throttle valve drive means) including a DC motor.

The exhaust system 50 includes an exhaust manifold 51, an exhaust pipe 52, an upstream catalyst 53 disposed in the exhaust pipe 52, and an unillustrated downstream catalyst disposed in the exhaust pipe 52 at a position downstream of the upstream catalyst 53.

As shown in FIG. 1, the exhaust manifold 51 has a plurality of branch portions 51*a* whose one ends are connected to the exhaust ports, and a merging portion 51*b* where all of the branch portions 51*a* at their the other ends merge together. The merging portion 51*b* is also referred to as an exhaust merging portion HK, since exhaust gases discharged from a plurality (two or more, or four in the present example) of the cylinders merge together at the merging portion 51*b*. The exhaust pipe 52 is connected to the merging portion 51*b*. As shown in FIG. 7, the exhaust ports 34, the exhaust manifold 51, and the exhaust pipe 52 constitute an exhaust passage.

Each of the upstream catalyst 53 and the downstream catalyst is a so-called three-way catalyst unit (exhaust purifying catalyst) carrying an active component formed of a noble metal such as platinum, rhodium, palladium, or the like. Each of the catalysts has a function of oxidizing unburned combustibles such as HC, CO, and $H_2$ and reducing nitrogen oxides (NOx) when the air-fuel ratio of gas flowing into each catalyst coincides with the stoichiometric air-fuel ratio. This function is also called a "catalytic function." Further, each catalyst has an oxygen storage function of occluding (storing) oxygen. This oxygen storage function enables removal of the unburned combustibles and the nitrogen oxides even when the air-fuel ratio deviates from the stoichiometric air-fuel ratio. This oxygen storage function is realized by an oxygen storing substance (e.g. ceria ($CeO_2$)) carried by the catalyst.

This system includes a hot-wire air flowmeter 61, a throttle position sensor 62, a water temperature sensor 63, a crank position sensor 64, an intake-cam position sensor 65, an exhaust-cam position sensor 66, an upstream air-fuel ratio sensor 67, a downstream air-fuel ratio sensor 68, and an accelerator opening sensor 69.

The air flowmeter 61 outputs a signal representing the mass flow rate (intake air flow rate) Ga of an intake air flowing through the intake pipe 42. That is, the intake air flow rate Ga represents the amount of air taken into the engine 10 per unit time.

The throttle position sensor 62 detects the opening of the throttle valve 44 (throttle valve opening), and outputs a signal representing the detected throttle valve opening TA.

The water temperature sensor 63 detects the temperature of cooling water of the internal combustion engine 10, and outputs a signal representing the detected cooling water temperature THW.

The crank position sensor 64 outputs a signal including a narrow pulse generated every time the crankshaft 24 rotates 10° and a wide pulse generated every time the crankshaft 24 rotates 360°. This signal is converted to an engine rotational speed NE by an electric controller 70, which will be described later.

The intake-cam position sensor 65 outputs a single pulse when the intake camshaft rotates 90 degrees from a predetermined angle, when the intake camshaft rotates 90 degrees after that, and when the intake camshaft further rotates 180 degrees after that. Based on the signals from the crank position sensor 64 and the intake-cam position sensor 65, the electric controller 70, which will be described later, obtains the absolute crank angle CA, while using, as a reference, the compression top dead center of a reference cylinder (e.g., the first cylinder). This absolute crank angle CA is set to a "0° crank angle" at the compression top dead center of the reference cylinder, increases up to a 720° crank angle in accordance with the rotational angle of the crank angle, and is again set to the "0° crank angle" at that point in time.

The exhaust-cam position sensor 66 outputs a single pulse when the exhaust camshaft rotates 90 degrees from a predetermined angle, when the exhaust camshaft rotates 90 degrees after that, and when the exhaust camshaft further rotates 180 degrees after that.

As is also shown in FIG. 1, the upstream air-fuel ratio sensor 67 (an air-fuel ratio sensor in the present invention) is disposed on/in "either one of the exhaust manifold 51 and the exhaust pipe 52 (that is, the exhaust passage)" at a position between the upstream catalyst 53 and the merging portion (exhaust merging portion HK) 51*b* of the exhaust manifold 51. The upstream air-fuel ratio sensor 67 is a "limiting-current-type wide range air-fuel ratio sensor including a diffusion resistance layer" disclosed in, for example, Japanese Patent Application Laid-Open (kokai) Nos. H11-72473, 2000-65782, and 2004-69547.

As shown in FIGS. 8 and 9, the upstream air-fuel ratio sensor 67 includes an air-fuel ratio detecting section 67*a*, an outer protective cover 67*b*, and an inner protective cover 67*c*.

The outer protective cover 67*b* is a hollow cylinder formed of metal. The outer protective cover 67*b* accommodates the inner protective cover 67*c* so as to cover it. The outer protective cover 67*b* has a plurality of inflow holes 67*b*1 formed in its peripheral wall. The inflow holes 67*b*1 are through holes for allowing the exhaust gas EX (the exhaust gas which is present outside the outer protective cover 67*b*) flowing through the exhaust passage to flow into the space inside the outer protective cover 67*b*. Further, the outer protective cover 67*b* has an outflow hole(s) 67*b*2 formed in its bottom wall so as to allow the exhaust gas to flow from the space inside the outer protective cover 67*b* to the outside (exhaust passage).

The inner protective cover 67*c* formed of metal is a hollow cylinder whose diameter is smaller than that of the outer protective cover 67*b*. The inner protective cover 67*c* accommodates an air-fuel ratio detecting section 67*a* so as to cover it. The inner protective cover 67*c* has a plurality of inflow holes 67*c*1 in its peripheral wall. The inflow holes 67*c*1 are through holes for allowing the exhaust gas, which has flowed into the "space between the outer protective cover 67*b* and the inner protective cover 67*c*" through the inflow holes 67*b*1 of the outer protective cover 67*b*, to flow into the space inside the inner protective cover 67*c*. In addition, the inner protective cover 67*c* has an outflow hole(s) 67*c*2 formed in its bottom wall so as to allow the exhaust gas to flow from the space inside the inner protective cover 67*c* to the outside.

As shown in (A) to (C) of FIG. 2, the air-fuel ratio detecting section 67*a* includes a solid electrolyte layer 671, an exhaust-gas-side electrode layer 672, an atmosphere-side electrode layer 673, a diffusion resistance layer 674, a first partition section 675, a catalytic section 676, a second partition section 677, and a heater 678.

The solid electrolyte layer 671 is formed of an oxygen-ion-conductive sintered oxide. In this embodiment, the solid electrolyte layer 671 is a "stabilized zirconia element" which is a solid solution of $ZrO_2$ (zirconia) and CaO (stabilizer). The solid electrolyte layer 671 exhibits an "oxygen cell property (characteristic)" and an "oxygen pump property (characteristic)," which are well known, when its temperature is equal to or higher than an activation temperature thereof.

The exhaust-gas-side electrode layer 672 is formed of a noble metal having a high catalytic activity, such as platinum (Pt). The exhaust-gas-side electrode layer 672 is formed on one of surfaces of the solid electrolyte layer 671. The exhaust-gas-side electrode layer 672 is formed through chemical plating, etc. so as to exhibit adequate degree of permeability (that is, it is formed into a porous layer).

The atmosphere-side electrode layer 673 is formed of a noble metal having a high catalytic activity, such as platinum (Pt). The atmosphere-side electrode layer 673 is formed on the other one of surfaces of the solid electrolyte layer 671 in such a manner it faces the exhaust-gas-side electrode layer 672 across the solid electrolyte layer 671. The atmosphere-side electrode layer 673 is formed through chemical plating, etc. so as to exhibit adequate permeability (that is, it is formed into a porous layer).

The diffusion resistance layer (diffusion-controlling layer) 674 is formed of a porous ceramic material (heat-resistant inorganic material). The diffusion resistance layer 674 is formed through, for example, plasma spraying in such a manner that it covers the outer surface of the exhaust-gas-side electrode layer 672.

The first partition section 675 is formed of dense and gas-nonpermeable alumina ceramic. The first partition section 675 is formed so as to cover the diffusion resistance layer 674 except a corner (a part) of the diffusion resistance layer 674. That is, the first partition section 675 has pass-through portions to expose parts of the diffusion resistance layer 674 to the outside.

The catalytic section 676 is formed in the pass-through portions to close the through hole. Similarly to the upstream catalyst 53, the catalytic section 676 includes the catalytic substance which facilitates/accelerates the oxidation-reduction reaction and a substance for storing oxygen which exerts the oxygen storage function. The catalytic section 676 is porous. Accordingly, as shown by a white painted arrow in (B) and (C) of FIG. 2, the exhaust gas (the above described exhaust gas which has flowed into the inside of the inner protective cover 67*c*) reaches the diffusion resistance layer 674 through the catalytic section 676, and then further reaches the exhaust-gas-side electrode layer 672 through the diffusion resistance layer 674.

The second partition section 677 is formed of dense and gas-nonpermeable alumina ceramic. The second partition section 677 is configured so as to form an "atmosphere chamber 67A" which is a space that accommodates the atmosphere-side electrode layer 673. Air is introduced into the atmosphere chamber 67A.

A power supply 679 is connected to the upstream air-fuel ratio sensor 67. The power supply 679 applies a voltage V (=Vp) in such a manner that the atmosphere-side electrode layer 673 is held at a high potential and the exhaust-gas-side electrode layer 672 is held at a low potential.

The heater 678 is buried in the second partition section 677. The heater 678 produces heat when energized by the electric controller 70, which will be described later, so as to heat up the solid electrolyte layer 671, the exhaust-gas-side electrode layer 672, and the atmosphere-side electrode layer 673 to adjust temperatures of those. Hereinafter, "the solid electrolyte layer 671, the exhaust-gas-side electrode layer 672, and the atmosphere-side electrode layer 673" that are heated up by the heater 678 may also be referred to as "a sensor element section, or an air-fuel ratio sensor element" Accordingly, the heater 678 is configured so as to control the "air-fuel ratio sensor element temperature" which is the temperature of the sensor element section. The amount of heat generation of the heater 678 becomes greater as a magnitude of the amount of energy supplied to the heater 678 (current flowing through the heater 678) is greater. An amount of energy supplied to the heater 678 is adjusted so as to become greater as a duty signal (hereinafter, also referred to as a "heater duty Duty") generated by the electric controller 70 becomes greater. When the heater duty Duty is 100%, the amount of heat generation of the heater 678 becomes maximum. When the heater duty Duty is 0%, energizing the heater 678 is stopped, and accordingly, the heater 678 does not produce any heat.

The air-fuel ratio sensor element temperature varies depending on the admittance Y of the solid electrolyte layer 671. In other words, the air-fuel ratio sensor element temperature can be estimated based on the admittance Y. Generally, the air-fuel ratio sensor element temperature becomes higher as the admittance Y becomes larger. The electric controller 70 applies the "applied voltage generated by an electric power supply 679" superimposed periodically with a "voltage having a rectangular waveform, a sine waveform, or the like" between the exhaust-gas-side electrode layer 672 and the atmosphere-side electrode layer 673, and obtains the actual admittance Yact of the air-fuel ratio sensor 67 (solid electrolyte layer 671) based on the current flowing through the solid electrolyte layer 671.

As shown in (B) of FIG. 2, when the air-fuel ratio of the exhaust gas is leaner than the stoichiometric air-fuel ratio, the thus configured upstream air-fuel ratio sensor 67 ionizes oxygen which has reached the exhaust-gas-side electrode layer 672 after passing through the diffusion resistance layer 674, and makes the ionized oxygen reach the atmosphere-side electrode layer 673. As a result, an electrical current I flows from a positive electrode of the electric power supply 679 to a negative electrode of the electric power supply 679. As shown in FIG. 3, the magnitude of the electrical current I becomes a constant value which is proportional to a concentration of oxygen arriving at the exhaust-gas-side electrode layer 672 (or a partial pressure, the air-fuel ratio of the exhaust gas), when the electric voltage V is set at a predetermined value Vp or higher. The upstream air-fuel ratio sensor 67 outputs a value into which this electrical current (i.e., the limiting current Ip) is converted, as its output value Vabyfs.

To the contrary, as shown in (C) of FIG. 2, when the air-fuel ratio of the exhaust gas is richer than the stoichiometric air-fuel ratio, the upstream air-fuel ratio sensor 67 ionizes oxygen which is present in the atmosphere chamber 67A and makes the ionized oxygen reach the exhaust-gas-side electrode layer 672 so as to oxide the unburned combustibles (HC, CO, and $H_2$, etc.) reaching the exhaust-gas-side electrode layer 672 after passing through the diffusion resistance layer 674. As a result, an electrical current I flows from the negative electrode of the electric power supply 679 to the positive electrode of the electric power supply 679. As shown in FIG. 3, the magnitude of the electrical current I also becomes a constant value which is proportional to a concentration of the unburned combustibles arriving at the exhaust-gas-side electrode layer 672 (i.e., the air-fuel ratio of the exhaust gas), when the electric voltage V is set at the predetermined value Vp or higher. The upstream air-fuel ratio sensor 67 outputs a value into which the electrical current (i.e., the limiting current Ip) is converted, as its output value Vabyfs.

That is, the air-fuel detecting section 67*a*, as shown in FIG. 4, outputs, as the "air-fuel ratio sensor output", the output value Vabyfs being in accordance with the air-fuel ratio (an upstream air-fuel ratio abyfs, a detected air-fuel ratio abyfs) of the gas, which flows at the position at which the upstream air-fuel ratio sensor 67 is disposed and reaches the air-fuel detecting section 67*a* after passing through the inflow holes 67*b*1 of the outer protective cover 67*b* and the inflow holes 67*c*1 of the inner protective cover 67*c*. The output value Vabyfs becomes larger as the air-fuel ratio of the gas reaching the air-fuel ratio detecting section 67*a* becomes larger (leaner). That is, the output value Vabyfs is substantially proportional to the air-fuel ratio of the exhaust gas reaching the air-fuel ratio detecting section 67*a*. It should be noted that the output value Vabyfs becomes equal to a stoichiometric air-fuel ratio corresponding value Vstoich, when the detected air-fuel ratio abyfs is equal to the stoichiometric air-fuel ratio.

The electric controller 70 stores an air-fuel ratio conversion table (map) Mapabyfs shown in FIG. 4, and detects the actual upstream air-fuel ratio abyfs (that is, obtains the detected air-fuel ratio abyfs) by applying the output value Vabyfs of the air-fuel ratio sensor 67 to the air-fuel ratio conversion table Mapabyfs.

Meanwhile, the upstream air-fuel ratio sensor 67 is disposed, in either the exhaust manifold 51 or the exhaust pipe 52, at the position between the exhaust merging portion HK of the exhaust manifold 51 and the upstream catalyst 53 in such a manner that the outer protective cover 67*b* is exposed.

More specifically, as shown in FIGS. 8 and 9, the air-fuel ratio sensor 67 is disposed in the exhaust passage in such a manner that the bottom walls of the protective covers (67*b* and 67*c*) are parallel to the flow of the exhaust gas EX and the central axis CC of the protective covers (67*b* and 67*c*) is perpendicular to the flow of the exhaust gas EX. This allows the exhaust gas EX, which has reached the inflow holes 67*b*1 of the outer protective cover 67*b*, to be sucked into the space inside the outer protective cover 67*b* and into the space inside the inner protective cover 67*c*, owing to the flow of the exhaust gas EX in the exhaust passage, which flows in the vicinity of the outflow hole 67*b*2 of the outer protective cover 67*b*.

Thus, as indicated by the arrow Ar1 shown in FIGS. 8 and 9, the exhaust gas EX flowing through the exhaust passage flows into the space between the outer protective cover 67*b* and the inner protective cover 67*c* through the inflow holes 67*b*1 of the outer protective cover 67*b*. Subsequently, as indicated by the arrow Ar2, the exhaust gas flows into the "the space inside the inner protective cover 67*c*" through the "inflow holes 67*c*1 of the inner protective cover 67*c*," and then reaches the air-fuel ratio detection element 67*a*. Thereafter, as indicated by the arrow Ar3, the exhaust gas flows out to the exhaust passage through the "outflow hole 67*c*2 of the inner protective cover 67*c* and the outflow hole 67*b*2 of the outer protective cover 67*b*."

Accordingly, the flow rate of the exhaust gas within "the outer protective cover 67*b* and the inner protective cover 67*c*" changes in accordance with the flow rate of the exhaust gas EX flowing near the outflow hole 67*b*2 of the outer protective cover 67*b* (i.e., the intake air flow rate Ga representing the intake air amount per unit time). In other words, a time duration from a "point in time at which an exhaust gas having a specific air-fuel ratio (first exhaust gas) reaches the inflow holes 67*b*1" to a "point in time at which the first exhaust gas reaches the air-fuel ratio detecting section 67*a*" depends on the intake air-flow rate Ga, but does not depend on the engine rotational speed NE. Accordingly, the output responsiveness (responsiveness) of the air-fuel ratio sensor 67 for (with respect to) the "air-fuel ratio of the exhaust gas flowing through the exhaust passage" becomes better as the flow rate (speed of flow) of the exhaust gas flowing in the vicinity of the outer protective cover 67*b* is higher. This can be true even in a case in which the upstream air-fuel ratio sensor 67 has the inner protective cover 67*c* only.

Referring back to FIG. 7 again, the downstream air-fuel ratio sensor 68 is disposed in the exhaust pipe 52, and at a position downstream of an upstream catalyst 53 and upstream of the downstream catalyst (i.e., in the exhaust passage between the upstream catalyst 53 and the downstream catalyst). The downstream air-fuel ratio sensor 68 is a well-known electro-motive-force-type oxygen concentration sensor (well-known concentration-cell-type oxygen concentration sensor using stabilized zirconia). The downstream air-fuel ratio sensor 68 is designed to generate an output value Voxs corresponding to the air-fuel ratio of a gas to be detected, the gas flowing through a portion of the exhaust passage at which the downstream air-fuel ratio sensor 68 is disposed (that is, the air-fuel ratio of the gas which flows out from the upstream catalyst 53 and flows into the downstream catalyst; namely, the time average (temporal mean value) of the air-fuel ratio of the mixture supplied to the engine).

As shown in FIG. 10, this output value Voxs becomes a "maximum output value max (e.g., about 0.9 V)" when the air-fuel ratio of the exhaust gas to be detected is richer than the stoichiometric air-fuel ratio, becomes a "minimum output value min (e.g., about 0.1 V) when the air-fuel ratio of the exhaust gas to be detected is leaner than the stoichiometric air-fuel ratio, and becomes a voltage Vst (midpoint voltage Vst, e.g., about 0.5 V) which is approximately the midpoint value between the maximum output value max and the minimum output value min when the air-fuel ratio of the exhaust gas to be detected is the stoichiometric air-fuel ratio. Further, this voltage Vox changes suddenly from the maximum output value max to the minimum output value min when the air-fuel ratio of the exhaust gas to be detected changes from the air-fuel ratio richer than the stoichiometric air-fuel ratio to the air-fuel ratio leaner than the stoichiometric air-fuel ratio, and changes suddenly from the minimum output value min to the maximum output value max when the air-fuel ratio of the exhaust gas to be detected changes from the air-fuel ratio leaner than the stoichiometric air-fuel ratio to the air-fuel ratio richer than the stoichiometric air-fuel ratio.

The accelerator opening sensor 69 shown in FIG. 7 is designed to output a signal which indicates the operation amount Accp of the accelerator pedal 81 operated by the driver (accelerator pedal operation amount Accp). The accelerator pedal operation amount Accp increases as the opening of the accelerator pedal 81 (accelerator pedal operation amount) increases.

The electric controller 70 is a well-known microcomputer which includes a CPU 71; a ROM 72 in which programs executed by the CPU 71, tables (maps and/or functions), constants, etc. are stored in advance; a RAM 73 in which the CPU 71 temporarily stores data as needed; a backup RAM 74; and an interface 75 which includes an AD converter, etc. These components are mutually connected via a bus.

The backup RAM 74 is supplied with an electric power from a battery mounted on a vehicle on which the engine 10 is mounted, regardless of a position (off-position, start position, on-position, and so on) of an unillustrated ignition key switch of the vehicle. While the electric power is supplied to the backup RAM 74, data is stored in (written into) the backup RAM 74 according to an instruction of the CPU 71, and the backup RAM 74 holds (retains, stores) the data in such a manner that the data can be read out. When the battery is taken out from the vehicle, and thus, when the backup RAM 74 is not supplied with the electric power, the backup RAM 74 can not hold the data. Accordingly, the CPU 71 initializes the data (sets the data to default values) to be stored in the backup RAM 74 when the electric power starts to be supplied to the backup RAM 74 again.

The interface 75 is connected to sensors 61 to 69 so as to send signals from these sensors to the CPU 71. In addition, the interface 75 is designed to send drive signals (instruction signals) to the actuator 33*a* of the variable intake timing control apparatus 33, the actuator 36*a* of a variable exhaust timing control apparatus 36, each of the igniters 38 of the cylinders, the fuel injection valves 39 each of which is provided for each of the cylinders, the throttle valve actuator 44*a*, the heater 678 of the air-fuel ratio sensor 67, etc., in response to instructions from the CPU 71.

The electric controller 70 is designed to send an instruction signal to the throttle valve actuator 44*a* so that the throttle valve opening TA increases as the obtained accelerator pedal operation amount Accp increases. That is, the electric controller 70 has throttle valve drive means for changing the opening of the "throttle valve 44 disposed in the intake passage of the engine 10" in accordance with the acceleration operation amount (accelerator pedal operation amount Accp) of the engine 10 which is changed by the driver.

(Outline of the Inter-Cylinder Air-Fuel Ratio Imbalance Determination)

Next, there will be described the outline of method for the "inter-cylinder air-fuel ratio imbalance determination" which is adopted/used by the first determination apparatus. The inter-cylinder air-fuel ratio imbalance determination is to determine whether or not non-uniformity of the air-fuel ratio among the cylinders exceeds a value requiring some warning due to the change of the property/characteristic of the fuel injection valve 39, etc. In other words, the first determination apparatus determines that the inter-cylinder air-fuel ratio imbalance state has occurred when the magnitude of the difference in air-fuel ratio (cylinder-by-cylinder air-fuel ratio difference) between the imbalanced cylinder and the balanced cylinder is equal to or larger than a "degree which is not permissible in terms of the emission".

The first determination apparatus obtains, in order to perform the inter-cylinder air-fuel ratio imbalance determination, a "change amount per unit time (constant sampling time ts)" of the "air-fuel ratio represented by the output value Vabyfs of the air-fuel ratio sensor 67 (i.e., the detected air-fuel ratio abyfs obtained by applying the output value Vabyfs to the air-fuel ratio conversion table Mapabyfs shown in FIG. 4). The "change amount of the detected air-fuel ratio abyfs per unit time" can be said as (to be) a temporal (or time) differential value d(abyfs)/dt of the detected air-fuel ratio abyfs, if the unit time is very short, e.g., about 4 ms. Accordingly, the "change amount of the detected air-fuel ratio abyfs per unit time" will also be referred to as a "detected air-fuel ratio change rate ΔAF."

Exhaust gases from the cylinders reach the air-fuel ratio sensor 67 in the order of ignition (namely, in the order of exhaust). If the inter-cylinder air-fuel ratio imbalance state has not being occurring, the air-fuel ratios of the exhaust gases which are discharged from the cylinders and reach the air-fuel ratio sensor 67 are almost the same to each other. Accordingly, when the inter-cylinder air-fuel ratio imbalance state has not being occurring, the detected air-fuel ratio abyfs changes, for example, as indicated by a broken line C1 in (B) of FIG. 5. That is, when the inter-cylinder air-fuel ratio imbalance state has not being occurring, the waveforms of the output value Vabyfs of the air-fuel ratio sensor 67 are nearly flat. Thus, as shown by a broken line C3 in (C) of FIG. 5, when the inter-cylinder air-fuel ratio imbalance state has not being occurring, an absolute value of the detected air-fuel ratio change rate ΔAF is small.

Meanwhile, when the property of the "injection valve 39 injecting fuel to a specific cylinder (e.g., the first cylinder)" becomes a property that it injects fuel in an "amount greater than the instructed fuel injection amount", and thus, the inter-cylinder air-fuel ratio imbalance state has occurred, an air-fuel ratio of an exhaust gas of the specific cylinder (air-fuel ratio of the imbalanced cylinder) is greatly different from air-fuel ratios of exhaust gases of cylinders other than the specific cylinder (air-fuel ratio of the balanced cylinder).

Accordingly, the detected air-fuel ratio abyfs when the inter-cylinder air-fuel ratio imbalance state is occurring changes/fluctuates greatly at an interval of the unit combustion cycle, as indicated by a solid line C2 in (B) of FIG. 5. Therefore, as shown by a solid line C4 in (C) of FIG. 5, when the inter-cylinder air-fuel ratio imbalance state is occurring, the absolute value of the detected air-fuel ratio change rate ΔAF becomes large. It should be noted that, in a case where the engine is an in-line four-cylinder four-cycle type, the unit combustion cycle period is a period for which a crank angle of 720° passes/elapses That is, the unit combustion cycle period of the engine 10 is a period for which a crank angle passes, the crank angle being required for the engine to complete one combustion stroke in every and all of the cylinders that are the first to fourth cylinders, which discharge the exhaust gases reaching the single air-fuel ratio sensor 67.

Furthermore, the absolute value |ΔAF| of the detected air-fuel ratio change rate ΔAF fluctuates more greatly as the air-fuel ratio of the imbalanced cylinder deviates more greatly from the air-fuel ratio of the balanced cylinder. For example, if the detected air-fuel ratio abyfs changes as indicated by the solid line C2 in (B) of FIG. 5 when a magnitude of a difference between the air-fuel ratio of the imbalanced cylinder and the air-fuel ratio of the balanced cylinder is equal to a first value, the detected air-fuel ratio abyfs changes as indicated by an alternate long and short dash line C2*a* in (B) of FIG. 5 when the magnitude of the difference between the air-fuel ratio of the imbalanced cylinder and the air-fuel ratio of the balanced cylinder is equal to a "second value larger than the first value." Accordingly, the absolute value of the detected air-fuel ratio change rate ΔAF becomes larger as the air-fuel ratio of the imbalanced cylinder deviates more greatly from the air-fuel ratio of the balanced cylinder.

In view of the above, the first determination apparatus obtains, as a base indicating amount, the detected air-fuel ratio change rate ΔAF (first order differential value d(abyfs)/dt) every time the sampling time is elapses in a single unit combustion cycle period during/over/in a period (parameter obtaining period) in which a predetermined parameter obtaining condition is satisfied. The first determination apparatus obtains a mean value (an average value) of the absolute values |ΔAF| of a plurality of the detected air-fuel ratio change rates ΔAF obtained in the single unit combustion cycle period. Further, the first determination apparatus obtains a mean (average) value of the "mean values (average values) of the absolute values |ΔAF| of the detected air-fuel ratio change rates ΔAF", each has been obtained for each of a plurality of the combustion cycle periods, and adopts/employs the obtained value as the air-fuel ratio fluctuation indicating amount AFD. It should be noted that the imbalance determination parameter X is not limited to the above-described value, but may be obtained according to various methods described later.

Meanwhile, FIG. 6 shows a graph between the air-fuel ratio sensor element temperature and the responsiveness of the air-fuel ratio sensor 67. As understood from FIG. 6, the responsiveness of the air-fuel ratio sensor is better as the air-fuel ratio sensor element temperature is higher. It is inferred that the reason for that is the reaction (oxidation-reduction reaction) at the sensor element section (especially, at the exhaust-gas-side electrode layer 672) becomes more active.

On the other hand, as long as the cylinder-by-cylinder air-fuel ratio difference is not "0", the air-fuel ratio of the exhaust gas fluctuates every one cycle (period) which is the unit combustion cycle. Accordingly, when the air-fuel ratio sensor temperature is relatively low, the responsiveness of the air-fuel ratio sensor is not sufficient with respect to the fluctuation of the exhaust gas, and thus, the output value Vabyfs of the air-fuel ratio sensor can not sufficiently follow the "fluctuation in air-fuel ratio of the exhaust gas."

Accordingly, as indicated by a solid line L1 of FIG. 11, the air-fuel ratio fluctuation indicating amount AFD, when the cylinder-by-cylinder air-fuel ratio difference is large, and it should therefore be determined that the inter-cylinder air-fuel ratio imbalance state has been occurring, becomes smaller as the air-fuel ratio sensor element temperature becomes lower. Similarly, as indicated by a broken line L2 of FIG. 11, the air-fuel ratio fluctuation indicating amount AFD, when the cylinder-by-cylinder air-fuel ratio difference is not "0" and small, and it should therefore be determined that the inter-cylinder air-fuel ratio imbalance state has not occurred, becomes smaller as the air-fuel ratio sensor element temperature becomes lower.

Accordingly, there is a case where the air-fuel ratio fluctuation indicating amount (refer to, for example, point A1) obtained when it should be determined that the inter-cylinder air-fuel ratio imbalance state has been occurring and the air-fuel ratio temperature is relatively low is smaller than the air-fuel ratio fluctuation indicating amount (refer to, for example, point A2) obtained when it should be determined that the inter-cylinder air-fuel ratio imbalance state has not occurred and the air-fuel ratio temperature is relatively high. Therefore, if the air-fuel ratio fluctuation indicating amount AFD itself is adopted/employed as the imbalance determination parameter, and when the imbalance determination is carried out based on a comparison between the imbalance determination parameter and a "constant imbalance determination threshold", the imbalance determination may be erroneous.

In view of the above, the first determination apparatus cope with the problem as follows.

The first determination apparatus estimates the air-fuel ratio sensor element temperature in the parameter obtaining period.

The first determination apparatus adopts/employs the air-fuel ratio fluctuation indicating amount AFD which is corrected based on the estimated air-fuel ratio sensor element temperature (corrected air-fuel ratio fluctuation indicating amount) adopts/employs the imbalance determination parameter X.

More specifically, the first determination apparatus obtains the corrected air-fuel ratio fluctuation indicating amount by performing, on (onto) the obtained air-fuel ratio fluctuation indicating amount, a correction to decrease the "obtained air-fuel ratio fluctuation indicating amount AFD" as the estimated air-fuel ratio element temperature becomes higher with respect to a specific temperature, and/or, a correction to increase the "obtained air-fuel ratio fluctuation indicating amount" as the estimated air-fuel ratio element temperature becomes lower with respect to the specific temperature, and determines, as the imbalance determination parameter X, a value corresponding to (in accordance with) the corrected air-fuel ratio fluctuation indicating amount (e.g., a value obtained by multiplying the corrected air-fuel ratio fluctuation indicating amount by a positive constant, wherein the positive constant may includes "1").

After the first determination apparatus determines the imbalance determination parameter X, it compares the imbalance determination parameter X with the imbalance determination threshold Xth (constant threshold). The first determination apparatus determines that the inter-cylinder air-fuel-ratio imbalance state has occurred when the imbalance determination parameter X is larger than the imbalance determination threshold Xth. In contrast, the first determination apparatus determines that the inter-cylinder air-fuel-ratio imbalance state has not occurred when the imbalance determination parameter X is smaller than the imbalance determination threshold Xth. This is the outline of the method of inter-cylinder air-fuel-ratio imbalance determination employed by the first determination apparatus.

In this way, the first determination apparatus obtains the imbalance determination parameter X by correcting the air-fuel ratio fluctuation indicating amount AFD based on the "estimated air-fuel ratio element temperature." Accordingly, the imbalance determination parameter X is normalized/standardized so as to be a value obtained when the air-fuel ratio element temperature (and thus, the responsiveness of the air-fuel ratio sensor of the air-fuel ratio sensor) is a specific value (e.g., refer to a line L1hosei and a line L2hosei, shown in FIG. 11). Consequently, the imbalance determination can be accurately performed regardless of the air-fuel ratio sensor element temperature.

(Actual Operation)

<Fuel Injection Amount Control>

The CPU 71 of the first determination apparatus is designed to repeatedly execute a "routine for calculating the instructed fuel injection amount Fi and for instructing a fuel injection" shown in FIG. 12 for an arbitrary cylinder (hereinafter also referred to as a "fuel injection cylinder") each time the crank angle of that cylinder reaches a predetermined crank angle before its intake top dead center (e.g., BTDC 90° C.A). Accordingly, when the predetermined timing comes, the CPU 71 starts processing from step 1200, and determines whether or not a fuel cut condition (hereinafter, expresses as "FC condition") is satisfied at step 1210.

It is assumed here that the FC condition is not satisfied. In this case, the CPU 71 makes a "No" determination at step 1210 to executes processes from step 1220 to step 1250 one after another. Thereafter, the CPU 71 proceeds to step 1295 to end the present routine tentatively.

Step 1220: The CPU 71 obtains an "in-cylinder intake air amount Mc(k)", namely, the "amount of air taken into the fuel injection cylinder", based on the "intake air flow rate Ga measured using the air flow meter 61, the engine rotational speed NE obtained based on the signal from the crank position sensor 64, and a lookup table MapMc." The in-cylinder intake air amount Mc(k) is stored with information specifying the intake stroke in the RAM. The in-cylinder intake air amount Mc(k) may be computed from a well-known air model (a model established in conformity with a physical law simulating the behavior of air in the intake passage).

Step 1230: The CPU 71 obtains a basic fuel injection amount Fbase through dividing the in-cylinder intake air amount Mc(k) by a target air-fuel ratio abyfr. The target air-fuel ratio abyfr (upstream-side target air-fuel ratio abyfr) is set to (at) the stoichiometric air-fuel ratio (e.g., 14.6) except for specific cases, such as a case after the start or a case in which the load is high. Accordingly, the basic fuel injection amount Fbase is a feedforward amount of the fuel injection amount which is required for realizing/achieving the target air-fuel ratio abyfr which is equal to the stoichiometric air-fuel ratio. The step 1230 constitutes feedforward control means (air-fuel ratio control means) for having the air-fuel ratio of the mixture supplied to the engine coincide with the target air-fuel ratio abyfr.

Step 1240: The CPU 71 corrects the basic fuel injection amount Fbase based on a main feedback amount DFi. More specifically, the CPU 71 computes the instructed fuel injection amount (final fuel injection amount) Fi by adding the main feedback amount DFi to the basic fuel injection amount Fbase. The main feedback amount DFi is an air-fuel ratio feedback amount to have the air-fuel ratio of the engine coincide with the target air-fuel ratio abyfr. A way of calculating of the main feedback amount DFi will be described later.

Step 1250: The CPU 71 sends the injection instruction signal to the fuel injection valve 39 provided for the fuel injection cylinder, so that "fuel of the instructed injection amount Fi" is injected from that fuel injection valve 39.

Consequently, the fuel of an amount required to have the air-fuel ratio of the engine coincide with the target air-fuel ratio abyfr (in most cases, the stoichiometric air-fuel ratio) is injected from the fuel injection valve 39 of the fuel injection cylinder. That is, steps from 1220 to 1250 constitute instructed fuel injection amount control means for controlling the instructed fuel injection amount Fi in such a manner that an "air-fuel ratio of the mixture supplied to the combustion chambers 25 of two or more of the cylinders (in the present example, all of the cylinder) which discharge the exhaust gases reaching the air-fuel ratio sensor 67" coincides with the target air-fuel ratio abyfr.

Meanwhile, if the FC condition is satisfied when the CPU 71 executes the process of step 1210, the CPU 71 makes a "Yes" determination at step 1210 to directly proceed to step 1295 so as to end the present routine tentatively. In this case, fuel injection is not carried out by the process of step 1250, and the fuel cut control (fuel supply stop control) is therefore performed.

<Computation of the Main Feedback Amount>

The CPU 71 repeatedly executes a "main feedback amount computation routine" shown by a flowchart of FIG. 13 every time a predetermined time elapses. Accordingly, when the predetermined timing comes, the CPU 71 starts processing from step 1300, and proceeds to step 1305 to determine whether or not a "main feedback control condition (upstream-side air-fuel ratio feedback control condition)" is satisfied.

The main feedback control condition is satisfied when all of the following conditions are satisfied:

(A1) The air-fuel ratio sensor 67 has been activated.

(A2) An engine load (filling rate, loading rate) KL is equal to or smaller than a threshold KLth.

(A3) The fuel cut control is not being performed.

It should be noted that, in the present embodiment, the load KL is obtained in accordance with a formula (1) given below. An accelerator pedal operation amount Accp may be used in place of the load KL. In the formula (1), Mc is the in-cylinder intake air amount, ρ is the density of air (unit: g/l), L is the displacement of the engine 10 (unit: l), and "4" is the number of the cylinders of the engine 10.

$$KL=(Mc/(\rho\cdot L/4))\cdot 100\% \quad (1)$$

A description will be continued on the assumption that the main feedback control condition is satisfied. In this case, the CPU 71 makes a "Yes" determination at step 1305 to execute processes from steps 1310 to 1340 described below one after another, and then proceeds to step 1395 to end the present routine tentatively.

Step 1310: The CPU 71 obtains an output value Vabyfc for a feedback control, according to a formula (2) described below. In the formula (2), Vabyfs is the output value of the air-fuel ratio sensor 67, Vafsfb is a sub feedback amount calculated based on the output value Voxs of the downstream air-fuel ratio sensor 68. The way by which the sub feedback amount Vafsfb is calculated is well known. For example, the sub feedback amount Vafsfb is decreased when the output value Voxs of the downstream air-fuel ratio sensor 68 is a value indicating an air-fuel ratio richer than the stoichiometric air-fuel ratio corresponding to the value Vst, and is increased when the output value Voxs of the downstream air-fuel ratio sensor 68 is a value indicating an air-fuel ratio leaner than the stoichiometric air-fuel ratio corresponding to the value Vst. Note that the first determination apparatus may set the sub feedback amount Vafsfb to (at) "0", so that it may not perform the sub feedback control.

$$Vabyfc=Vabyfs+Vafsfb \tag{2}$$

Step 1315: The CPU 71 obtains an air-fuel ratio abyfsc for a feedback control by applying the output value Vabyfc for a feedback control to the table Mapabyfs shown in FIG. 4, as shown by a formula (3) described below.

$$abyfsc=Mapabyfs(Vabyfc) \tag{3}$$

Step 1320: According to a formula (4) described below, the CPU 71 obtains a "in-cylinder fuel supply amount Fc(k−N)" which is an "amount of the fuel actually supplied to the combustion chamber 25 for a cycle at a timing N cycles before the present time." That is, the CPU 71 obtains the "in-cylinder fuel supply amount Fc(k−N)" through dividing the "in-cylinder intake air amount Mc(k−N) which is the in-cylinder intake air amount for the cycle the N cycles (i.e., N·720° crank angle) before the present time" by the "air-fuel ratio abyfsc for a feedback control."

$$Fc(k-N)=Mc(k-N)/abyfsc \tag{4}$$

The reason why the in-cylinder intake air amount Mc(k−N) for the cycle N cycles before the present time is divided by the air-fuel ratio abyfsc for a feedback control in order to obtain the in-cylinder fuel supply amount Fc(k−N) is because the "exhaust gas generated by the combustion of the mixture in the combustion chamber 25" requires time "corresponding to the N cycles" to reach the air-fuel ratio sensor 67.

Step 1325: The CPU 71 obtains a "target in-cylinder fuel supply amount Fcr(k−N)" which is a "fuel amount which was supposed to be supplied to the combustion chamber 25 for the cycle the N cycles before the present time", according to a formula (5) described below. That is, the CPU 71 obtains the target in-cylinder fuel supply amount Fcr(k−N) through dividing the in-cylinder intake air amount Mc(k−N) for the cycle the N cycles before the present time by the target air-fuel ratio abyfr.

$$Fcr(k-N)=Mc(k-N)/abyfr \tag{5}$$

Step 1330: The CPU 71 obtains an "error DFc of the in-cylinder fuel supply amount", according to a formula (6) described below. That is, the CPU 71 obtains the error DFc of the in-cylinder fuel supply amount by subtracting the in-cylinder fuel supply amount Fc(k−N) from the target in-cylinder fuel supply amount Fcr(k−N). The error DFc of the in-cylinder fuel supply amount represents excess and deficiency of the fuel supplied to the cylinder the N cycle before the present time.

$$DFc=Fcr(k-N)-Fc(k-N) \tag{6}$$

Step 1335: The CPU 71 obtains the main feedback amount DFi, according to a formula (7) described below. In the formula (7) below, Gp is a predetermined proportion gain, and Gi is a predetermined integration gain. Further, a "value SDFc" in the formula (7) is an "integrated value of the error DFc of the in-cylinder fuel supply amount". That is, the CPU 71 calculates the "main feedback amount DFi" based on a proportional-integral control to have the air-fuel ratio abyfsc for a feedback control become equal to the target air-fuel ratio abyfr.

$$DFi=Gp\cdot DFc+Gi\cdot SDFc \tag{7}$$

Step 1340: The CPU 71 obtains a new integrated value SDFc of the error of the in-cylinder fuel supply amount by adding the error DFc of the in-cylinder fuel supply amount obtained at the step 1330 to the current integrated value SDFc of the error DFc of the in-cylinder fuel supply amount.

As described above, the main feedback amount DFi is obtained based on the proportional-integral control. The main feedback amount DFi is reflected in (onto) the final fuel injection amount Fi by the process of the step 1240 shown in FIG. 12.

In contrast, when the determination is made at step 1305, and if the main feedback condition is not satisfied, the CPU 71 makes a "No" determination at step 1305 to proceed to step 1345, at which the CPU 71 sets the value of the main feedback amount DFi to (at) "0". Subsequently, the CPU 71 stores "0" into the integrated value SDFc of the error of the in-cylinder fuel supply amount at step 1350. Thereafter, the CPU 71 proceeds to step 1395 to end the present routine tentatively. As described above, when the main feedback condition is not satisfied, the main feedback amount DFi is set to (at) "0". Accordingly, the correction for the basic fuel injection amount Fbase with the main feedback amount DFi is not performed.

<Inter-Cylinder Air-Fuel Ratio Imbalance Determination>

Next, there will be described processes for performing "inter-cylinder air-fuel ratio imbalance determination." The CPU 71 is designed to execute an "inter-cylinder air-fuel ratio imbalance determination routine" shown by a flowchart in FIG. 14 every time 4 ms (predetermined, fixed sampling interval ts) elapses.

Therefore, when a predetermined timing comes, the CPU 71 starts processing from step 1400, and then proceeds to step 1405 to determine whether or not a value of a parameter obtaining permission flag Xkyoka is "1."

The value of the parameter obtaining permission flag Xkyoka is set to (at) "1", when a parameter obtaining condition (imbalance determination parameter obtaining permissible condition) described later is satisfied at a point in time at which the absolute crank angle CA reaches 0° crank angle, and is set to (at) "0" immediately after a point in time at which the parameter obtaining condition becomes unsatisfied.

The parameter obtaining condition is satisfied when all of conditions described below (conditions C1 to C6) are satisfied. Accordingly, the parameter obtaining condition is unsatisfied when at least one of the conditions described below (conditions C1 to C6) is unsatisfied. It should be noted that the conditions constituting the parameter obtaining condition are not limited to those conditions C1 to C6 described below.

(Condition 1) A final result as to the inter-cylinder air-fuel-ratio imbalance determination has not been obtained yet after the current start of the engine 10. The condition C1 is also referred to as an imbalance determination execution request condition. The condition C1 may be replaced by a condition satisfied when "an integrated value of an operation time of the engine 10 or an integrated value of the intake air flow rate Ga is equal to or larger than a predetermined value."

(Condition 2) The intake air flow rate Ga measured by the air-flow meter 61 is within a predetermined range. That is, the intake air flow rate Ga is equal to or larger than a low-side intake air flow rate threshold GaLoth and is equal to or smaller than a high-side intake air flow rate threshold GaHith.

(Condition 3) The engine rotational speed NE is within a predetermined range. That is, the engine rotational speed NE is equal to or higher than a low-side engine rotational speed NELoth and is equal to or lower than a high-side engine rotational speed NEHith.

(Condition 4) The cooling water temperature THW is equal to or higher than a threshold cooling water temperature THWth.

(Condition 5) The main feedback control condition is satisfied.

(Condition 6) The fuel cut control is not being performed.

It is assumed here that the value of the parameter obtaining permission flag Xkyoka is equal to "1". In this case, the CPU 71 makes a "Yes" determination at step 1405 to proceed to step 1410, at which the CPU 71 obtains the "output value Vabyfs of the air-fuel ratio sensor 67 at that point in time" through an AD conversion.

Subsequently, the CPU proceeds to step 1415 to obtain a present/current detected air-fuel ratio abyfs by applying the output value Vabyfs obtained at step 1410 to the air-fuel ratio conversion table Mapabyfs shown in FIG. 4. It should be noted that the CPU 71 stores the detected air-fuel ratio obtained when the present routine was previously executed as a previous detected air-fuel ratio abyfsold before the process of step 1415. That is, the previous detected air-fuel ratio abyfsold is the detected air-fuel ratio abyfs 4 ms (the sampling time ts) before the present time. An initial value of the previous detected air-fuel ratio abyfsold is set at a value corresponding to an AD-converted value of the stoichiometric air-fuel ratio in an initial routine. The initial routine is a routine which is executed by the CPU 71 when the ignition key switch of the vehicle equipped with the engine 10 is turned from an off position to an on position.

Subsequently, the CPU 71 proceeds to step 1420, at which the CPU 71, (A) obtains the detected air-fuel ratio changing rate ΔAF, (B) renews/updates a cumulated value SAFD of an absolute value |ΔAF| of the detected air-fuel ratio changing rate ΔAF, and (C) renews/updates a cumulated number counter Cn showing how many times the absolute value |ΔAF| of the detected air-fuel ratio changing rate ΔAF is accumulated (integrated) to the cumulated value SAFD.

Next will be described the ways in which these values are renewed more specifically.

(A) Obtainment of the Detected Air-Fuel Ratio Change Rate ΔAF:

The detected air-fuel ratio change rate ΔAF (differential value d(abyfs)/dt) is a data (basic indicating amount) which is a base data for the air-fuel ratio fluctuation indicating amount AFD as well as the imbalance determination parameter X. The CPU 71 obtains the detected air-fuel ratio change rate ΔAF by subtracting the previous detected air-fuel ratio abyfsold from the present detected air-fuel ratio abyfs. That is, when the present detected air-fuel ratio abyfs is expressed as abyfs(n) and the previous detected air-fuel ratio abyfs is expressed as abyfs(n−1), the CPU 71 obtains the "present detected air-fuel ratio change rate ΔAF(n)" at step 1420, according to a formula (8) described below.

$$\Delta AF(n)=abyfs(n)-abyfs(n-1) \tag{8}$$

(B) Renewal of the Integrated Value SAFD of the Absolute Value |ΔAF| of the Detected Air-Fuel Ratio Change Rate ΔAF:

The CPU 71 obtains the present integrated value SAFD(n) according to a formula (9) described below. That is, the CPU 71 renews the integrated value SAFD by adding the absolute value |ΔAF(n)| of the present detected air-fuel ratio change rate ΔAF(n) calculated as described above to the previous integrated value SAFD(n−1) at the point in time when the CPU 71 proceeds to step 1420.

$$SAFD(n)=SAFD(n-1)+|\Delta AF(n)| \tag{9}$$

The reason why the "absolute value |ΔAF(n)| of the present detected air-fuel ratio change rate" is added to the integrated value SAFD is that the detected air-fuel ratio change rate ΔAF(n) can become both a positive value and a negative value, as understood from (B) and (C) in FIG. 5. It should be noted that the integrated value SAFD is set to (at) "0" in the initial routine.

(C) Renewal of the Cumulated Number Counter Cn of the Absolute Value |ΔAF| of the Detected Air-Fuel Ratio Change Rate ΔAF Added to the Integrated Value SAFD:

The CPU 71 increments a value of the counter Cn by "1" according to a formula (10) described below. Cn(n) represents the counter Cn after the renewal, and Cn(n−1) represents the counter Cn before the renewal. The value of the counter Cn is set to (at) "0" in the initial routine described above, and is also set to (at) "0" at step 1475 described later. The value of the counter Cn therefore represents the number of data of the absolute value |ΔAF| of the detected air-fuel ratio change rate ΔAF which has been accumulated in the integrated value SAFD.

$$Cn(n)=Cn(n-1)+1 \tag{10}$$

Subsequently, the CPU 71 proceeds to step 1425 to determine whether or not the crank angle CA (the absolute crank angle CA) measured with reference to the top dead center of the compression stroke of the reference cylinder (in the present example, the first cylinder) reaches 720° crank angle. When the absolute crank angle CA is less than 720° crank angle, the CPU 71 makes a "No" determination at step 1425 to directly proceed to step 1495, at which the CPU 71 ends the present routine tentatively.

It should be noted that step 1425 is a step to define the smallest unit period for obtaining a mean value (or average) of the absolute values |ΔAF| of the detected air-fuel ratio change rates ΔAF. Here, the "720° crank angle which is the unit combustion cycle" corresponds to the smallest unit period. The smallest unit period may obviously be shorter than the 720° crank angle, however, may preferably be a time period longer than or equal to a period having a multiple of the sampling time ts. That is, it is preferable that the smallest unit period be set/determined in such a manner that a plurality of the detected air-fuel ratio change rates ΔAF are obtained in the smallest unit period.

Meanwhile, if the absolute crank angle CA reaches 720° crank angle when the CPU 71 executes the process of step 1425, the CPU 71 makes a "Yes" determination at step 1425 to proceed to step 1430.

The CPU 71, at step 1430:

(D) calculates a mean value (average) AveΔAF of the absolute values |ΔAF| of the detected air-fuel ratio change rates ΔAF, (E) renews/updates an integrated value Save of the mean value AveΔAF, and (F) renews/updates a cumulated number counter Cs.

The ways in which these values are renewed will be next be described more specifically.

(D) Calculation of the Mean Value AveΔAF of the Absolute Values |ΔAF| of the Detected Air-Fuel Ratio Change Rates ΔAF:

The CPU 71 calculates the mean value AveΔAF of the absolute values |ΔAF| of the detected air-fuel ratio change rates ΔAF by dividing the integrated value SAFD by the value of the counter Cn, as shown in a formula (11) described below. Thereafter, the CPU 71 sets the integrated value SAFD to (at) "0."

$$\text{Ave}\Delta AF = SAFD/Cn \tag{11}$$

(E) Renewal of the Integrated Value Save of the Mean Value AveΔAF:

The CPU 71 obtains the present integrated value Save(n) according to a formula (12) described below. That is, the CPU 71 renews the integrated value Save by adding the present mean value AveΔAF obtained as described above to the previous integrated value Save(n−1) at the point in time when the CPU 71 proceeds to step 1430. The value of the integrated value Save(n) is set to (at) "0" in the initial routine described above.

$$\text{Save}(n) = \text{Save}(n-1) + \text{Ave}\Delta AF \tag{12}$$

(F) Renewal of the Cumulated Number Counter Cs:

The CPU 71 increments a value of the counter Cs by "1" according to a formula (13) described below. Cs(n) represents the counter Cs after the renewal, and Cs(n−1) represents the counter Cs before the renewal. The value of the counter Cs is set to (at) "0" in the initial routine described above. The value of the counter Cs therefore represents the number of data of the mean value AveΔAF which has been accumulated in the integrated value Save.

$$Cs(n) = Cs(n-1) + 1 \tag{13}$$

Subsequently, the CPU 71 proceeds to step 1435 to determine whether or not the value of the counter Cs is larger than or equal to a threshold value Csth. When the value of the counter Cs is smaller than the threshold value Csth, the CPU 71 makes a "No" determination at step 1435 to directly proceed to step 1495, at which the CPU 71 ends the present routine tentatively. It should be noted that the threshold value Csth is a natural number, and is preferably larger than or equal to 2.

Meanwhile, if the value of the counter Cs is larger than or equal to the threshold value Csth when the CPU 71 executes the process of step 1435, the CPU 71 makes a "Yes" determination at step 1435 to execute processes of step 1440 and step 1455 one after another, and then proceeds to step 1460.

Step 1440: The CPU 71 obtains the air-fuel ratio fluctuation indicating amount AFD through dividing the integrated value Save by the value of the counter (=Csth) according to a formula (14) described below. The air-fuel ratio fluctuation indicating amount AFD is a value obtained by averaging the mean values of the absolute values |ΔAF| of the detected air-fuel ratio change rates ΔAF, each of the mean values being obtained for each of the unit combustion cycle periods, over a plurality (Csth) of the unit combustion cycle periods.

$$AFD = \text{Save}/Csth \tag{14}$$

Step 1445: The CPU 71 estimates an air-fuel ratio sensor element temperature (temperature of the solid electrolyte layer 671 of the air-fuel ratio sensor 67) Temps based on the actual admittance Yact of the solid electrolyte layer 671. More specifically, the CPU 71 obtains the actual admittance Yact of the solid electrolyte layer 671 every time a predetermined time elapses based on a current flowing through the solid electrolyte layer 671 (the current flowing through the solid electrolyte layer 671 being a current obtained based on a voltage between the exhaust-gas-side electrode layer 672 and the atmosphere-side electrode layer 673 at a point in time a predetermined time elapses from an application of the detecting voltage) and a detected voltage, when a voltage formed of the "applied voltage generated by an electric power supply 679" and a "detecting voltage having a rectangular waveform, a sine waveform, or the like" which is superimposed periodically onto the applied voltage is applied between the exhaust-gas-side electrode layer 672 and the atmosphere-side electrode layer 673. It should be noted that the method for obtaining the admittance (or impedance which is an inverse number of the admittance) is well known, and is described in, for example, Japanese Patent Application Laid-Open (kokai) Nos. 2001-74693, 2002-48761, and 2007-17191. Further, the CPU 71 reads in the air-fuel ratio sensor element temperature Temps at step 1445, when the CPU 71 proceeds to step 1445.

Furthermore, at step 1445, the CPU 71 may estimate the air-fuel ratio sensor element temperature Temps based on an average of the values of admittance Yact obtained every elapse of the predetermined time in the period in which the air-fuel ratio fluctuation indicating amount AFD (more specifically, the detected air-fuel ratio change rates ΔAF) is being obtained.

FIG. 15 is a graph showing a relation between the air-fuel ratio sensor element temperature and the admittance of the solid electrolyte layer and. This relation is stored in the ROM 72 in a form of a look-up table in advance. This table is referred to as an element temperature table MapTemps(Y). The CPU 71 estimates the air-fuel ratio sensor element temperature Temps (=MapTemps(Yact)) by applying the obtained admittance Yact to the element temperature table MapTemps(Y).

Step 1450: The CPU 71 determines a correction value kh (kh≦1.0) by applying the air-fuel ratio sensor element temperature Temps estimated at step 1445 to a correction value calculation table Mapkh(Temps) shown by a solid line in FIG. 16. The correction value calculation table Mapkh(Temps) is stored in a form of a look-up table in the ROM 72 in advance.

According to the correction value calculation table Mapkh (Temps), the correction value (correction coefficient) kh is determined/obtained so as to become smaller in a range equal to or smaller than 1.0 as the air-fuel ratio sensor element temperature Temps becomes higher. Further, according to the correction value calculation table Mapkh(Temps), the correction value kh is maintained at 1.0, when the air-fuel ratio sensor element temperature Temps is equal to or lower than the activation temperature (e.g., 700° C. serving as a first specific temperature), and/or when the air-fuel ratio sensor element temperature Temps is equal to or higher than a permissible upper limit temperature (e.g., 900° C. serving as a second specific temperature). It should be noted that the correction value calculation table Mapkh(Temps) may be configured in such a manner that the correction value Kh increases as the air-fuel ratio sensor element temperature Temps becomes lower in a range equal to or lower than 700° C., and the correction value Kh decreases as the air-fuel ratio sensor element temperature Temps becomes higher in a range equal to or higher than 900° C. (refer to a broken line).

Step 1455: The CPU 71 obtains, as a corrected air-fuel ratio fluctuation indicating amount, a value (=kh·AFD) obtained by multiplying the "air-fuel ratio fluctuation indicating amount AFD obtained at step 1440" by the "correction value kh obtained at step 1450", and obtains (determines), as the imbalance determination parameter X, the corrected air-fuel ratio fluctuation indicating amount itself.

The correction using the correction value kh is an equivalent of correcting the air-fuel ratio fluctuation indicating amount AFD in such a manner that the obtained air-fuel ratio fluctuation indicating amount AFD is decreased as the estimated air-fuel ratio sensor element temperature Temps becomes higher with respect to (or from) a specific temperature (700° C., in the example shown in FIG. 16).

Further, the CPU 71 may obtain, as the imbalance determination parameter X, a value (=Cp·kh·AFD) obtained by multiplying the product (the corrected air-fuel ratio fluctuation indicating amount) of "the air-fuel ratio fluctuation indicating amount AFD obtained at step 1440" by "the correction value kh obtained at step 1450" by a positive constant Cp. It should be noted that the positive constant Cp being "1" means "determining the corrected air-fuel ratio fluctuation indicating amount itself as the imbalance determination parameter X."

In this manner, the imbalance determination parameter X is a value corresponding to (proportional to) the corrected air-fuel ratio fluctuation indicating amount obtained by correcting the air-fuel ratio fluctuation indicating amount AFD which is obtained at step 1440 in such a manner that the air-fuel ratio fluctuation indicating amount AFD becomes smaller as the estimated air-fuel ratio sensor element temperature Temps becomes higher.

Thereafter, the CPU 71 proceeds to step 1460 to determine whether or not the imbalance determination parameter X is larger than an imbalance determination threshold Xth.

When the imbalance determination parameter X is larger than the imbalance determination threshold Xth, the CPU 71 makes a "Yes" determination at step 1460 to proceed to step 1465, at which the CPU 71 sets a value of an imbalance occurrence flag XINB to (at) "1." That is, the CPU 71 determines that an inter-cylinder air-fuel ratio imbalance state has been occurring. Furthermore, the CPU 71 may turn on a warning lamp which is not shown. Note that the value of the imbalance occurrence flag XINB is stored in the backup RAM 74. Thereafter, the CPU 71 proceeds to step 1495 to end the present routine tentatively.

In contrast, if the imbalance determination parameter X is equal to or smaller than the imbalance determination threshold Xth when the CPU 71 performs the process of step 1460, the CPU 71 makes a "No" determination in step 1460 to proceed to step 1470, at which the CPU 71 sets the value of the imbalance occurrence flag XINB to (at) "2." That is, the CPU 71 memorizes the "fact that it has been determined that the inter-cylinder air-fuel ratio imbalance state has not occurred according to the result of the inter-cylinder air-fuel ratio imbalance determination." Then, the CPU 71 proceeds to step 1495 to end the present routine tentatively. Note that step 1470 may be omitted.

Meanwhile, if the value of the parameter obtaining permission flag Xkyoka is not "1" when the CPU 71 proceeds to step 1405, the CPU 71 makes a "No" determination at step 1405 to proceed to step 1475. Subsequently, the CPU 71 sets (clears) the each of the values (e.g., ΔAF, SAFD, SABF, Cn, etc.) to "0." Thereafter, the CPU 71 proceeds to step 1495 to end the present routine tentatively.

As described above, the first determination apparatus is applied to the multi-cylinder internal combustion engine 10 having a plurality of the cylinders. Further, the first determination apparatus comprises the air-fuel ratio sensor 67, a plurality of the fuel injection valves 39, and imbalance determining means.

The imbalance determining means obtains, based on the output value Vabyfs of the air-fuel ratio sensor 67, the air-fuel ratio fluctuation indicating amount AFD which becomes larger as the variation/fluctuation of the air-fuel ratio of the "exhaust gas passing/flowing through the position at which the air-fuel ratio sensor 67 is disposed" becomes larger, in the parameter obtaining period which is the period for/in which the predetermined parameter obtaining condition is being satisfied (parameter obtaining permission flag Xkyoka=1) (step 1405 to step 1440, shown in FIG. 14); makes the comparison between the imbalance determination parameter X obtained based on the obtained air-fuel ratio fluctuation indicating amount AFD and the predetermined imbalance determination threshold Xth (step 1455 and step 1460, shown in FIG. 14); determines that the inter-cylinder air-fuel ratio imbalance state has occurred when the imbalance determination parameter X is larger than the imbalance determination threshold Xth (step 1465 shown in FIG. 14); and determines that the inter-cylinder air-fuel ratio imbalance state has not occurred when the imbalance determination parameter X is smaller than the imbalance determination threshold Xth (step 1470 shown in FIG. 14).

Further, the imbalance determining means includes:

element temperature estimating means for estimating the air-fuel ratio sensor element temperature Temps which is the temperature of the solid electrolyte layer during/for the parameter obtaining period (step 1445 shown in FIG. 14, and FIG. 15); and pre-comparison preparation means for performing/making the determination before performing the comparison between the imbalance determination parameter X and the imbalance determination threshold Xth (i.e., before step 1460), wherein the determination is made by obtaining corrected air-fuel ratio fluctuation indicating amount obtained by performing, on (onto) the obtained air-fuel ratio fluctuation indicating amount AFD, the correction to decrease the obtained air-fuel ratio fluctuation indicating amount AFD as the estimated air-fuel ratio sensor element temperature Temps becomes higher with respect to the specific temperature (e.g., 700° C.), and by determining, as the imbalance determination parameter X, the value corresponding to (in accordance with) the corrected air-fuel ratio fluctuation indicating amount (step 1450 and 1455, shown in FIG. 14).

According to the configuration above, the imbalance determination parameter X becomes the "value which is obtained when the air-fuel ratio sensor element temperature Temps is equal to (coincides with) the specific temperature (that is, when the responsiveness of the air-fuel ratio sensor is the specific responsiveness)." In other words, the corrected air-fuel ratio fluctuation indicating amount becomes the "air-fuel ratio fluctuation indicating amount obtained when the air-fuel ratio sensor element temperature is equal to the specific temperature", and the imbalance determination parameter X becomes the "value in accordance with the air-fuel ratio fluctuation indicating amount obtained when the air-fuel ratio sensor element temperature is equal to the specific temperature." Consequently, the imbalance determination can be performed accurately regardless of the air-fuel ratio sensor element temperature Temps.

It should be noted that the first determination apparatus may determine the correction value kh at step 1450 by applying the air-fuel ratio sensor element temperature Temps estimated at step 1445 to a correction value calculation table Mapkhanother(Temps) indicated by an alternate long and short dash line shown in FIG. 16. The correction value calculation table Mapkhanother(Temps) is stored in the ROM 72 in a form of a look-up table in advance.

According to the correction value calculation table Mapkhanother(Temps), the correction value kh is determined/obtained so as to become smaller in a range equal to or smaller than 1.0 as the air-fuel ratio sensor element temperature Temps becomes higher with respect to (from) a specific temperature (e.g. 800° C.). That is, a correction to decrease the air-fuel ratio fluctuation indicating amount AFD is made as the estimated air-fuel ratio sensor element temperature Temps becomes higher with respect to (from) the specific temperature by the correction value kh, and the corrected air-fuel ratio fluctuation indicating amount is obtained by that correction.

Further, according to the correction value calculation table Mapkhanother(Temps), the correction value kh is determined/obtained so as to become larger in a range equal to or larger than 1.0 as the air-fuel ratio sensor element temperature Temps becomes higher with respect to (from) the specific temperature (e.g. 800° C.). That is, a correction to increase the air-fuel ratio fluctuation indicating amount AFD is made as the estimated air-fuel ratio sensor element temperature Temps becomes lower with respect to (from) the specific temperature by the correction value kh, and the corrected air-fuel ratio fluctuation indicating amount is obtained by that correction.

Accordingly, also with this correction value kh, the air-fuel ratio fluctuation indicating amount AFD is standardized/normalized so as to be the "air-fuel ratio fluctuation indicating amount AFD obtained when the air-fuel ratio sensor element temperature Temps coincides with the specific temperature (e.g., 800° C.)." That is, the pre-comparison preparation means included in the imbalance determining means of the first determination apparatus may be configured so as to obtain the corrected air-fuel ratio fluctuation indicating amount by performing a correction to increase the air-fuel ratio fluctuation indicating amount AFD as the air-fuel ratio sensor element temperature Temps becomes lower with respect to (from) the specific temperature (e.g. 800° C.), and by performing a correction to decrease the air-fuel ratio fluctuation indicating amount AFD as the air-fuel ratio sensor element temperature Temps becomes higher with respect to (from) the specific temperature (e.g. 800° C.).

Second Embodiment

Next, there will be described a determination apparatus according to a second embodiment of the present invention (hereinafter simply referred to as the "second determination apparatus").

The second determination apparatus adopts/employs, as the imbalance determination parameter X, the air-fuel ratio fluctuation indicating amount AFD itself (that is, without correcting the air-fuel ratio fluctuation indicating amount AFD based on the air-fuel ratio sensor element temperature Temps). In contrast, the second determination apparatus determines the imbalance determination threshold Xth based on the air-fuel ratio sensor element temperature Temps. That is, the second determination apparatus obtains the imbalance determination threshold Xth based on the air-fuel ratio sensor element temperature Temp in such a manner that the imbalance determination threshold Xth becomes larger as the air-fuel ratio sensor element temperature Temps becomes higher. Other than this point, the second determination apparatus is the same as the first determination apparatus.

(Actual Operation)

The CPU 71 of the second determination apparatus is different from the first determination apparatus only in that the CPU 71 executes an "inter-cylinder air-fuel ratio imbalance determination routine" shown by a flowchart in FIG. 17 in place of FIG. 14 every time sampling interval is (4 ms) elapses. Accordingly, this difference will be mainly described hereinafter.

The routine shown in FIG. 17 is different from the routine shown in FIG. 14 only in that step 1450 and step 1455, shown in FIG. 14, are replaced with the step 1710 and step 1720, respectively. Thus, hereinafter, processes of step 1710 and step 1720 will be described. It should be noted that each step shown in FIG. 17 at which the same processing is performed as each step which has been already described is given the same numeral as one given to such step.

The CPU 71 obtains the air-fuel ratio sensor element temperature Temps at step 1445, and then proceeds to step 1710, at which the CPU 71 determines the imbalance determination threshold Xth by applying the obtained air-fuel ratio sensor element temperature Temps to a threshold determining table MapXth(Temps) shown in FIG. 18.

According to the threshold determining table MapXth (Temps), the imbalance determination threshold Xth is determined so as to become larger as the air-fuel ratio sensor element temperature Temps becomes higher.

It should be noted that the CPU 71 may determine the imbalance determination threshold Xth by applying the air-fuel ratio sensor element temperature Temps obtained at step 1455 and the air flow rate Ga measured by the air-flow meter 61 to a threshold determining table MapXth(Temps, Ga) in place of the threshold determining table MapXth(Temps). According to the threshold determining table MapXth (Temps), the imbalance determination threshold Xth is determined based on the air-fuel ratio sensor element temperature Temps and the air flow rate Ga in such a manner that the imbalance determination threshold Xth becomes larger as the air-fuel ratio sensor element temperature Temps becomes higher, and becomes larger as the air flow rate Ga becomes larger.

The reason why the imbalance determination threshold Xth is determined based on not only the air-fuel ratio sensor element temperature Temps but also the air flow rate Ga is that the responsiveness of the air-fuel ratio sensor 67 becomes lower as the intake air-flow rate Ga becomes smaller due to the presence of the protective covers (67*b*, 67*c*).

Subsequently, the CPU 71 proceeds to step 1720, at which the CPU 71 adopts/employs, as the imbalance determination parameter X, the air-fuel ratio fluctuation indicating amount AFD obtained at step 1440. It should be noted that the CPU 71 may adopt/employ a value obtained by multiplying the air-fuel ratio fluctuation indicating amount AFD by a positive constant Cp.

Thereafter, the CPU 71 proceeds to step 1460, at which the CPU 71 performs the imbalance determination similarly to the CPU 71 of the first determination apparatus by comparing the imbalance determination parameter X obtained at step 1720 and the imbalance determination threshold Xth determined at step 1710. That is, the CPU 71 determines that the inter-cylinder air-fuel ratio imbalance state has been occurring when the imbalance determination parameter X is larger than the imbalance determination threshold Xth, and determines that the inter-cylinder air-fuel ratio imbalance state has not occurred when the imbalance determination parameter X is smaller than the imbalance determination threshold Xth.

As described above, similarly to the imbalance determining means of the first determination apparatus, the imbalance determining means of the second determination apparatus obtains, based on the output value Vabyfs of the air-fuel ratio sensor 67, the air-fuel ratio fluctuation indicating amount AFD which becomes larger as the variation/fluctuation of the air-fuel ratio of the "exhaust gas passing/flowing through the position at which the air-fuel ratio sensor 67 is disposed" becomes larger, in the parameter obtaining period which is the period for/in which the predetermined parameter obtaining condition is being satisfied (parameter obtaining permission flag Xkyoka=1) (step 1405 to step 1440, shown in FIG. 17); makes the comparison between the imbalance determination parameter X obtained based on the obtained air-fuel ratio fluctuation indicating amount AFD and the predetermined imbalance determination threshold Xth (step 1460 shown in FIG. 17); determines that the inter-cylinder air-fuel ratio imbalance state has occurred when the imbalance determination parameter X is larger than the imbalance determination threshold Xth (step 1465 shown in FIG. 17); and determines that the inter-cylinder air-fuel ratio imbalance state has not occurred when the imbalance determination parameter X is smaller than the imbalance determination threshold Xth (step 1470 shown in FIG. 17).

In addition, the imbalance determining means of the second determination apparatus is configured so as to determine the imbalance determination threshold Xth, based on the estimated air-fuel ratio sensor element temperature Temps, in such a manner that the imbalance determination threshold Xth becomes larger as the estimated air-fuel ratio sensor element temperature Temps becomes higher, in place of obtaining the corrected air-fuel ratio fluctuation indicating amount (step 1710 shown in FIG. 17, and FIG. 18).

As described above, the responsiveness of the air-fuel ratio sensor 67 becomes lower as the air-fuel ratio sensor element temperature Temps becomes lower, and the air-fuel ratio fluctuation indicating amount AFD obtained based on the output value Vabyfs of the air-fuel ratio sensor therefore becomes smaller as the air-fuel ratio sensor element temperature Temps becomes lower. In other words, the responsiveness of the air-fuel ratio sensor 67 becomes higher as the air-fuel ratio sensor element temperature Temps becomes higher, and the air-fuel ratio fluctuation indicating amount AFD obtained based on the output value Vabyfs of the air-fuel ratio sensor therefore becomes larger as the air-fuel ratio sensor element temperature Temps becomes higher.

In order to cope with the above, in the second determination apparatus, the imbalance determination threshold Xth becomes larger as the estimated air-fuel ratio sensor element temperature Temps becomes higher, and the imbalance determination threshold Xth becomes smaller as the estimated air-fuel ratio sensor element temperature Temps becomes lower. That is, the imbalance determination threshold Xth in the second determination apparatus becomes a value obtained by considering an "effect on the imbalance determination threshold Xth of the responsiveness of the air-fuel ratio sensor 67 changing depending on the air-fuel ratio sensor element temperature Temps." Consequently, the imbalance determination can be accurately made regardless of the air-fuel ratio sensor element temperature.

Third Embodiment

Next, there will be described a determination apparatus according to a third embodiment of the present invention (hereinafter simply referred to as the "third determination apparatus").

The third determination apparatus is different from the first determination apparatus only in the following points.

The third determination apparatus includes heater control means for controlling an amount of heat generation of/from the heater 678 in such a manner that a difference between the actual admittance Yact of the solid electrolyte layer 671 and a predetermined target value (target admittance Ytgt) becomes smaller.

The third determination apparatus is configured so as to estimate the air-fuel ratio sensor element temperature Temps based on a "value corresponding to an amount of a current flowing through the heater 678", whereas the first determination apparatus estimates the air-fuel ratio sensor element temperature Temps based on the "actual admittance Yact of the solid electrolyte layer 671."

These differences will next be described hereinafter.

A solid line Y1 shown in FIG. 19 indicates the relation between the admittance Y (admittance Y of the solid electrolyte layer 671) of the air-fuel ratio sensor 67 which has not deteriorated with age and the air-fuel ratio sensor element temperature Temps. The admittance Y becomes larger as the air-fuel ratio sensor element temperature Temps becomes higher. Accordingly, the electric controller 70 controls the amount of heat generation of/from the heater 678 (performs the heater control) by controlling the amount of energy supplied to the heater 678 (current flowing through the heater 678) in such a manner that a difference between the actual admittance Yact of the air-fuel ratio sensor 67 and the predetermined target admittance Ytgt becomes smaller.

However, the air-fuel ratio sensor 67 deteriorates with age (changes with the passage of time) when a usage time of the air-fuel ratio sensor 67 becomes long. As a result, the "admittance Y of the air-fuel ratio sensor 67 which has deteriorated with age" indicated by the broken line Y2 shown in FIG. 19 becomes smaller than the "admittance Y of the air-fuel ratio sensor 67 which has not deteriorated with age" indicated by the solid line Y1.

Accordingly, even when the actual admittance Yact of the solid electrolyte layer coincides with the target admittance Ytgt by the heater control, the air-fuel ratio sensor element temperature differs in accordance with whether or not the air-fuel ratio sensor has deteriorated with age. Accordingly, if the air-fuel ratio sensor element temperature is estimated based on the actual admittance Yact, the estimated air-fuel ratio sensor element temperature may be different from the actual air-fuel ratio sensor element temperature. Consequently, if the corrected air-fuel ratio fluctuation indicating amount (imbalance determination parameter) is obtained using the air-fuel ratio sensor element temperature Temps which is estimated based on the actual admittance Yact, it is likely that the corrected air-fuel ratio fluctuation indicating amount (imbalance determination parameter) is not a value which accurately represent the cylinder-by-cylinder air-fuel ratio difference.

In view of the above, as described above, the third determination apparatus estimates the air-fuel ratio sensor element temperature Temps based on the "value corresponding to the amount of the current flowing through the heater 678."

(Actual Operation)

The CPU 71 of the third determination apparatus executes the routines shown in FIGS. 12 to 14, similarly to the CPU 71 of the first determination apparatus. Further, the CPU 71 of the third determination apparatus executes an "air-fuel ratio sensor heater control routine" shown by a flowchart of FIG. 20 every time a predetermined time elapses, in order to control the air-fuel ratio sensor element temperature.

<Air-Fuel Ratio Sensor Heater Control>

Accordingly, when the predetermined timing comes, the CPU 71 starts processing from step 2000 in FIG. 20 to proceed to step 2010, at which the CPU 71 sets the target admittance Ytgt. The target admittance Ytgt is set to (at) a value corresponding to a first temperature (e.g., 600° C.) before the warming-up of the engine 10 completes (the cooling water temperature THW is equal to or lower than the threshold cooling water temperature THWth), and is set to (at) a value corresponding to a "second temperature (e.g., 750° C.) higher than the first temperature" after the warming-up of the engine 10 completes.

Thereafter, the CPU 71 proceeds to step 2020, at which the CPU 71 determines whether or not the actual admittance Yact is larger than a "value obtained by adding a predetermined positive value a to the target admittance Ytgt."

When the condition in step 2020 is satisfied, the CPU 71 makes a "Yes" determination at step 2020 to proceed to step 2030, at which the CPU 71 decreases the heater duty Duty by a predetermined amount ΔD. Subsequently, the CPU 71 proceeds to step 2040 to energize the heater 678 based on the heater duty Duty. In this case, because the heater duty is decreased, the amount of energy (current) supplied to the heater 678 is decreased, so that the amount of heat generation by the heater 678 is decreased. Consequently, the air-fuel ratio sensor element temperature decreases. Thereafter, the CPU 71 proceeds to step 2095 to end the present routine tentatively.

In contrast, if the actual admittance Yact is smaller than or equal to the "value obtained by adding the predetermined positive value a to the target admittance Ytgt" when the CPU 71 executes the process of step 2020, the CPU 71 makes a "No" determination at step 2020 to proceed to step 2050. At step 2050, the CPU 71 determines whether or not the actual admittance Yact is smaller than a "value obtained by subtracting the predetermined positive value α from the target admittance Ytgt."

When the condition in step 2050 is satisfied, the CPU 71 makes a "Yes" determination at step 2050 to proceed to step 2060, at which the CPU 71 increases the heater duty Duty by the predetermined amount ΔD. Subsequently, the CPU 71 proceeds to step 2040 to energize the heater 678 based on the heater duty Duty. In this case, because the heater duty is increased, the amount of energy (current) supplied to the heater 678 is increased, so that the amount of heat generation by the heater 678 increases. Consequently, the air-fuel ratio sensor element temperature is elevated/increased/raised. Thereafter, the CPU 71 proceeds to step 2095 to end the present routine tentatively.

In contrast, if the actual admittance Yact is larger than the "value obtained by subtracting the predetermined positive value a from the target admittance Ytgt" when the CPU 71 executes the process of step 2050, the CPU 71 makes a "No" determination at step 2050 to directly proceed to step 2040. In this case, because the heater duty is not changed, the amount of energy supplied to the heater 678 is therefore not changed. Consequently, since the amount of heat generation by the heater 678 is not changed, the air-fuel ratio sensor element temperature does not greatly change. Thereafter, the CPU 71 proceeds to step 2095 to end the present routine tentatively.

In this manner, the actual admittance Yact is controlled within a rage in the vicinity of the target admittance Ytgt (the range between Ytgt−α and Ytgt+α) according to the heater control. In other words, the air-fuel ratio sensor element temperature is made substantially equal to a value corresponding to the target admittance Ytgt.

In addition, the CPU 71 of the third determination apparatus executes a routine which is the same as the routine shown in FIG. 14. However, when the CPU 71 proceeds to step 1445, the CPU 71 estimates the air-fuel ratio sensor element temperature Temps in a way different from the way used by the CPU 71 of the first determination apparatus.

More specifically, the CPU 71 of the third determination apparatus obtains a blurred value SD of the heater duty Duty every time a predetermined time (sampling time ts) elapses. The blurred value SD is calculated according to a formula (15) described below, if the heater duty Duty when the blurred value SD is updated/renewed is expressed as Duty(n), the blurred value SD after the update/renewal is expressed as SD(n), and the blurred value SD before the update/renewal (that is, the blurred value SD the sampling time ts before) is expressed as SD(n−1). β is a any constant between 0 to 1.

$$SD(n)=\beta\cdot SD(n-1)+(1-\beta)\cdot \mathrm{Duty}(n) \quad (15)$$

The CPU 71 read in the blurred value SD at step 1445, and estimates, based on the blurred value SD, the air-fuel ratio sensor element temperature Temps in such a manner that the air-fuel ratio sensor element temperature Temps becomes higher as the blurred value SD becomes larger.

Subsequently, the CPU 71 proceeds to step 1450 to determine the correction value kh by applying the air-fuel ratio sensor element temperature Temps estimated at step 1445 to the correction value calculation table Mapkh(Temps) shown in FIG. 16 (or the correction value calculation table Mapkhanother(Temps)). Thereafter, at step 1455, the CPU 71 obtains, as the corrected air-fuel ratio fluctuation indicating amount, the value (=kh·AFD) obtained by multiplying the "air-fuel ratio fluctuation indicating amount AFD obtained at step 1440" by the "correction value kh obtained at step 1450", and obtains (determines), as the imbalance determination parameter X, the corrected air-fuel ratio fluctuation indicating amount itself.

Subsequently, the CPU 71 proceeds to steps following step 1460 to perform the imbalance determination based on the comparison between the imbalance determination parameter X and the imbalance determination threshold Xth. That is, the CPU 71 determines that the inter-cylinder air-fuel-ratio imbalance state has been occurring when the imbalance determination parameter X is larger than the imbalance determination threshold Xth, and determines that the inter-cylinder air-fuel-ratio imbalance state has not occurred when the imbalance determination parameter X is smaller than or equal to the imbalance determination threshold Xth. These are the actual operations of the third determination apparatus.

It should be noted that the CPU 71 of the third determination apparatus (and the other determination apparatuses described later) may control the amount of heat generation of the heater in such a manner that a difference between the actual impedance Zact and a target value (target impedance Ztgt) becomes smaller. Because the impedance Z is an inverse number of the admittance Y, the air-fuel ratio sensor element temperature Temps becomes lower as the impedance Z becomes larger. Accordingly, the CPU 71 increases the heater duty Duty by a predetermined amount AD when the actual impedance Zact is larger than a "value obtained by adding the predetermined positive value γ to the target impedance Ztgt." Further, the CPU 71 decreases the heater duty Duty by the predetermined amount ΔD when the actual impedance Zact is smaller than a "value obtained by subtracting the predetermined positive value γ from the target impedance Ztgt."

Further, the CPU 71 of the third determination apparatus may be configured so as to estimate the air-fuel ratio sensor element temperature Temps based on not only the "value (blurred value SD) corresponding to the amount of the current flowing through the heater" but also an "operating parameter of the engine 10 associated with the exhaust gas temperature." The "operating parameter of the engine 10 associated with the exhaust gas temperature" is one or more selected from, for example, the exhaust gas temperature detected by an exhaust gas temperature sensor, the air flow rate Ga measured by the air-flow meter 61, a load KL, the engine rotational speed NE, and the like.

The actual exhaust gas temperature becomes higher as the value of each of those parameters becomes larger. Accordingly, the CPU 71 estimates the air-fuel ratio sensor element temperature Temps in such a manner that the air-fuel ratio sensor element temperature Temps becomes higher as the value selected from those parameters becomes larger.

As described above, the air-fuel ratio sensor 67 includes the heater 678 which produces heat when the current is flowed through the heater 678 so as to heat (up) the "sensor element section including the solid electrolyte layer 671, the exhaust-gas-side electrode layer 672, and the atmosphere-side electrode layer 673." Further, the third determination apparatus includes the heater control means (FIG. 20) to control the amount of heat generation of/from the heater 678 in such a manner that the difference between the actual admittance Yact of the solid electrolyte layer 671 and the predetermined target value (target admittance Ytgt) becomes smaller. In addition, the element temperature estimating means of the third determination apparatus is configured so as to estimate the air-fuel ratio sensor element temperature Temps based on at least the "value (blurred value SD) in accordance with the amount of the current flowing through the heater 678" (step 1445 shown in FIG. 14 describing the third determination apparatus).

The magnitude (Duty) of the current flowing through the heater 678 has a strong relation with the amount of heat generation of the heater 678, and thus, has a strong relation with the air-fuel ratio sensor element temperature Temps. Accordingly, when (by) estimating the air-fuel ratio sensor element temperature Temps based on the value (blurred value SD) corresponding to the amount of the current flowing through the heater, the air-fuel ratio sensor element temperature Temps can be estimated accurately regardless of whether or not the air-fuel ratio sensor 67 has deteriorated with age. Consequently, the imbalance determination parameter X with high accuracy can be obtained, and the imbalance determination can therefore be made accurately.

Further, the element temperature estimating means may be configured so as to estimate the air-fuel ratio sensor element temperature Temps based on the operating parameter of the engine 10 correlating to the temperature of the exhaust gas.

The air-fuel ratio sensor element temperature varies depending also on the exhaust gas temperature. Accordingly, the air-fuel ratio sensor element temperature Temps can be more accurately estimated according to the above configuration. Consequently, the imbalance determination parameter X with high accuracy can be obtained, and the imbalance determination can therefore be made accurately.

It should be noted that the CPU 71 of the third determination apparatus may obtain, in place of the blurred value SD of the heater duty Duty, a blurred value SI of the actual current (heater current) I flowing through the heater 678 as the "value corresponding to the amount of the current flowing through the heater 678", and may estimate the air-fuel ratio sensor element temperature Temps based on the value SI.

Fourth Embodiment

Next, there will be described a determination apparatus according to a fourth embodiment of the present invention (hereinafter simply referred to as the "fourth determination apparatus").

The fourth determination apparatus is different from the third determination apparatus only in the following point.

The fourth determination apparatus determines the "imbalance determination threshold Xth" based on the air-fuel ratio sensor element temperature Temps which is estimated based on the "value corresponding to the amount of the current flowing through the heater", whereas the third determination apparatus determines the "imbalance determination parameter X" based on the air-fuel ratio sensor element temperature Temps which is estimated based on the "value corresponding to the amount of the current flowing through the heater."

The difference will next be described hereinafter.

(Actual Operation)

The CPU 71 of the fourth determination apparatus executes the routines shown in FIGS. 12, 13, and 17, similarly to the CPU 71 of the second determination apparatus. Further, the CPU 71 of the fourth determination apparatus executes the routine shown in FIG. 20, similarly to the CPU 71 of the third determination apparatus.

However, when the CPU 71 of the fourth determination apparatus proceeds to step 1445 shown in FIG. 17, the CPU 71 obtains the "blurred value SD of the heater duty Duty which is separately calculated according to the formula (15) described above" at step 1445. Further, the CPU 71 estimates the air-fuel ratio sensor element temperature Temps based on the blurred value SD in such a manner that the air-fuel ratio sensor element temperature Temps becomes higher as the blurred value SD becomes larger.

Subsequently, the CPU 71 proceeds to step 1710, at which the CPU 71 determines the imbalance determination threshold Xth by applying the air-fuel ratio sensor element temperature Temps which is obtained at stp 1445 based on the "blurred value SD" to the threshold determining table MapXth(Temps) shown in FIG. 18. The imbalance determination threshold Xth becomes smaller as the estimated air-fuel ratio sensor element temperature Temps becomes lower.

Subsequently, the CPU 71 proceeds to step 1720, at which the CPU 71 adopts/employs, as the imbalance determination parameter X, the air-fuel ratio fluctuation indicating amount AFD obtained at step 1440. Thereafter, the CPU 71 proceeds to steps following step 1460 to perform the imbalance determination based on the comparison between the imbalance determination parameter X and the imbalance determination threshold Xth. That is, the CPU 71 determines that the inter-cylinder air-fuel-ratio imbalance state has been occurring when the imbalance determination parameter X is larger than the imbalance determination threshold Xth, and determines that the inter-cylinder air-fuel-ratio imbalance state has not occurred when the imbalance determination parameter X is smaller than or equal to the imbalance determination threshold Xth. These are the actual operations of the fourth determination apparatus.

It should be noted that the CPU 71 of the fourth determination apparatus may be configured so as to estimate the air-fuel ratio sensor element temperature Temps based on not only the "value (blurred value SD) corresponding to the amount of the current flowing through the heater" but also the "operating parameter of the engine 10 associated with the exhaust gas temperature" described above, similarly to the third determination apparatus. Further, the fourth determination apparatus may obtain, in place of the blurred value SD of the heater duty Duty, the blurred value SI of the actual current (heater current) I flowing through the heater 678 as the "value corresponding to the amount of the current flowing through the heater 678", and may estimate the air-fuel ratio sensor element temperature Temps based on the value SI.

As described above, similarly to the third determination apparatus, the fourth determination apparatus includes the element temperature estimating means which is configured so as to estimate the air-fuel ratio sensor element temperature Temps based on at least the "value (blurred value SD, SI) in accordance with the amount of the current flowing through the heater 678" (step 1445 shown in FIG. 17). Accordingly, the fourth determination apparatus can estimate the air-fuel ratio sensor element temperature Temps accurately regardless of whether or not the air-fuel ratio sensor 67 has deteriorated with age. Consequently, the imbalance determination threshold Xth can be obtained while considering the "effect on the imbalance determination parameter X of the responsiveness of the air-fuel ratio sensor changing depending on the air-fuel ratio sensor element temperature Temps." Accordingly, the imbalance determination can be accurately performed.

Fifth Embodiment

Next, there will be described a determination apparatus according to a fifth embodiment of the present invention (hereinafter simply referred to as the "fifth determination apparatus").

The fifth determination apparatus is different from the third determination apparatus only in that the fifth determination apparatus makes the target admittance Ytgt when the parameter obtaining permissible condition is satisfied (parameter obtaining permission flag Xkyoka is "1") (be) larger by a predetermined value ΔY than the target admittance Ytgt (=Ytujo) when the parameter obtaining permissible condition is not satisfied (parameter obtaining permission flag Xkyoka is "0").

More specifically, the CPU 71 of the fifth determination apparatus executes an "air-fuel ratio sensor heater control routine" shown by a flowchart in FIG. 21 in place of FIG. 20 every time a predetermined time elapses. It should be noted that each step shown in FIG. 21 at which the same processing is performed as each step which has been already described is given the same numeral as one given to such step.

When the predetermined timing comes, the CPU 71 starts processing from step 2100 to proceed to step 2110, at which the CPU 71 determines whether or not the value of the parameter obtaining permission flag Xkyoka is "0."

When the value of the parameter obtaining permission flag Xkyoka is "0", the CPU 71 makes a "Yes" determination at step 2110 to proceed to step 2120, at which the CPU 71 sets the target admittance to (at) a usual value Ytujo. The usual value Ytujo is set to a value in such a manner that the air-fuel ratio sensor 67 is activated, and the output value Vabyfs coincides with a value which corresponds to an air-fuel ratio of the exhaust gas as long as the air-fuel ratio of the exhaust gas is stable. For example, the usual value Ytujo is an admittance Y when the sensor element temperature is about 700° C. The air-fuel ratio sensor element temperature corresponding to the usual value Ytujo is also referred to as "the usual temperature and a first temperature t1." Thereafter, the CPU 71 proceeds to steps following step 2020.

In contrast, if the value of the parameter obtaining permission flag Xkyoka is "1" when the CPU 71 executes the process of step 2110, the CPU 71 makes a "No" determination at step 2110 to proceed to step 2130, at which the CPU 71 sets the target admittance Ytgt to (at) a "value (Ytujo+ΔY) obtained by adding a predetermined positive value ΔY to the usual value Ytujo." That is, the CPU 71 makes the target admittance Ytgt (be) larger than the usual value Ytujo. Thereafter, the CPU 71 proceeds to steps following step 2020.

The "value (Ytujo+ΔY) obtained by adding the predetermined positive value ΔY to the usual value Ytujo" may also be referred to as an elevated value Ytup. The elevated value Ytup is set to a value in such a manner that the air-fuel ratio sensor 67 is activated, and the responsiveness of the air-fuel ratio sensor 67 is a "degree at which the output value Vabyfs can sufficiently follow the fluctuation of the air-fuel ratio of the exhaust gas." For example, the elevated value Ytup is an admittance Y when the sensor element temperature is about 850° C. The air-fuel ratio sensor element temperature corresponding to the elevated value Ytup is also referred to as "the elevated temperature and a second temperature t2."

Consequently, by the processes following step 2020 executed by the CPU 71, the air-fuel ratio sensor element temperature in a period in which the base indicating amount (detected air-fuel ratio changing rate ΔAF) which is the base data for the air-fuel ratio fluctuation indicating amount AFD is being obtained (parameter obtaining period) becomes higher than the air-fuel ratio sensor element temperature in the usual period (parameter non-obtaining period in which the detected air-fuel ratio changing rate ΔAF is not being obtained). Accordingly, the detected air-fuel ratio changing rate ΔAF is obtained in the "state where the responsiveness of the air-fuel ratio sensor is high." Consequently, the air-fuel ratio fluctuation indicating amount AFD which more accurately represents the cylinder-by-cylinder air-fuel ratio difference can be obtained.

It should be noted that the CPU 71 of the fifth determination apparatus, similarly to the third determination apparatus, estimates the air-fuel ratio sensor element temperature Temps based on the "value corresponding to the amount of the current flowing through the heater", corrects the air-fuel ratio fluctuation indicating amount AFD based on the estimated air-fuel ratio sensor element temperature Temps, and obtains (determines) the corrected air-fuel ratio fluctuation indicating amount (kh AFD) obtained by the correction as the imbalance determination parameter X. This enables the imbalance determination parameter X to coincide with the "imbalance determination parameter which is obtained when the responsiveness of the air-fuel ratio sensor 67 coincides with the specific responsiveness" regardless of whether or not the air-fuel ratio sensor 67 has deteriorated with age. Furthermore, the fifth determination apparatus performs the imbalance determination based on the comparison between the imbalance determination parameter X and the imbalance determination threshold Xth.

As described above, the imbalance determining means of the fifth determination apparatus is configured so as to instruct the heater control means in such a manner that the heater control means performs, in the parameter obtaining period, a "sensor element section temperature elevating control to have the temperature of the sensor element section during the parameter obtaining period (be) higher than the temperature of the sensor element section during the period other than the parameter obtaining period" (refer to step 2110 shown in FIG. 21).

In addition, the heater control means is configured so as to realize the sensor element section temperature elevating control by having/making the target value (target admittance Ytgt, target impedance Ztgt) when it is instructed to perform the sensor element section temperature elevating control (be) different from the target value when it is not instructed to perform the sensor element section temperature elevating control (step 2120 and step 2130, shown in FIG. 21). That is, in the case where the target value is the target admittance Ytgt, the target value when the sensor element section temperature elevating control is not instructed is the usual value Ytujo, and the target value when the sensor element section temperature elevating control is instructed is the elevated value Ytup (=Ytujo+ΔY). In contrast, in the case where the target value is the target impedance Ztgt, the target value when the sensor element section temperature elevating control is not instructed is the usual value Ztujo, and the target value when the sensor element section temperature elevating control is instructed is the elevated value Xtup (=Ztujo−ΔZ, ΔZ>0).

According to the configuration described above, the imbalance determination parameter X becomes a value which more accurately represents the cylinder-by-cylinder air-fuel ratio difference, and the imbalance determination can therefore be more accurately performed. Further, the air-fuel ratio sensor element temperature during the usual period is maintained at the relatively low temperature (usual temperature, first temperature t1), and accordingly, it can be avoided for the air-fuel ratio sensor to early deteriorate (with age) as compared to the case in which the air-fuel ratio sensor element temperature is always maintained at the relatively high temperature (elevated temperature, second temperature t2).

Sixth Embodiment

Next, there will be described a determination apparatus according to a sixth embodiment of the present invention (hereinafter simply referred to as the "sixth determination apparatus").

The sixth determination apparatus is different from the fourth determination apparatus only in that the sixth determination apparatus makes the target admittance Ytgt when the parameter obtaining permissible condition is satisfied (parameter obtaining permission flag Xkyoka is set to (at) "1") (be) larger by the predetermined value ΔY than the target admittance Ytgt (=Ytujo) when the parameter obtaining permissible condition is not satisfied (parameter obtaining permission flag Xkyoka is "0").

That is, similarly to the fifth determination apparatus, the sixth determination apparatus comprises the imbalance determining means which instructs the heater control means to perform, in the parameter obtaining period, the "sensor element section temperature elevating control" (refer to step 2110 shown in FIG. 21).

Furthermore, similarly to the heater control means of the fifth determination apparatus, the heater control means of the sixth determination apparatus is configured so as to realize the sensor element section temperature elevating control by having/making the target value (target admittance Ytgt, target impedance Ztgt) when it is instructed to perform the sensor element section temperature elevating control different from the target value when it is not instructed to perform the sensor element section temperature elevating control (step 2120 and step 2130, shown in FIG. 21).

More specifically, the CPU 71 of the sixth determination apparatus executes the "air-fuel ratio sensor heater control routine" shown by the flowchart in FIG. 21 in place of FIG. 20 every time the predetermined time elapses. Accordingly, the target admittance Ytgt is set to (at) the usual value Ytujo when the value of the parameter obtaining permission flag Xkyoka is "0." The target admittance Ytgt is set to (at) the "elevated value Ytup (=Ytujo+ΔY)" when the value of the parameter obtaining permission flag Xkyoka is "1."

Consequently, by the processes following step 2020 executed by the CPU 71, the air-fuel ratio sensor element temperature in the period in which the base indicating amount (detected air-fuel ratio changing rate ΔAF) which is the base data for the air-fuel ratio fluctuation indicating amount AFD is being obtained (parameter obtaining period) becomes higher than the air-fuel ratio sensor element temperature in the usual period (parameter non-obtaining period in which the detected air-fuel ratio changing rate ΔAF is not being obtained). Consequently, the air-fuel ratio fluctuation indicating amount AFD and the imbalance determination parameter X, both more accurately representing the cylinder-by-cylinder air-fuel ratio difference, can be obtained.

Meanwhile, the CPU 71 of the sixth determination apparatus, similarly to the CPU 71 of the fourth determination apparatus, estimates the air-fuel ratio sensor element temperature Temps based on the "value corresponding to the amount of the current flowing through the heater", and determines the imbalance determination threshold Xth based on the estimated air-fuel ratio sensor element temperature Temps.

According to the configuration described above, the air-fuel ratio sensor element temperature Temps can accurately be estimated regardless of whether or not the air-fuel ratio sensor 67 has deteriorated with age. Consequently, the imbalance determination threshold Xth can be obtained while considering the "effect on the imbalance determination parameter X of the responsiveness of the air-fuel ratio sensor changing depending on the air-fuel ratio sensor element temperature Temps." Accordingly, the imbalance determination can be accurately performed.

Further, the air-fuel ratio sensor element temperature during the usual period is maintained at the relatively low temperature (usual temperature, first temperature t1), and accordingly, it can be avoided for the air-fuel ratio sensor to early deteriorate (with age) as compared to the case in which the air-fuel ratio sensor element temperature is always maintained at the relatively high temperature (elevated temperature, second temperature t2).

Seventh Embodiment

Next, there will be described a determination apparatus according to a seventh embodiment of the present invention (hereinafter simply referred to as the "seventh determination apparatus").

The seventh determination apparatus maintains the target admittance Ytgt to (at) the usual target admittance (usual value Ytujo) without changing the target admittance Ytgt when the parameter obtaining permissible condition is satisfied (parameter obtaining permission flag Xkyoka is set to (at) "1") in a case in which a result of the imbalance determination has not been obtained after/since the current start of the engine 10, and obtains the air-fuel ratio fluctuation indicating amount AFD in that state. Thereafter, the seventh determination apparatus estimates the air-fuel ratio sensor element temperature Temps based on the value corresponding to the amount of the current flowing through the heater.

Subsequently, similarly to the fifth determination apparatus, the seventh determination apparatus obtains, as a tentative corrected air-fuel ratio fluctuation indicating amount, the value obtained by correcting the air-fuel ratio fluctuation indicating amount AFD based on the "estimated air-fuel ratio sensor element temperature Temps", and adopts/employs, as a tentative imbalance determination parameter X, the tentative corrected air-fuel ratio fluctuation indicating amount.

Thereafter, the seventh determination apparatus determines that the inter-cylinder air-fuel ratio imbalance state has occurred when the tentative imbalance determination parameter X is larger than the high-side threshold XHith. When and after this determination is obtained, the seventh determination apparatus does not set the target admittance Ytgt to (at) the elevated value Ytup at least until the parameter obtaining permissible condition becomes satisfied after the engine 10 is started next time.

On one hand, the seventh determination apparatus determines that the inter-cylinder air-fuel ratio imbalance state has not occurred when the tentative imbalance determination parameter X is smaller than a "low-side threshold XLoth smaller than the high-side threshold XHith." When and after this determination is obtained, the seventh determination apparatus does not set the target admittance Ytgt to (at) the elevated value Ytup at least until the parameter obtaining permissible condition becomes satisfied after the engine 10 is started next time.

On the other hand, the seventh determination apparatus withholds (making) the determination as to whether or not the inter-cylinder air-fuel-ratio imbalance state has been occurring, when the tentative parameter X is "between the high-side threshold XHith and the low-side threshold XLoth." Withholding conclusion of the imbalance determination may be expressed as withholding the imbalance determination.

Further, when the parameter obtaining permissible condition becomes satisfied in the case in which the imbalance determination is withheld, the seventh determination apparatus sets the target admittance Ytgt to (at) the elevated value Ytup so as to elevate (increase) the air-fuel ratio sensor element temperature. This makes the responsiveness of the air-fuel ratio sensor 67 become higher.

Under this state, similarly to the third determination apparatus and the fifth determination apparatus, the seventh determination apparatus obtains the air-fuel ratio fluctuation indicating amount AFD, estimates the air-fuel ratio sensor element temperature Temps based on the "value corresponding to the amount of the current flowing through the heater", corrects the air-fuel ratio fluctuation indicating amount AFD based on the estimated air-fuel ratio sensor element temperature Temps, and obtains (determines) the corrected air-fuel ratio fluctuation indicating amount (=kh·AFD) obtained by the correction as the imbalance determination parameter X. Thereafter, similarly to the third determination apparatus and the fifth determination apparatus, the seventh determination apparatus performs the imbalance determination based on the comparison between the imbalance determination parameter X and the imbalance determination threshold Xth.

(Actual Operation)

The CPU 71 of the seventh determination apparatus executes the routines shown in FIGS. 12 and 13, similarly to the other determination apparatuses. Further, the CPU 71 of the seventh determination apparatus executes the routines shown in FIGS. 22 to 24 every time a predetermined time elapses. The routines shown in FIGS. 12 and 13 have been already described, and the routines shown in FIGS. 22 to 24 will therefore be described hereinafter. It should be noted that each step shown in FIGS. 22 to 24 at which the same processing is performed as each step which has been already described is given the same numeral as one given to such step.

The CPU 71 executes the air-fuel ratio sensor heater control routine shown in FIG. 22 so that it sets the target admittance Ytgt to (at) the elevated value Ytup in a case where all of the following conditions are satisfied at step 2250, and it sets the target admittance Ytgt to (at) the usual value Ytujo in the other cases at step 2240.

The value of the parameter obtaining permission flag Xkyoka is "1" (refer to the "No" determination at step 2210).

The result of the imbalance determination has not been obtained yet since the current start of the engine 10 (refer to the "Yes" determination at step 2220).

The imbalance determination has been withheld (refer to the "Yes" determination at step 2230).

Further, the CPU 71 performs the heater control by the processes of steps from 2020 to 2060.

The CPU 71 executes a "first imbalance determination routine" shown by a flowchart in FIG. 23 every time the predetermined sampling interval is elapses. According to this routine, the air-fuel ratio fluctuation indicating amount AFD is obtained at step 2320 when all of the following conditions are satisfied. The process of step 2320 includes the processes of steps from step 1410 to 1440 shown in FIG. 14.

The value of the parameter obtaining permission flag Xkyoka is "1" (refer to the "Yes" determination at step 2305).

The result of the imbalance determination has not been obtained yet since the current start of the engine 10 (refer to the "Yes" determination at step 2310).

The imbalance determination has not been withheld (refer to the "Yes" determination at step 2315).

Then, after the CPU 71 confirms that the air-fuel ratio fluctuation indicating amount AFD has been obtained at step 2325, the CPU 71 executes processes of steps from step 2330 to 2340 one after another, and then proceeds to step 2345.

Step 2330: The CPU 71 estimates the air-fuel ratio sensor element temperature Temps based on the blurred value SD of the heater duty Duty.

Step 2335: The CPU 71 determines the correction value kh by applying the air-fuel ratio sensor element temperature Temps estimated at step 2330 to the correction value calculation table Mapkh(Temps) shown in FIG. 16 (or the correction value calculation table Mapkhanother(Temps)).

Step 2340: The CPU 71 obtains, as a tentative corrected air-fuel ratio fluctuation indicating amount, the value (=kh·AFD) obtained by multiplying the "air-fuel ratio fluctuation indicating amount AFD obtained at step 2320" by the "correction value kh obtained at step 2335", and obtains (determines), as a tentative imbalance determination parameter X, the tentative corrected air-fuel ratio fluctuation indicating amount itself.

Subsequently, the CPU 71 executes processes described below, and thereafter, proceeds to step 2395.

The CPU 71 determines that the inter-cylinder air-fuel ratio imbalance state has occurred when the tentative imbalance determination parameter X is larger than the high-side threshold XHith (step 2345 and step 2350).

The CPU 71 determines that the inter-cylinder air-fuel ratio imbalance state has not occurred when the tentative imbalance determination parameter X is smaller than the low-side threshold XLoth (step 2355 and step 2360).

The CPU 71 withholds (making) the imbalance determination when the tentative parameter X is equal to or smaller than the high-side threshold XHith, and is equal to or larger than the low-side threshold XLoth (step 2345, step 2355, and step 2365).

The CPU 71 executes a "second imbalance determination routine" shown by a flowchart in FIG. 24 every time the predetermined sampling interval is elapses. According to this routine, the air-fuel ratio fluctuation indicating amount AFD is obtained at step 2440 when all of the following conditions are satisfied. The process of step 2440 includes the processes of steps from step 1410 to 1440 shown in FIG. 14.

The value of the parameter obtaining permission flag Xkyoka is "1" (refer to the "Yes" determination at step 2410).

The result of the imbalance determination has not been obtained yet since the current start of the engine 10 (refer to the "Yes" determination at step 2420).

The imbalance determination has been withheld (refer to the "Yes" determination at step 2430).

Then, after the CPU 71 confirms that the air-fuel ratio fluctuation indicating amount AFD has been obtained at step 2450, the CPU 71 executes processes of steps from step 2460 to 2480 one after another, and then proceeds to step 1460.

Step 2460: The CPU 71 estimates the air-fuel ratio sensor temperature Temps based on the blurred value SD of the heater duty Duty.

Step 2470: The CPU 71 determines the correction value kh by applying the air-fuel ratio sensor element temperature Temps estimated at step 2460 to the correction value calculation table Mapkh(Temps) shown in FIG. 16 (or the correction value calculation table Mapkhanother(Temps)).

Step 2480: The CPU 71 obtains, as a final corrected air-fuel ratio fluctuation indicating amount, the value (=kh·AFD) obtained by multiplying the "air-fuel ratio fluctuation indicating amount AFD obtained at step 2440" by the "correction value kh obtained at step 2470", and obtains (determines), as a final imbalance determination parameter X, the final corrected air-fuel ratio fluctuation indicating amount itself.

Thereafter, the CPU 71 proceeds to steps following step 1460 to perform the imbalance determination by comparing the final imbalance determination parameter X obtained at step 2480 and the imbalance determination threshold Xth, similarly to the CPU 71 of the third and fifth determination apparatuses. That is, the CPU 71 determines that the inter-cylinder air-fuel ratio imbalance state has occurred when the imbalance determination parameter X is larger than the imbalance determination threshold Xth (step 1460 and step 1465), and determines that the inter-cylinder air-fuel ratio imbalance state has not occurred when the imbalance determination parameter X is smaller than the imbalance determination threshold Xth (step 1460 and step 1470).

As described above, according to the seventh determination apparatus, the air-fuel ratio fluctuation indicating amount AFD is obtained while the air-fuel ratio sensor element temperature is maintained at the usual temperature, estimates the air-fuel ratio sensor element temperature Temps based on the value corresponding to the current flowing through the heater 678, and obtains the corrected air-fuel ratio fluctuation indicating amount by correcting the air-fuel ratio fluctuation indicating amount AFD based on the air-fuel ratio sensor element temperature Temps. Further, the CPU 71 obtains, as the tentative imbalance determination parameter X, the corrected air-fuel ratio fluctuation indicating amount, and performs the imbalance determination using the tentative imbalance determination parameter X.

As a result, in the case where the determination has successfully been made as to whether or not the inter-cylinder air-fuel ratio imbalance state has occurred, the air-fuel ratio sensor element temperature is not elevated/increased to the elevated temperature. Accordingly, it can be avoided for the air-fuel ratio sensor to early deteriorate (with age).

Further, in the case where the determination can not be made as to whether or not the inter-cylinder air-fuel ratio imbalance state has occurred using the tentative imbalance determination parameter X (in the case where the imbalance determination has been withheld), the seventh determination apparatus elevates/increases the air-fuel ratio sensor element temperature to the elevated temperature, and obtains the air-fuel ratio fluctuation indicating amount AFD in that state. Further, the seventh determination apparatus estimates the air-fuel ratio sensor element temperature Temps based on the value corresponding to the current flowing through the heater 678 while the air-fuel ratio fluctuation indicating amount AFD is obtained. Further, the seventh determination apparatus obtains the corrected air-fuel ratio fluctuation indicating amount by correcting the air-fuel ratio fluctuation indicating amount AFD based on the estimated air-fuel ratio sensor element temperature Temps, and adopts/employs, as the final imbalance determination parameter X, the corrected air-fuel ratio fluctuation indicating amount. Furthermore, the seventh determination apparatus performs the imbalance determination using the final imbalance determination parameter X. Accordingly, the imbalance determination parameter X which accurately represents the cylinder-by-cylinder air-fuel ratio difference is obtained, similarly to the first, third, and fifth determination apparatus, and the imbalance determination can therefore be made accurately.

Eighth Embodiment

Next, there will be described a determination apparatus according to an eighth embodiment of the present invention (hereinafter simply referred to as the "eighth determination apparatus").

The eighth determination apparatus performs the air-fuel ratio sensor heater control, similarly to the seventh determination apparatus. That is, the eighth determination apparatus maintains the target admittance Ytgt to (at) the usual target admittance (usual value Ytujo) without changing the target admittance Ytgt when the parameter obtaining permissible condition is satisfied (parameter obtaining permission flag Xkyoka is set to (at) "1") in the case in which the result of the imbalance determination has not been obtained after/since the current start of the engine 10, and obtains the air-fuel ratio fluctuation indicating amount AFD in that state. Thereafter, the eighth determination apparatus adopts/employs, as a tentative imbalance determination parameter X, the air-fuel ratio fluctuation indicating amount AFD, and estimates the air-fuel ratio sensor element temperature Temps based on the value corresponding to the current flowing through the heater during the period in which the air-fuel ratio fluctuation indicating amount AFD is obtained.

Subsequently, the eighth determination apparatus determines a high-side threshold XHith based on the "estimated air-fuel ratio sensor element temperature Temps", and determines a low-side threshold XLoth smaller than the high-side threshold XHith based on the "estimated air-fuel ratio sensor element temperature Temps."

Thereafter, the eighth determination apparatus determines that the inter-cylinder air-fuel ratio imbalance state has occurred when the tentative imbalance determination parameter X is larger than the high-side threshold XHith. When and after this determination is obtained, the eighth determination apparatus does not set the target admittance Ytgt to (at) the elevated value Ytup at least until the parameter obtaining permissible condition becomes satisfied after the engine 10 is started next time.

On one hand, the eighth determination apparatus determines that the inter-cylinder air-fuel ratio imbalance state has not occurred when the tentative imbalance determination parameter X is smaller than the low-side threshold XLoth. When and after this determination is obtained, the eighth determination apparatus does not set the target admittance Ytgt to (at) the elevated value Ytup at least until the parameter obtaining permissible condition becomes satisfied after the engine 10 is started next time.

On the other hand, the eighth determination apparatus withholds (making) the determination as to whether or not the inter-cylinder air-fuel-ratio imbalance state has been occurring, when the tentative parameter X is "between the high-side threshold XHith and the low-side threshold XLoth."

Further, similarly to the seventh determination apparatus, when the parameter obtaining permissible condition becomes satisfied in the case in which the imbalance determination is withheld, the eighth determination apparatus sets the target admittance Ytgt to (at) the elevated value Ytup so as to elevate (increase) the air-fuel ratio sensor element temperature. This makes the responsiveness of the air-fuel ratio sensor 67 become higher.

Under this state, similarly to the fourth and sixth determination apparatuses, the eighth determination apparatus obtains the air-fuel ratio fluctuation indicating amount AFD, and adopts/employs, as the imbalance determination parameter X, the air-fuel ratio fluctuation indicating amount AFD. Furthermore, the eighth determination apparatus estimates the air-fuel ratio sensor element temperature Temps based on the "value corresponding to the amount of the current flowing through the heater 678" in a period in which the air-fuel ratio fluctuation indicating amount AFD is obtained, and determines the imbalance determination threshold Xth based on the estimated air-fuel ratio sensor element temperature Temps. Thereafter, similarly to the fourth and sixth determination apparatuses, the eighth determination apparatus perform the imbalance determination parameter based on the comparison between the imbalance determination parameter X and the imbalance determination threshold Xth.

(Actual Operation)

The CPU 71 of the eighth determination apparatus executes the routines shown in FIGS. 12 and 13, similarly to the other determination apparatuses. Further, the CPU 71 of the eighth determination apparatus executes the routines shown in FIGS. 22, 25 and 26 every time a predetermined time elapses. The routines shown in FIGS. 12, 13, and 22 have been already described, and the routines shown in FIGS. 25 and 26 will therefore be described hereinafter. It should be noted that each step shown in FIGS. 25 and 26, at which the same processing is performed as each step which has been already described, is given the same numeral as one given to such step.

The CPU 71 executes a "first imbalance determination routine" shown by a flowchart in FIG. 25 every time the predetermined sampling interval is elapses. This routine is different from the routine shown in FIG. 23 only in that step 2335 and step 2340, shown in FIG. 23, are replaced by the step 2510 and 2520, shown in FIG. 25.

That is, after the CPU 71 confirms that the air-fuel ratio fluctuation indicating amount AFD has been obtained at step 2325, the CPU 71 proceeds to step 2330 to estimate the air-fuel ratio sensor element temperature Temps based on the blurred value SD of the heater duty Duty.

Subsequently, the CPU 71 proceeds to step 2510 to obtain (determine) the "air-fuel ratio fluctuation indicating amount AFD obtained at step 2320" itself, as the tentative imbalance determination parameter X.

Subsequently, at step 2520, the CPU 71 determines a high-side threshold XHith based on the "air-fuel ratio sensor element temperature Temps estimated at step 2330", and determines a low-side threshold XLoth based on the "air-fuel ratio sensor element temperature Temps estimated at step 2330." At this time, each of the high-side threshold XHith and the low-side threshold XLoth is determined in such a manner that each of those becomes larger as the air-fuel ratio sensor element temperature Temps becomes larger.

Thereafter, the CPU 71 executes the processes following step 2345, and proceeds to step 2395. Consequently, the imbalance determination is carried out based on the tentative imbalance determination parameter X, and the imbalance determination is withheld when the tentative parameter X is equal to or smaller than the high-side threshold XHith, and is equal to or larger than the low-side threshold XLoth.

The CPU 71 executes a "second imbalance determination routine" shown by a flowchart in FIG. 26 every time the predetermined sampling interval is elapses. This routine is different from the routine shown in FIG. 24 only in that step 2470 and step 2480, shown in FIG. 24, are replaced by the step 2610 and 2620, shown in FIG. 26.

That is, after the CPU 71 confirms that the air-fuel ratio fluctuation indicating amount AFD has been obtained at step 2450, the CPU 71 proceeds to step 2460 to estimate the air-fuel ratio sensor element temperature Temps based on the blurred value SD of the heater duty Duty.

Subsequently, the CPU 71 proceeds to step 2610 to obtain (determine) the "air-fuel ratio fluctuation indicating amount AFD obtained at step 2440" itself, as the final imbalance determination parameter X.

Subsequently, at step 2620, the CPU 71 determines an imbalance determination threshold Xth based on the "air-fuel ratio sensor element temperature Temps estimated at step 2460." This step is the same as step 1710 shown in FIG. 17. Accordingly, the imbalance determination is determined in such a manner that the imbalance determination threshold Xth becomes larger as the air-fuel ratio sensor element temperature Temps becomes higher.

Thereafter, the CPU 71 executes the processes following step 1460 to thereby perform the imbalance determination by comparing the imbalance determination parameter X obtained at step 2610 with the imbalance determination threshold Xth determined at step 2620. That is, the CPU 71 determines that the inter-cylinder air-fuel ratio imbalance state has occurred when the imbalance determination parameter X is larger than the imbalance determination threshold Xth (step 1460 and step 1465), and determines that the inter-cylinder air-fuel ratio imbalance state has not occurred when the imbalance determination parameter X is smaller than the imbalance determination threshold Xth (step 1460 and step 1470).

As described above, according to the eighth determination apparatus, the air-fuel ratio fluctuation indicating amount AFD is obtained while the air-fuel ratio sensor element temperature is maintained at the usual temperature, and adopts/employs, as the tentative imbalance determination parameter X, the air-fuel ratio fluctuation indicating amount AFD. Further, the eighth determination apparatus estimates the air-fuel ratio sensor element temperature Temps based on the value corresponding to the current flowing through the heater 678 while the air-fuel ratio fluctuation indicating amount AFD is obtained. Furthermore, the eighth determination apparatus determines, based on the estimated air-fuel ratio sensor element temperature Temps, each of the high-side threshold XHith and the low-side threshold XLoth. Then, the eighth determination apparatus performs the imbalance determination based on the comparison between the tentative imbalance determination parameter X and each of the high-side threshold XHith and the low-side threshold XLoth.

In the case where the determination has been made as to whether or not the inter-cylinder air-fuel ratio imbalance state has occurred as the result of that, the air-fuel ratio sensor element temperature is not elevated/increased to the elevated temperature. Accordingly, it can be avoided for the air-fuel ratio sensor to early deteriorate.

Further, in the case where the determination can not be made as to whether or not the inter-cylinder air-fuel ratio imbalance state has occurred using the tentative imbalance determination parameter X (in the case where the imbalance determination has been withheld), the eighth determination apparatus elevates/increases the air-fuel ratio sensor element temperature to the elevated temperature, obtains the air-fuel ratio fluctuation indicating amount AFD in that state, and obtains the air-fuel ratio fluctuation indicating amount AFD as the final imbalance determination parameter X. Further, the eighth determination apparatus estimates the air-fuel ratio sensor element temperature Temps based on the value corresponding to the current flowing through the heater 678 while the air-fuel ratio fluctuation indicating amount AFD is obtained. Furthermore, the eighth determination apparatus determines the imbalance determination threshold Xth based on the estimated air-fuel ratio sensor element temperature Temps.

The eighth determination apparatus performs the imbalance determination using the final imbalance determination parameter X and the imbalance determination threshold Xth. Accordingly, similarly to the second, fourth, and sixth determination apparatuses, the imbalance determination parameter X which accurately represents the cylinder-by-cylinder air-fuel ratio difference is obtained, and the imbalance determination can therefore be made accurately.

As described above, each of the determination apparatuses according to each of the embodiments of the present invention estimates the air-fuel ratio sensor element temperature Temps (temperature of the solid electrolyte layer 671) having a strong relation with the responsiveness of the air-fuel ratio sensor 67, and determines, based on the air-fuel ratio sensor element temperature Temps, "the imbalance determination parameter and/or the imbalance determination threshold." Accordingly, the imbalance determination parameter or the imbalance determination threshold becomes the value reflecting the responsiveness of the air-fuel ratio sensor 67 varying depending on the air-fuel ratio sensor element temperature. Consequently, the determination apparatus according to each of the embodiments can accurately determine whether or not the inter-cylinder air-fuel-ratio imbalance state has occurred.

The present invention is not limited to the above-described embodiments, and may adopt various modifications within the scope of the present invention. For example, the air-fuel ratio fluctuation indicating amount AFD may be one of parameters obtained as described below.

(P1) The air-fuel ratio fluctuation indicating amount AFD may be a value corresponding to the trace/trajectory length of the output value Vabyfs of the air-fuel ratio sensor 67 (base indicating amount) or the trace/trajectory length of the detected air-fuel ratio abyfs (base indicating amount). For example, the trace length of the detected air-fuel ratio abyfs may be obtained by obtaining the output value Vabyfs every elapse of the definite sampling time ts, converting the output value Vabyfs into the detected air-fuel ratio abyfs, and integrating/accumulating an absolute value of a difference between the detected air-fuel ratio abyfs and a detected air-fuel ratio abyfs which was obtained the definite sampling time ts before.

It is preferable that the trace length be obtained every elapse of the unit combustion cycle period. An average of the trace lengths for a plurality of the unit combustion cycle periods (i.e., the value corresponding to the trace length) may also be adopted as the air-fuel ratio fluctuation indicating amount AFD. It should be noted that the trace length of the output value Vabyfs or the trace length of the detected air-fuel ratio abyfs has a tendency that they become larger as the engine rotational speed becomes higher. Accordingly, when the imbalance determination parameter based on the trace length is used for the imbalance determination, it is preferable that the imbalance determination threshold Xth be made larger as the engine rotational speed NE becomes higher.

(P2) The air-fuel ratio fluctuation indicating amount AFD may be obtained as a value corresponding to a base indicating amount which is obtained by obtaining a change rate of the change rate of the output value Vabyfs of the air-fuel ratio sensor 67 or a change rate of the change rate of the detected air-fuel ratio abyfs (i.e., a second-order differential value of each of those values with respect to time). For example, the air-fuel ratio fluctuation indicating amount AFD may be a maximum value of absolute values of the "second-order differential value ($d^2$(Vabyfs)/$dt^2$) of the output value Vabyfs of the air-fuel ratio sensor 67 with respect to time" in the unit combustion cycle period, or a maximum value of absolute values of the "second-order differential value ($d^2$(abyfs)/$dt^2$) of the detected air-fuel ratio abyfs represented by the output value Vabyfs of the upstream air-fuel ratio sensor 67 with respect to time" in the unit combustion cycle period.

For example, the change rate of the change rate of the detected air-fuel ratio abyfs may be obtained as follows.

The output value Vabyfs is obtained every elapse of the definite sampling time ts.

The output value Vabyfs is converted into the detected air-fuel ratio abyfs.

A difference between the detected air-fuel ratio abyfs and a detected air-fuel ratio abyfs obtained the definite sampling time ts before is obtained as the change rate of the detected air-fuel ratio abyfs.

A difference between the change rate of the detected air-fuel ratio abyfs and a change rate of the detected air-fuel ratio abyfs obtained the definite sampling time ts before is obtained as the change rate of the change rate of the detected air-fuel ratio abyfs (second-order differential value ($d^2$(abyfs)/$dt^2$).

In this case, among a plurality of the change rates of the change rate of the detected air-fuel ratio abyfs, that are obtained during the unit combustion cycle period, a value whose absolute value is the largest may be selected as a representing value. In addition, such a representing value may be obtained for each of a plurality of the unit combustion cycle periods. Further, an average of a plurality of the representing values may be adopted as the air-fuel ratio fluctuation indicating amount AFD.

In addition, each of the determination apparatuses adopts the differential value d(abyfs)/dt (detected air-fuel ratio changing rate ΔAF) as the base indicating amount, and adopts, as the air-fuel ratio fluctuation indicating amount AFD, the value based on the average of the absolute values of the base indicating amounts in the unit combustion cycle period.

On the other hand, each of the determination apparatuses may obtain the differential value d(abyfs)/dt (detected air-fuel ratio changing rate ΔAF) as the base indicating amount, obtain a value P1 whose absolute value is the largest among a plurality of the differential values d(abyfs)/dt, each of which is obtained in the unit combustion cycle period and has a positive value, obtain a value P2 whose absolute value is the largest among the differential values d(abyfs)/dt, each of which is obtained in the unit combustion cycle period and has a negative value, and adopt a value whichever larger between the value P1 and the value P2, as the base indicating amount. Then, the each of the determination apparatuses may adopt, as the air-fuel ratio fluctuation indicating amount AFD, a mean value of absolute values of the base indicating amounts that are obtained in a plurality of unit combustion cycle periods.

Furthermore, each of the determination apparatuses described above may be applied to a V-type engine. In such a case, the V-type engine may comprise, a right bank upstream catalyst disposed at a position downstream of an exhaust gas merging portion of two or more of cylinders belonging to a right bank (a catalyst disposed in the exhaust passage of the engine and at a position downstream of the exhaust gas merging portion into which the exhaust gases merge, the exhaust gases being discharged from chambers of at least two or more of the cylinders among a plurality of the cylinders), and a left bank upstream catalyst disposed at a position downstream of an exhaust gas merging portion of two or more of cylinders belonging to a left bank (a catalyst disposed in the exhaust passage of the engine and at a position downstream of the exhaust merging portion into which the exhaust gases merge, the exhaust gases being discharged from chambers of two or more of the cylinders among the rest of the at least two or more of the cylinders).

Further, the V-type engine may comprise an upstream air-fuel ratio sensor for the right bank and a downstream air-fuel ratio sensor for the right bank disposed upstream and downstream of the right bank upstream catalyst, respectively, and may comprise upstream air-fuel ratio sensor for the left bank and a downstream air-fuel ratio sensor for the left bank disposed upstream and downstream of the left bank upstream catalyst, respectively. Each of the upstream air-fuel ratio sensors, similarly to the air-fuel ratio sensor 67, is disposed between the exhaust gas merging portion of each of the banks and the upstream catalyst of each of the banks. In this case, a main feedback control for the right bank and a sub feedback for the right bank are performed based on the output values of the upstream air-fuel ratio sensor for the right bank and the downstream air-fuel ratio sensor for the right bank, and a main feedback control for the left bank and a sub feedback for the left bank are independently performed based on the output values of the upstream air-fuel ratio sensor for the left bank and the downstream air-fuel ratio sensor for the left bank.

Further, in this case, the determination apparatus may obtain "an imbalance determination parameter X corresponding to an air-fuel ratio fluctuation indicating amount AFD" for the right bank based on the output value of the upstream air-fuel ratio sensor for the right bank, and may determine whether or not an inter-cylinder air-fuel ratio imbalance state has been occurring among the cylinders belonging to the right bank using the parameter.

Similarly, the determination apparatus may obtain "an imbalance determination parameter X corresponding to an air-fuel ratio fluctuation indicating amount AFD" for the left bank based on the output value of the upstream air-fuel ratio sensor for the left bank, and may determine whether or not an inter-cylinder air-fuel ratio imbalance state has been occurring among the cylinders belonging to the left bank using the parameter.

In addition, each of the determination apparatuses may change the imbalance determination threshold Xth (including the high-side threshold XHith and the low-side threshold XLoth) in such a manner that the threshold Xth becomes larger as the intake air-flow rate Ga becomes larger. This is because the responsiveness of the air-fuel ratio sensor 67 becomes lower as the intake air-flow rate Ga becomes smaller, due to the presence of the protective covers 67*b* and 67*c*.

Furthermore, it is preferable that the high-side threshold XHith be equal to or larger than the imbalance determination threshold Xth, and the low-side threshold XLoth be equal to or smaller than the imbalance determination threshold Xth. It should be noted that the high-side threshold XHith may be smaller than the imbalance determination threshold Xth, if it can be clearly determined that the inter-cylinder air-fuel ratio imbalance state has been occurring when the tentative imbalance determination parameter X is larger than the high-side threshold XHith. Similarly, the low-side threshold XLoth may be a value which allows/enables the apparatus to clearly determine that the inter-cylinder air-fuel ratio imbalance state has not been occurring when the tentative imbalance determination parameter X is smaller than the low-side threshold XLoth.

Further, each of the determination apparatuses comprises indicated fuel injection amount control means for controlling the indicated fuel injection amount in such a manner that the air-fuel ratio of the mixture supplied to the combustion chambers of the two or more of the cylinders coincides with the target air-fuel ratio (routines shown in FIGS. 12 and 13). The instructed fuel injection amount control means includes air-fuel ratio feedback control means for calculating the air-fuel ratio feedback amount (DFi), based on the air-fuel ratio (detected air-fuel ratio abyfs) represented by the output value Vabyfs of the air-fuel ratio sensor 67 and the target air-fuel ratio abyfr, in such a manner that those values become equal to each other, and for determining (adjusting, controlling) the instructed fuel injection amount based on the air-fuel ratio feedback amount (DFi) (step 1240 shown in FIG. 12 and the routine shown in FIG. 13). In addition, the instructed fuel injection amount control means may be feedforward control means, for example, for determining (controlling), as the instructed fuel injection amount, a value obtained by dividing the in-cylinder intake air amount (air amount taken into a single cylinder per one intake stroke) Mc determined based on the intake air flow rate and the engine rotational speed by the target air-fuel ratio abyfr, without including the air-fuel ratio feedback control means. That is, the main feedback amount DFi shown in the routine of FIG. 12 may be set to (at) "0."

Furthermore, the heater control means of each of the determination apparatuses described above may be configured so as to set the heater duty Duty to 100% (i.e., to set the amount of energy supplied to the heater 678 to the maximum value) when the actual admittance Yact is smaller than the "value obtained by subtracting the predetermined positive value a from the target admittance Ytgt", set the heater duty Duty to "0" (i.e., to set the amount of energy supplied to the heater 678 to the minimum value) when the actual admittance Yact is larger than the "value obtained by adding the predetermined positive value a to the target admittance Ytgt", and set the heater duty Duty to a "predetermined value (e.g., 50%) larger than 0 and smaller than 100%" when the actual admittance Yact is between the "value obtained by subtracting the predetermined positive value a from the target admittance Ytgt" and the "value obtained by adding the predetermined positive value $\alpha$ to the target admittance Ytgt."

It is also preferable that the imbalance determining means of each of the determination apparatuses be configured so as to start obtaining the air-fuel ratio fluctuation indicating amount AFD (in actuality, the detected air-fuel ratio change rate $\Delta$AF) after a predetermined delay time Tdelay has elapsed since a point in time at which it instructs the heater control means to perform the sensor element section temperature elevating control.

A predetermined time is necessary from a point in time the amount of energy supplied to the heater 678 is increased to a point in time at which the air-fuel ratio sensor element temperature is actually elevated. Accordingly, by the configuration described above, the air-fuel ratio fluctuation indicating amount AFD can be obtained based on the output value Vabyfs of the air-fuel ratio sensor 67 after a point in time at which the air-fuel ratio sensor element temperature becomes sufficiently high, and the responsiveness of the air-fuel ratio sensor 67 thus becomes sufficiently high. Accordingly, the imbalance determination parameter X more accurately representing the cylinder-by-cylinder air-fuel ratio difference can be obtained.

In this case, the imbalance determining means may be configured so as to shorten the delay time Tdelay as a temperature Tex of the exhaust gas becomes higher. The air-fuel ratio sensor element temperature rapidly becomes high as the temperature Tex of the exhaust gas is higher. Accordingly, the delay time Tdelay can be set to be shorter as the temperature Tex of the exhaust gas becomes higher.

The temperature Tex of the exhaust gas may be obtained by the exhaust gas temperature sensor, or be estimated based on an "operating parameter of the engine 10, which correlates with the temperature Tex of the exhaust gas (e.g., intake air flow rate Ga measured by the air flow meter 61, engine load KL, engine rotational speed NE, and so on)."

More specifically, the imbalance determining means of each of the determination apparatuses may be configured so as to have the delay time Tdelay be shorter as "the intake air flow rate Ga or the engine load KL" is greater.

Further, each of the fifth and sixth apparatuses may be configured so as to have the heater control means perform the sensor element section temperature elevating control at a point in time at which a warming-up of the engine is completed after the start of the engine 10 (i.e., at the time of completion of the warming-up, specifically, at a point in time at which the cooling water temperature THW reaches a threshold cooling water temperature THWth indicating the completion of the warming-up), and so as to have the heater control means ends the sensor element section temperature elevating control at a point in time at which the obtaining the air-fuel ratio fluctuation indicating amount AFD has been completed.

In a case in which the engine 10 has not been completely warmed up yet after the start of the engine 10, moisture in the exhaust gas is easily cooled down so as to thereby be likely to form water droplets. In a case in which such water droplets likely adhere to the air-fuel ratio sensor 67 (hereinafter, this is expressed as "the air-fuel ratio sensor gets wet with water"), if the temperature of the sensor element section is elevated by the sensor element section temperature elevating control, a great temperature unevenness in the sensor element section occurs in the case where the air-fuel ratio sensor gets wet with water, and thus, the sensor element section may crack/dunt (be broken). Accordingly, it is not preferable to perform the sensor element section temperature elevating control immediately after the start of the engine.

In contrast, it is unlikely that the air-fuel ratio sensor 67 gets wet with water after the point in time at which the warming-up of the engine 10 has been completed. Accordingly, as the configuration described above, if the sensor element section temperature elevating control is started at the point in time at which the warming-up of the engine 10 has been completed, the possibility that the air-fuel ratio sensor 67 becomes broken is low. In addition, according to the configuration, the chances in which the air-fuel ratio sensor element temperature is sufficiently high when the parameter obtaining condition becomes satisfied can be increased, the chances in which the imbalance determination parameter which is accurate is obtained can be increased.

Further, each of the apparatuses of the above embodiments may adopt/employ the corrected air-fuel ratio fluctuation indicating amount obtained through the correction on the air-fuel ratio fluctuation indicating amount AFD based on the air-fuel ratio sensor element temperature Temps, and at the same time, determine the imbalance determination threshold Xth based on the air-fuel ratio sensor element temperature Temps.

Further, in the each of the embodiments, the corrected air-fuel ratio fluctuation indicating amount is obtained after the air-fuel ratio fluctuation indicating amount AFD is obtained, however, each of the embodiments may be configured so as to correct the detected air-fuel ratio changing rate ΔAF using the correction value kh every time the detected air-fuel ratio changing rate ΔAF is obtained, and so as to obtain, as the corrected air-fuel ratio fluctuation indicating amount (that is, the imbalance determination parameter), the air-fuel ratio fluctuation indicating amount AFD obtained based on the detected air-fuel ratio changing rate ΔAF which was corrected.

The invention claimed is:

1. An inter-cylinder air-fuel ratio imbalance determination apparatus for an internal combustion engine, applied to a multi-cylinder internal combustion engine having a plurality of cylinders, comprising:

an air-fuel ratio sensor, which is disposed at a position in an exhaust merging portion of an exhaust passage of said engine into which exhaust gases discharged from at least two or more of cylinders among a plurality of said cylinders merge or disposed in said exhaust passage at a position downstream of said exhaust merging portion, and which includes an air-fuel ratio detecting section including a solid electrolyte layer, an exhaust-gas-side electrode layer which is formed on one of surfaces of said solid electrolyte layer, a diffusion resistance layer which covers said exhaust-gas-side electrode layer and which said exhaust gases reach, and an atmosphere-side electrode layer which is formed on the other one of said surfaces of said solid electrolyte layer and is exposed to an atmosphere chamber, wherein, said air-fuel ratio sensor outputs, based on a limiting current flowing through said solid electrolyte layer, an output value corresponding to an air-fuel ratio of an exhaust gas passing through said position at which said air-fuel ratio sensor is disposed, owing to an application of a predetermined voltage between said exhaust-gas-side electrode layer and said atmosphere-side electrode layer;

a plurality of fuel injection valves, each of which is disposed in such a manner that it corresponds to each of said at least two or more of said cylinders, and each of which injects fuel, contained in an air-fuel mixture supplied to each of combustion chambers of said two or more of said cylinders, in an amount in accordance with an instructed fuel injection amount;

imbalance determining unit, which is configured to perform an imbalance determination by obtaining, based on said output value of said air-fuel ratio sensor, an air-fuel ratio fluctuation indicating amount which becomes larger as a fluctuation of an air-fuel ratio of an exhaust gas passing through said position at which said air-fuel ratio sensor is disposed becomes larger, in a parameter obtaining period which is a period in which a predetermined parameter obtaining condition is being satisfied; by performing a comparison between an imbalance determination parameter obtained based on said obtained air-fuel ratio fluctuation indicating amount and a predetermined imbalance determination threshold; and by determining that an inter-cylinder air-fuel ratio imbalance state has occurred when said imbalance determination parameter is larger than said imbalance determination threshold and determining that said inter-cylinder air-fuel ratio imbalance state has not occurred when said imbalance determination parameter X is smaller than said imbalance determination threshold;

wherein, said imbalance determining unit includes:

an element temperature estimating portion configured to estimate an air-fuel ratio sensor element temperature which is a temperature of said solid electrolyte layer during said parameter obtaining period; and a pre-comparison preparation portion configured to perform at least one of determinations before performing said comparison between said imbalance determination parameter and said imbalance determination threshold, wherein one of said determinations being to obtain a corrected air-fuel ratio fluctuation indicating amount by performing, on said obtained air-fuel ratio fluctuation indicating amount, a correction to decrease said obtained air-fuel ratio fluctuation indicating amount as said estimated air-fuel ratio sensor element temperature becomes higher with respect to a specific temperature, and/or, a correction to increase said obtained air-fuel ratio fluctuation indicating amount as said estimated air-fuel ratio sensor element temperature becomes lower with respect to said specific temperature, and to determine, as said imbalance determination parameter, a value corresponding to said corrected air-fuel ratio fluctuation indicating amount; and the other of said determinations being to determine, based on said estimated air-fuel ratio sensor element temperature, said imbalance determination threshold, in such a manner that said imbalance determination threshold increases as said estimated air-fuel ratio sensor element temperature becomes higher.

2. The inter-cylinder air-fuel ratio imbalance determination apparatus according to claim 1, wherein said air-fuel ratio sensor includes a heater which produces heat when a current is flowed through said heater to heat a sensor element section including said solid electrolyte layer, said exhaust-gas-side electrode layer, and said atmosphere-side electrode layer; and said inter-cylinder air-fuel ratio imbalance determination apparatus further comprises heater control unit, which is configured to control an amount of heat generation of said heater in such a manner that a difference between a value corresponding to an actual admittance or an actual impedance of said solid electrolyte layer and a predetermined target value becomes smaller;

wherein, said element temperature estimating portion is configured to estimate said air-fuel ratio sensor element temperature based on at least a value corresponding to an amount of a current flowing through said heater.

3. The inter-cylinder air-fuel ratio imbalance determination apparatus according to claim 2, wherein said element temperature estimating portion is further configured to estimate said air-fuel ratio sensor element temperature based on an operating parameter of said engine correlating to a temperature of said exhaust gas.

4. The inter-cylinder air-fuel ratio imbalance determination apparatus according to claim 3, wherein said imbalance determining unit is configured to instruct said heater control unit to perform, in said parameter obtaining period, a sensor element section temperature elevating control to have said temperature of said sensor element section during said parameter obtaining period higher than said temperature of said sensor element section during a period other than said parameter obtaining period; and said heater control unit is configured to realize said sensor element section temperature elevating control by having said target value when it is instructed to perform said sensor element section temperature elevating control different from said target value when it is not instructed to perform said sensor element section temperature elevating control.

* * * * *

UNITED STATES PATENT AND TRADEMARK OFFICE

CERTIFICATE OF CORRECTION

PATENT NO. : 8,401,765 B2
APPLICATION NO. : 13/516841
DATED : March 19, 2013
INVENTOR(S) : Yasushi Iwazaki et al.

It is certified that error appears in the above-identified patent and that said Letters Patent is hereby corrected as shown below:

Title page, Item (75) change the fifth inventor's residence from "Shizuoka-ken (JP)" to -- Sunto-gun (JP) --.

Signed and Sealed this
Thirtieth Day of July, 2013

Teresa Stanek Rea
*Acting Director of the United States Patent and Trademark Office*